US009644916B2

(12) United States Patent
Hobson

(10) Patent No.: US 9,644,916 B2
(45) Date of Patent: May 9, 2017

(54) MODULAR WEAPON STATION SYSTEM

(71) Applicant: Merrill Aviation, Inc., Saginaw, MI (US)

(72) Inventor: James C. Hobson, West Bloomfield, MI (US)

(73) Assignee: Merrill Aviation, Inc., Saginaw, MI (US)

( * ) Notice: Subject to any disclaimer, the term of this patent is extended or adjusted under 35 U.S.C. 154(b) by 215 days.

(21) Appl. No.: 14/623,244

(22) Filed: Feb. 16, 2015

(65) Prior Publication Data

US 2016/0258704 A1 Sep. 8, 2016

Related U.S. Application Data

(60) Provisional application No. 61/939,886, filed on Feb. 14, 2014.

(51) Int. Cl.

| | |
|---|---|
| ***F41A 27/18*** | (2006.01) |
| ***F41A 25/00*** | (2006.01) |
| ***F41A 27/28*** | (2006.01) |
| ***F41A 23/24*** | (2006.01) |

(52) U.S. Cl.

CPC ..... *F41A 27/18* (2013.01); *F41A 23/24* (2013.01); *F41A 25/00* (2013.01); *F41A 27/28* (2013.01)

(58) Field of Classification Search

CPC ..... F41A 9/54; F41A 9/79; F41A 9/86; F41A 27/18; F41A 27/28; F41A 23/24

USPC ..... 89/33.14, 34, 33.01, 36.13, 33.16, 37.07

See application file for complete search history.

(56) References Cited

U.S. PATENT DOCUMENTS

| | | | | |
|---|---|---|---|---|
| 2,349,454 | A | 5/1944 | O'Hare et al. | |
| 2,364,425 | A | 12/1944 | Corte | |
| 2,378,191 | A | 6/1945 | Corte | |
| 2,391,888 | A | 1/1946 | Elliott | |
| 2,464,689 | A | 3/1949 | Jackson | |
| 2,477,264 | A | 7/1949 | Pearson et al. | |
| 2,483,334 | A * | 9/1949 | D'Assis-Fonseca ..... | F41A 9/54 89/33.14 |
| 2,573,749 | A | 11/1951 | Wheeler et al. | |
| 2,582,225 | A * | 1/1952 | Bowser ..... | F41A 17/08 89/134 |

(Continued)

FOREIGN PATENT DOCUMENTS

| | | |
|---|---|---|
| WO | WO-2005118295 A2 | 12/2005 |
| WO | WO-2008097255 A2 | 8/2008 |

*Primary Examiner* — Michael David

(74) *Attorney, Agent, or Firm* — Butzel Long; Bill C. Panagos

(57) ABSTRACT

A modular weapon station includes a rotatable frame adapted to be mounted on a platform and is configured to have a removable cradle with a weapon mounted thereon. The rotatable frame may also include a removable ammunition feed chute, an optical sighting unit, and azimuth and elevation drives. The modular weapon station may also include a rotatable drum and ammunition loading assembly coupled with the rotatable frame assembly. The rotatable drum and ammunition loading assembly may be located in an under armor position such that an operator may replenish ammunition from an under armor position and not be subjected to hostile fire while replenishing ammunition. Belted ammunition rounds may travel along an ammunition feed path stemming from the loading assembly within the rotatable drum to a selected weapon.

9 Claims, 59 Drawing Sheets

(56) References Cited

U.S. PATENT DOCUMENTS

| | | | | |
|---|---|---|---|---|
| 2,710,561 | A | 6/1955 | Dowd | |
| 3,218,930 | A * | 11/1965 | Girouard | F41A 9/16 89/45 |
| 3,333,507 | A | 8/1967 | Meiss | |
| 4,137,820 | A | 2/1979 | Clemens | |
| 4,280,394 | A * | 7/1981 | Singenberger | F41A 27/08 89/37.02 |
| 4,469,005 | A | 9/1984 | Schaulin et al. | |
| 4,593,600 | A | 6/1986 | Kaustrater | |
| 4,662,264 | A | 5/1987 | Kaustrater | |
| 4,982,650 | A | 1/1991 | Bender-Zanoni et al. | |
| 5,949,015 | A | 9/1999 | Smith et al. | |
| 7,546,794 | B1 | 6/2009 | Sarles et al. | |
| 8,448,557 | B2 | 5/2013 | Hamish et al. | |
| 8,763,511 | B2 | 7/2014 | Schvartz et al. | |
| 8,833,228 | B2 | 9/2014 | Chachamian et al. | |
| 2008/0289485 | A1 | 11/2008 | Quinn et al. | |
| 2015/0267989 | A1* | 9/2015 | Hobson | F41A 23/24 89/37.12 |

* cited by examiner

MODULAR WEAPON STATION SYSTEM

CROSS-REFERENCE TO RELATED APPLICATION

This application claims priority to U.S. Provisional Patent Application No. 61/939,886 filed on Feb. 14, 2014, which is hereby incorporated by reference in its entirety.

BACKGROUND

As the nature of combat confrontation has changed, it has become more common to use weapon systems for multiple purposes and multiple missions. This is especially apparent in urban settings and when facing asymmetric opponents. In order to fulfill the expectations imposed upon them, it is necessary that military ordinance delivery systems have the capability to retrofit weapons systems that meet the requirements of the new combat realities. Weapon systems should offer interchangeability of weapons upon the same mounting structures, ease of operation, ease of replenishing ammunition, and ease of maintenance.

There is a need for a robust weapon system featuring interchangeability of ordinance delivery systems, ease of operation, ease of replenishing ammunition, ease of maintenance, and ease of retrofit to existing weapons platforms.

SUMMARY

In one embodiment, a modular weapon station is described. Modular weapon station can be tailored to the specific mission needs of a user, including provisions for alternate weapons and the ability to be installed and integrated on a variety of vehicles, naval, or ground-based structures. Modular weapon station may be manually aimed and fired, or by the addition of specific functional modules, the operating characteristics and performance of the weapon station can be upgraded. These functional modules include electric azimuth and elevation drives, control electronics, inertial sensors, external or internal ammunition handling, and alternate sighting sub-systems. In its maximum-capability configuration, a modular weapon station is lightweight, fully stabilized, configured to be loaded from an under armor position in an ergonomic manner, and may be accurately fired-on-the-move from a moving vehicle in day or night conditions.

DETAILED DESCRIPTION

Multiple embodiments of modular weapon station 10 are described with reference to the drawings, wherein like numerals reference like structures. Although modular weapon station 10 may be illustrated and described herein as including particular components in a particular configuration, the components and configuration shown and described are provided for example purposes only. The Figures and descriptions of the embodiments described herein are not intended to limit the breadth or the scope of the inventive concepts or the appended claims in any manner. Rather, the figures and detailed descriptions of modular weapon station 10 are provided to illustrate the inventive concepts to a person of ordinary skill in the art and to enable such person to make and use the inventive concepts.

Direct/External Ammunition Feed Assembly

Figure 1:
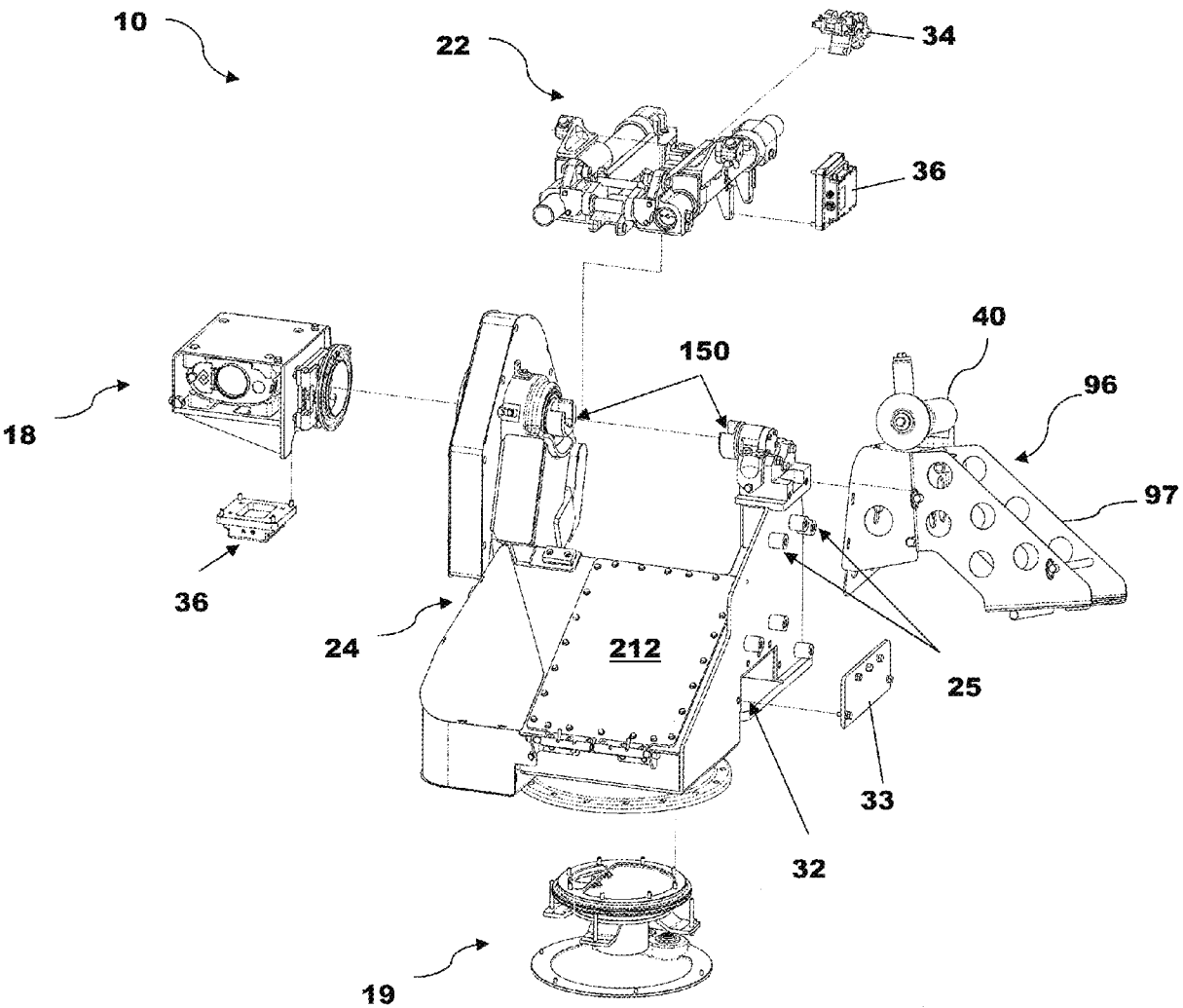
FIG. 1 is an exploded perspective view of a modular weapon station featuring external loading capabilities.

Turning now to the drawings, modular weapon station 10 may be configured in a direct feed mode as shown in FIG. 1. Direct ammunition feed assembly 96 may be mounted to rotatable frame 24 via fasteners 25. The direct ammunition feed assembly 96 includes a direct feed bracket 97 that holds and secures an ammunition box 334 (not shown) that in turn houses ammunition rounds to be fired by weapon 21. The direct feed assembly 96 further includes an ammunition feed 40 and side ammunition feed 48 to aid in the transport of ammunition rounds from the externally mounted ammunition box 334 to weapon 21. Direct feed bracket 97 may be angled with respect to a longitudinal axis so as to facilitate a smooth ammunition feed into weapon 21 regardless of whether the weapon is fired from its maximum elevation or depression. The angled orientation of the direct feed bracket 97 will be discussed in greater detail with respect to the load under armor ammunition feed chute 20 discussed later in the disclosure.

To replenish the externally mounted ammunition box 334, an operator of modular weapon station 10 must leave the safety of an armored structure, such as an armored vehicle or vessel, and either add ammunition rounds to the empty ammunition box or simply replace the depleted ammunition box with a loaded ammunition box. The operator must then feed the new belted ammunition rounds into the weapon 21.

Modular weapon station 10 may be rotated or slewed 360 degrees in an azimuth direction so that weapon 21 may be fired in any direction. Resolver/slip ring assembly 19 permits modular weapon station 10 to be electrically connected to the systems of an armored structure despite its 360 degree azimuth capabilities. Electrical connections for power, communications, networking, etc. permit modular weapon station 10 to be controlled remotely or from within the armored structure. Despite an operator's ability to remotely control a modular weapon station 10 having a direct ammunition feed assembly 96, an operator may be exposed to hostile fire if called upon to replenish ammunition.

Load Under Armor

Figure 2A:
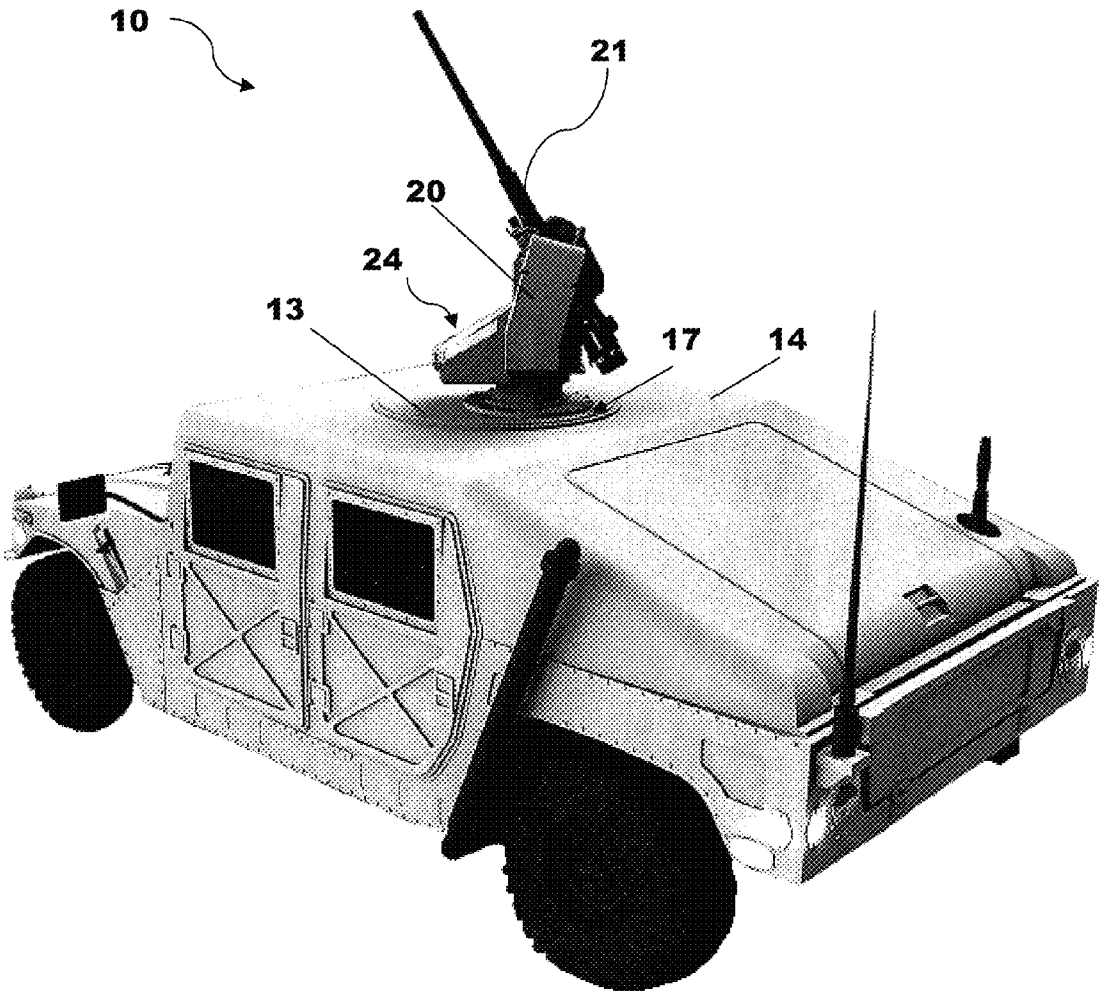
FIG. 2A is a perspective view of a modular weapon station mounted on an armored vehicle that features loading under armor capabilities.

Alternatively, modular weapon station 10 may be configured to be loaded from an under armor position. FIG. 2A is a perspective view of one embodiment of modular weapon station 10 mounted on an armored vehicle that features loading under armor capabilities. This mode is designated as the load under armor mode. As will be described herein, the modular weapon station 10 shown in FIG. 2A is capable of being loaded from an under armor position. The crew members of the armored vehicle may replenish ammunition without having to expose themselves to hostile fire. Ammunition may be replenished from within the armored structure, or an under armor position.

Figure 2B:
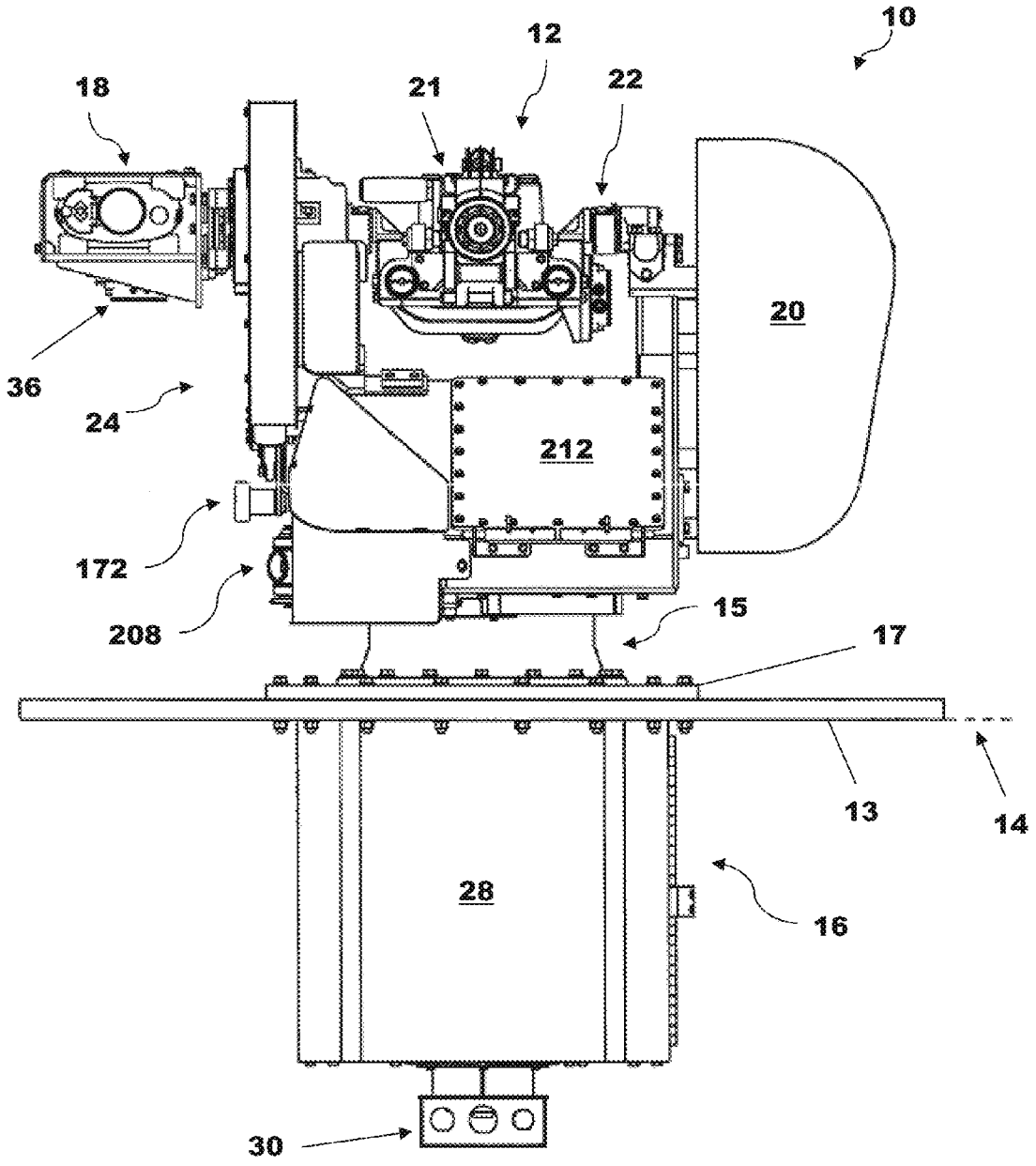
FIG. 2B is a front view of the modular weapon station of FIG. 2A.

FIG. 2B is a front view of the modular weapon station 10 shown in FIG. 2A. Modular weapon station 10 may be mounted on or to virtually any structure or platform 14, such as a vehicle roof, atop the bridge of a vessel, or on a stationary platform. Drum adapter 15 is shown in FIG. 2B mounted on roof adapter plate 13, which in turn is mounted to a platform 14. Rotatable frame 24 is rotatably mounted to drum adapter 15 and which can be rotatably mounted to drum assembly 16 in a manner to be hereinafter described. Rotatable frame 24 may also be rotatable mounted directly with a rotatable inner drum assembly 27 of drum assembly 16. In FIG. 2B, drum assembly 16 is located in an under armor position. The weapon assembly 12 features an optical sighting unit 18 mounted on one side of rotatable frame 24, a weapon 21, and a removable cradle 22. The selected weapon 21 may be mounted on cradle 22 which is configured to absorb recoil and counter-recoil shock in a manner to be herein described later in the disclosure. The cradle 22 is further mountable to rotatable frame 24 to permit a wide range of firing capabilities along an elevation arc 26. A removable ammunition feed chute 20 may be mounted or affixed to rotatable frame 24 opposite the optical sighting unit 18.

Figure 2C:
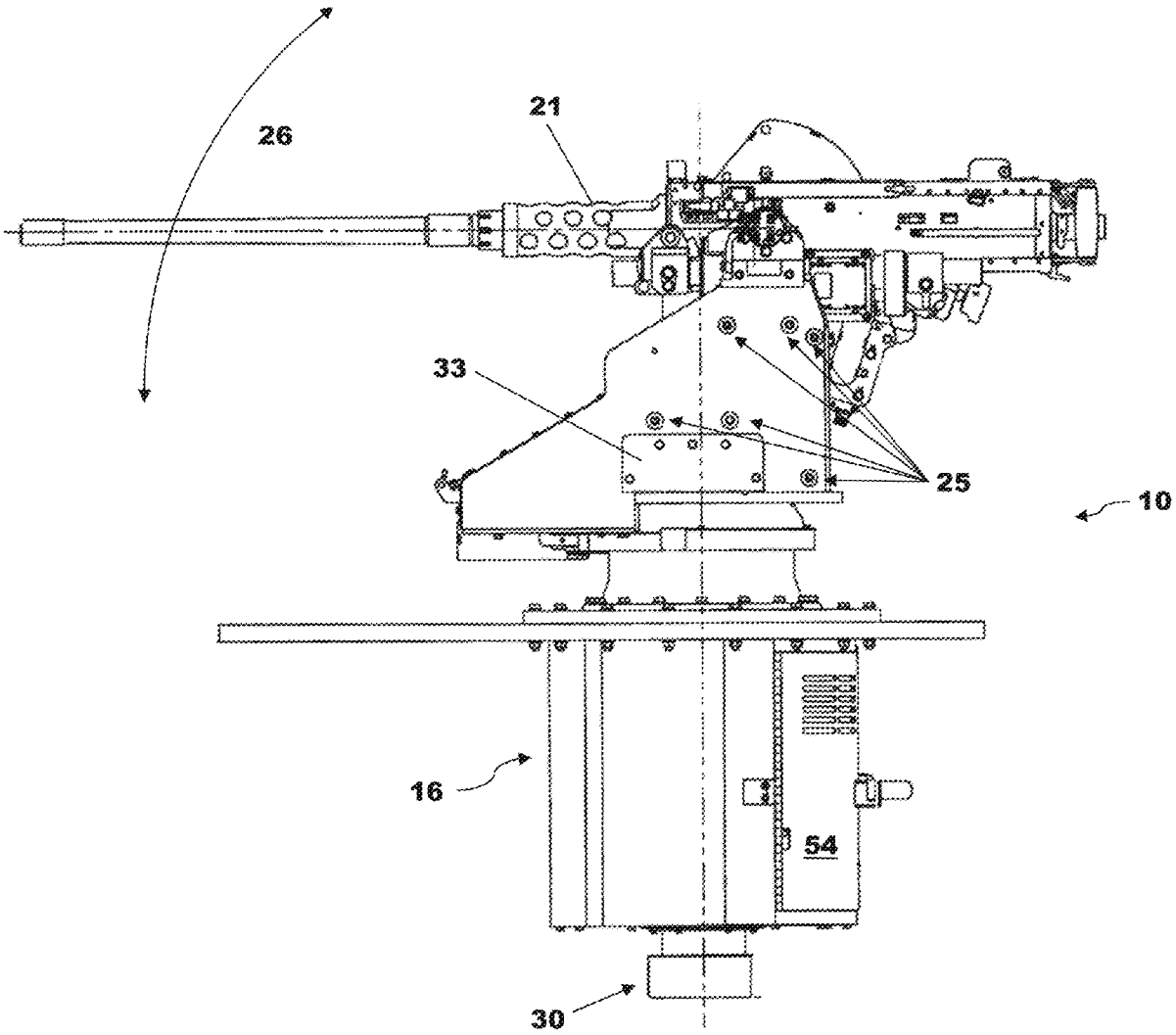
FIG. 2C is a side elevation view of the modular weapon station of FIG. 2A.

Turning to FIG. 2C, a side elevation view of one embodiment of modular weapon station 10 is shown. In FIG. 2C, ammunition feed chute 20 has been removed for clarity to show how fasteners 25 are disposed on rotatable frame 24. Fasteners 25 allow a variety of ammunition chutes to be attached to rotatable frame 24. Fasteners 25 are also disposed on rotatable frame 24 to permit an externally mounted direct ammunition feed assembly 96 to be attached, as illustrated in FIG. 1. It can be understood by reference to elevation arc 26 that weapon 21 may be moveable along elevation arc 26, which in this example is an elevation range of 90 degrees (−30 degrees to +60 degrees), so that the modular weapon station 10 has broad application to various combat situations, including aerial attack by, for example, helicopters.

As seen in both FIGS. 2B and 2C, the drum assembly 16 has an outer drum assembly 28 affixed to platform 14 or roof adapter plate 13 at one end (its top end) and is equipped with electrical connector access 30 at its opposite end (its bottom end). The drum assembly is generally located beneath a platform 14 such that the drum assembly 16 may be located in an under armor position. Outer drum assembly 28 may be rigidly coupled with the overhead platform 14; outer drum assembly 28 may be stationary and functions to protect crew members from being harmed by rotating components within the drum assembly 16. This is especially beneficial in vehicles or armored structures where crew members are in tight quarters, such as the Humvee shown in FIG. 2A. The drum assembly 16 is equipped with access doors 54 and 56, which will be described in further detail with reference to FIGS. 7A through 7D.

Figure 3A:
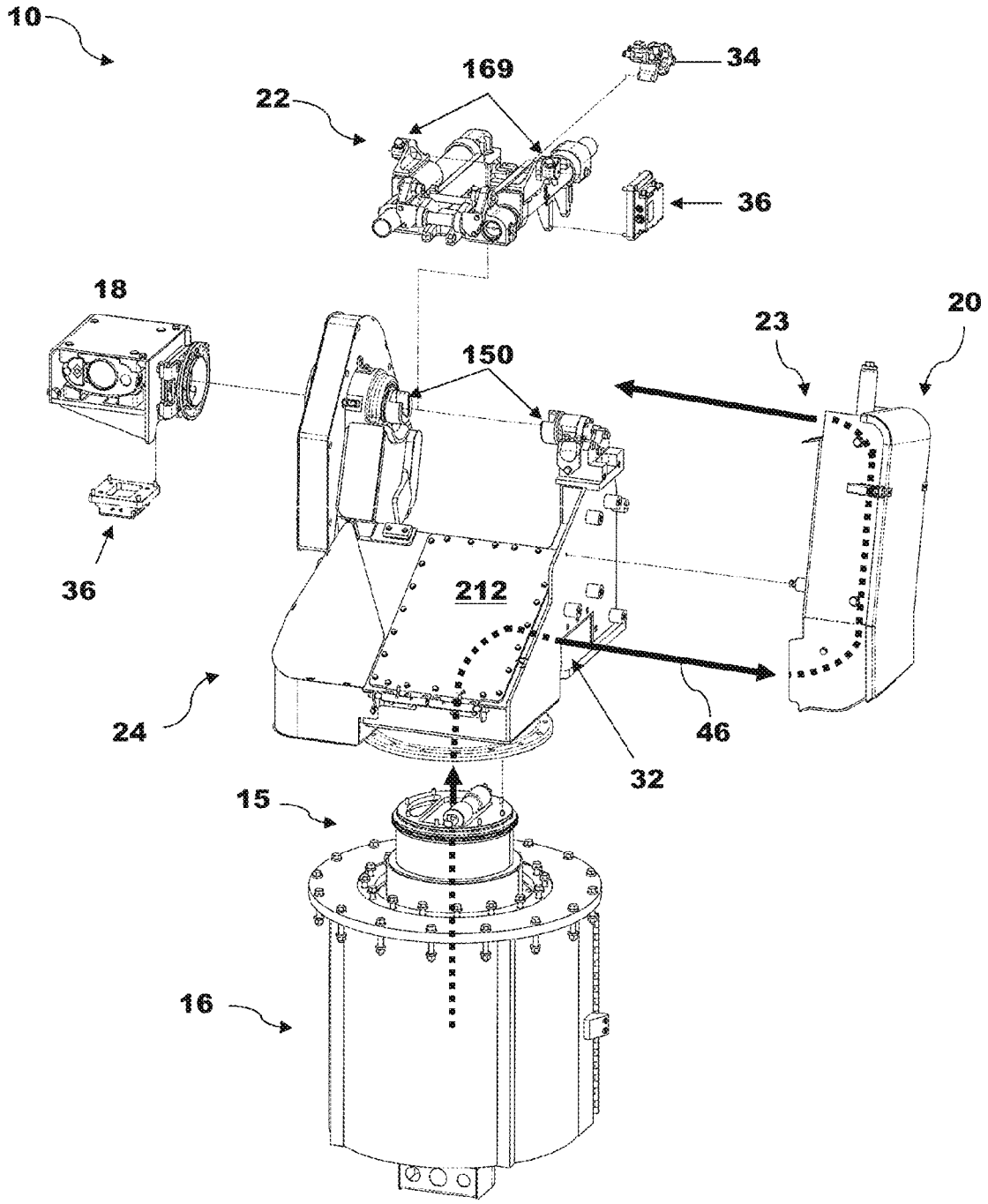
FIG. 3A is an exploded perspective view of the modular weapon station of FIG. 2A.
Figure 3B:
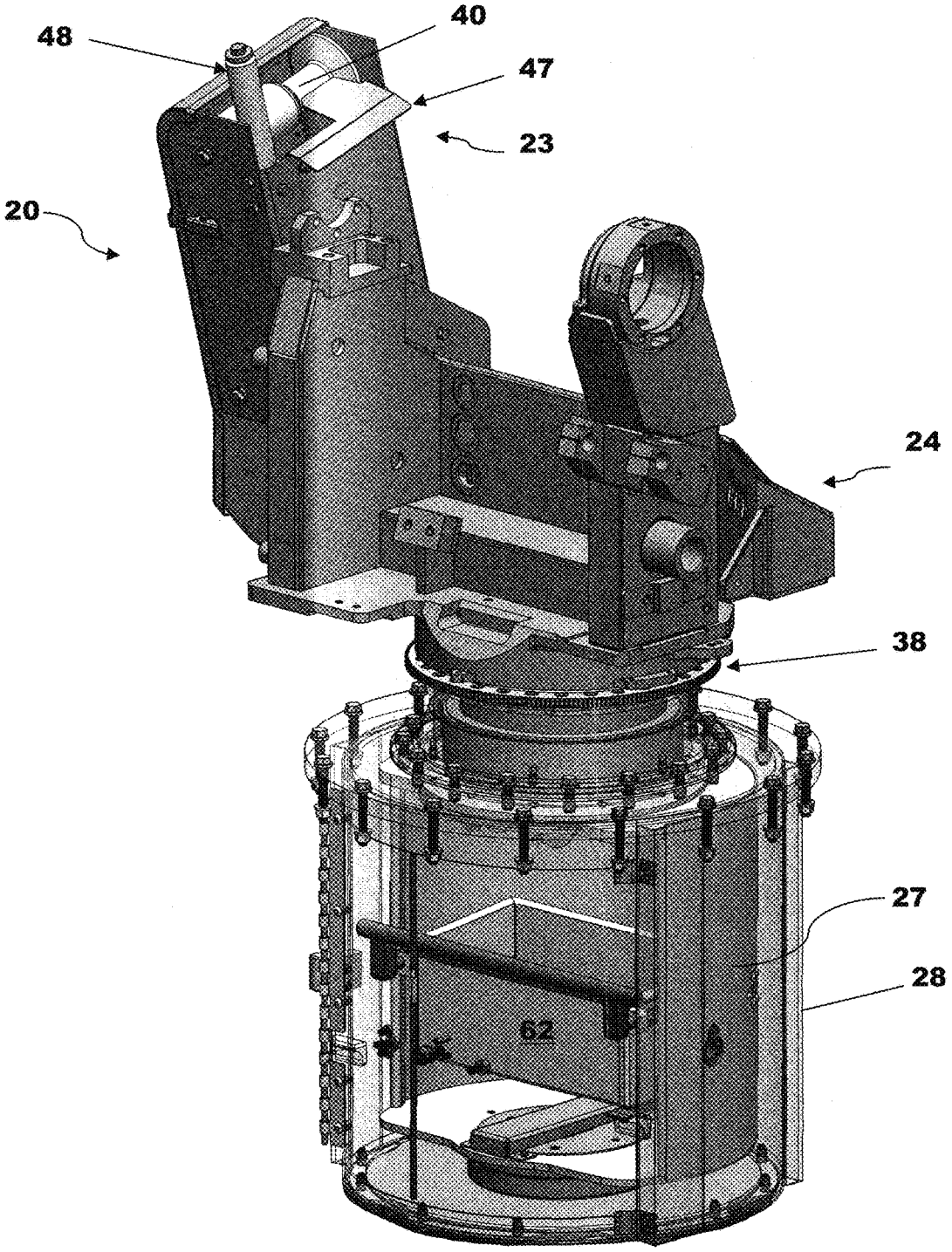
FIG. 3B is a schematic view of a modular weapon station having load under armor capabilities showing an ammunition tray pivotably mounted within an inner drum assembly.

As seen more clearly in FIG. 3B, drum assembly 16 also includes an inner drum assembly 27, which is a rotatable drum that may be optionally substantially enclosed by outer drum assembly 28. In FIG. 3B, outer drum assembly 28 is transparent so that inner drum assembly 27 may be visible. Ammunition tray 62 is shown mounted within the inner drum assembly 27. As will be described in greater detail later in the disclosure, ammunition tray 62 may be pivoted downward for ease of loading ammunition. An operator may load the ammunition or new ammunition box 334 into the ammunition tray 62 and connect or link the new ammunition belt to the existing ammunition belt hanging down into the rotatable inner drum assembly 27. A low ammunition sensor 57 may be configured to alert an operator when ammunition has been depleted to a predetermined amount. A predetermined amount, by way of example, may be an amount of ammunition remaining such that only a few rounds of the belted ammunition are hanging into the rotatable inner drum assembly 27 for linking of new rounds to the existing rounds. A predetermined amount could also be an amount where a partially fired ammunition round is below say, a quarter of the remaining ammunition rounds, and the armored vehicle has not detected an enemy target in proximity where the armored vehicle or crew members could be harmed. The system may detect this favorable opening for ammunition to be replenished and signal to an operator accordingly. No matter the selected predetermined amount, it is advantageous for at least a few ammunition rounds to be draped into the rotatable inner drum assembly so that an operator may link new rounds to the partially fired existing round. If ammunition can be linked within the drum assembly 16, the necessity to leave the under armor position to replenish ammunition is eliminated.

The low ammunition sensor 57 may also be configured to notify an operator that ammunition is running low in the ammunition tray 62. The sensor may be placed in multiple locations and there may be multiple sensors along the ammunition feed path 46 that network together to determine the feed rate of a given weapon and when it is most preferable to notify an operator that ammunition should be replenished. Additionally, modular weapon station 10 may include means to remotely charge or cock the selected weapon 21 so that an operator is not required to leave the under armor position for this reason.

Rotatable inner drum assembly 27 is configured to rotate or slew 360 degrees in an azimuth direction about a vertical axis. Rotatable inner drum assembly 27 and rotatable frame 24 rotate in azimuth in synchronization. Modular weapon station 10 includes azimuth ring gear 38 as shown in FIG. 3B. An azimuth drive pinion 230 (not shown in FIG. 3B), which may be electrically powered, may be in meshing communication with azimuth ring gear 38 to drive modular weapon station 10 about in an azimuth direction by rotating about azimuth ring gear 38 in a planetary-like movement. Azimuth ring gear 38 is stationary; azimuth pinion 230 drives about the azimuth ring gear 38 to rotate modular weapon station 10.

Turning now to FIG. 3A, an exploded perspective view of one embodiment of modular weapon station 10 having load under armor capabilities is shown. Specifically, the modular weapon station 10 has a cradle 22 with a rear clamp assembly 34 to permit locking engagement with a preferred weapon 21, which may for example be an M2 0.50 caliber heavy machine gun or an MK19 40 mm grenade machine gun. Cradle 22 may also optionally include an electric gyro assembly 36, for accurate aiming and handling of the weapon 21 electrically, as well as for stabilizing the weapon 21. Electric gyro assembly 36 may also assist modular weapon station 10 with automatic target tracking capabilities. The optical sighting unit 18 is attached on one side of rotatable frame 24, and may include an optional gyro assembly 36 to combine the sighting and stabilizing capabilities in one unit. Optical sighting unit 18 may include electro-optical (EO), electro-optical infrared (EO/IR), forward looking infrared (FLIR), and/or like sighting capabilities. On the other side of rotatable frame 24, ammunition feed chute 20 is affixed to rotatable frame 24 such that it may be secured in place during operation and easily detached when it is desired to create a direct load weapon system as shown in FIG. 1.

Figure 12A:
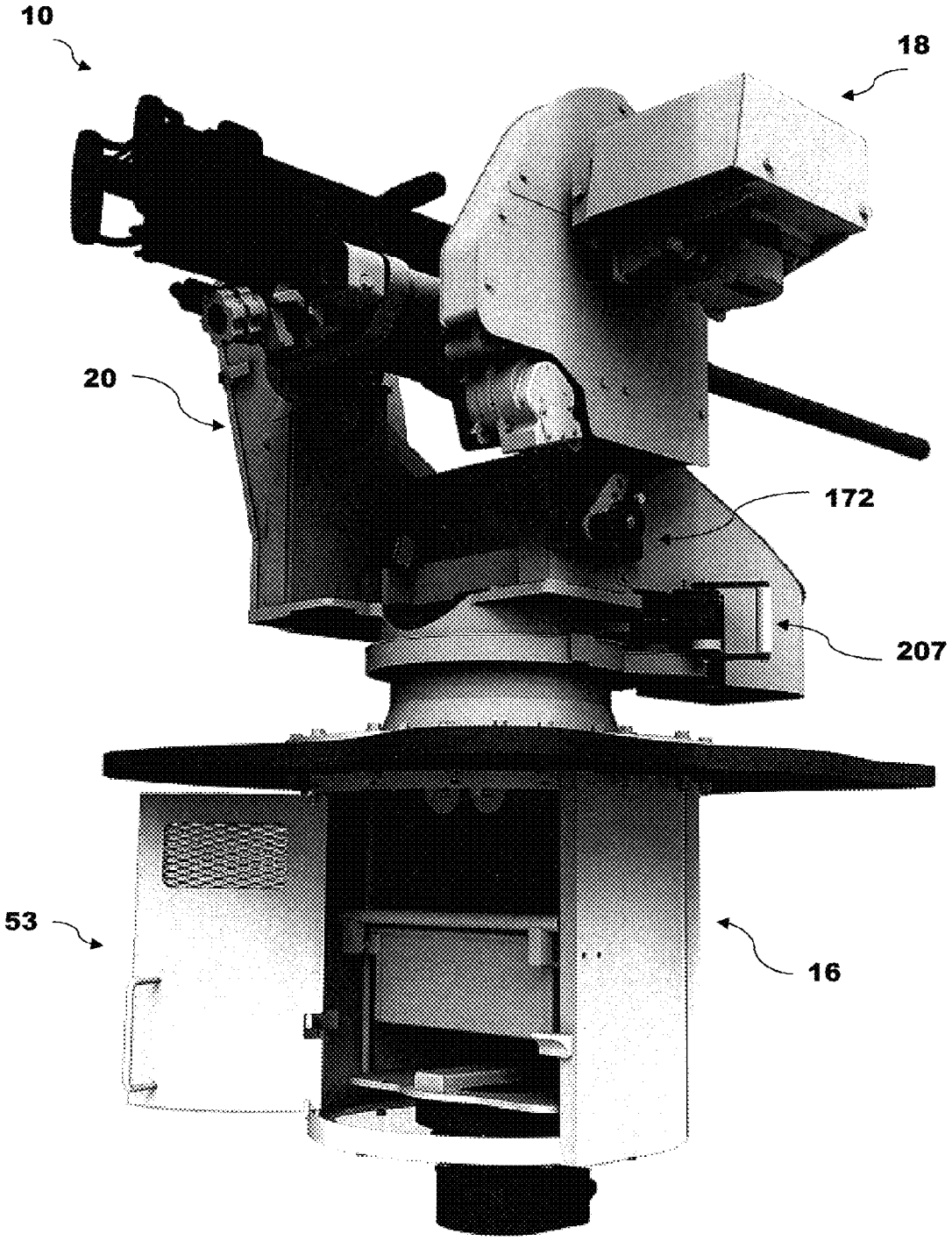
FIG. 12A is a schematic view of a modular weapon station having load under armor capabilities.

FIG. 3A shows the basic flow of ammunition feed path 46. Ammunition feed path 46 is shown having solid lines and dotted lines. The dotted lines denote the ammunition feed path 46 when ammunition would not otherwise be visible through the structures of modular weapon station 10. Solid lines denote the ammunition feed path 46 when ammunition would be visible because it is not blocked by a structure of modular weapon station 10. After ammunition is loaded into ammunition tray 62 and the new ammunition round is linked to the existing (or partially depleted) ammunition round, and the access doors 54 and 56 of drum assembly 16 are closed, weapon 21 may be fired. When weapon 21 is fired, ammunition is pulled and lifted from ammunition tray 62 and exits the drum assembly 16 by traveling through the drum assembly's multiple ammunition feeds 40, which is shown more clearly in FIG. 6C. There may be multiple ammunition feeds 40 at the top portion of the drum assembly 16 to more accurately channel the ammunition rounds up the ammunition feed path 46 as shown in FIG. 12A. Ammunition may be threaded between two ammunition feeds 40 to accomplish this task. Ammunition feeds 40 are exemplary structural means to facilitate the travel of ammunition rounds along the ammunition feed path 46. In the exemplary embodiments disclosed herein, ammunition feeds 40 are shown as rollers coupled with a shaft. Any number of like ammunition feed means or structural elements could be used to facilitate ammunition rounds along the ammunition feed path 46.

Figure 4A:
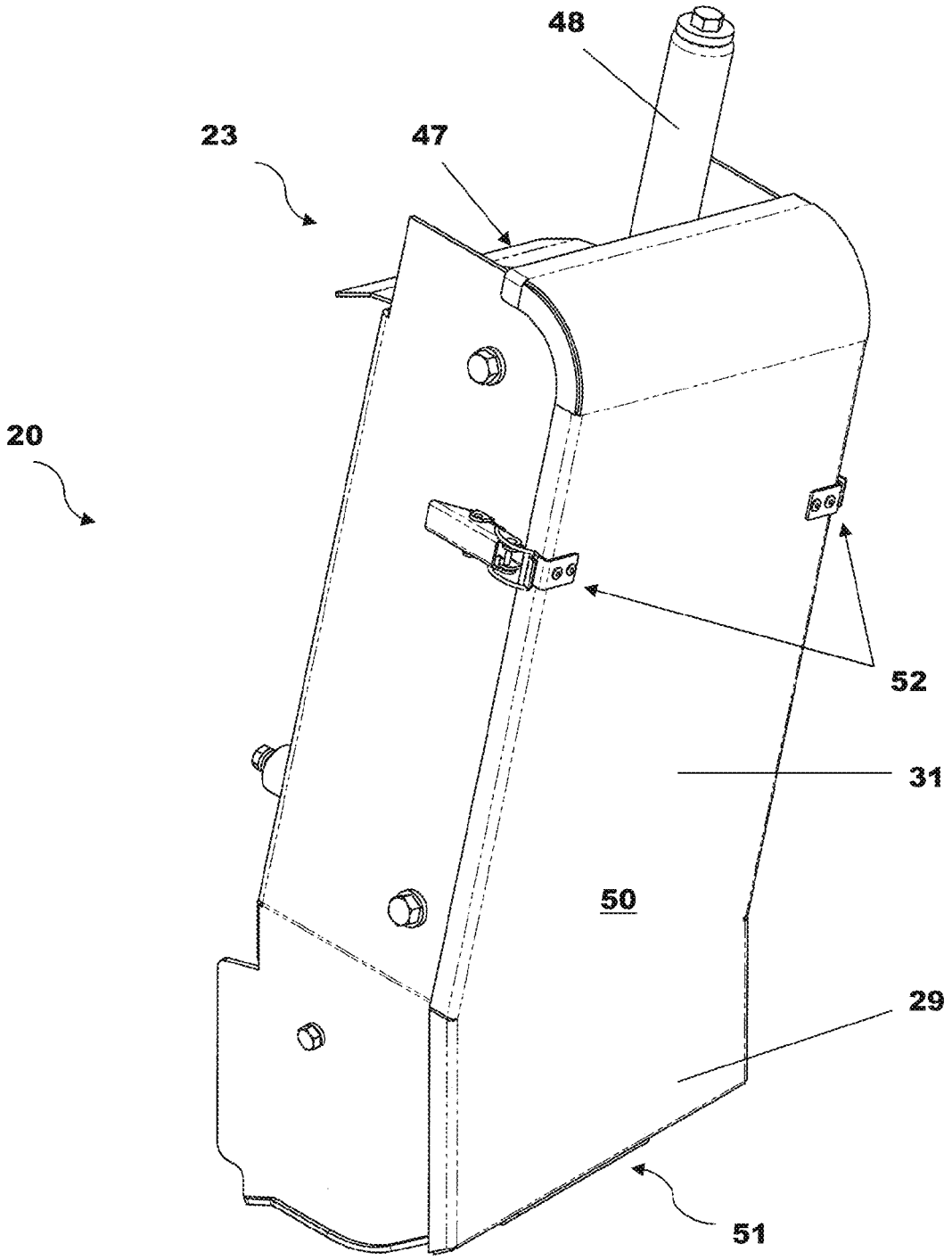
FIG. 4A is a perspective view of an assembled load under armor ammunition feed chute.
Figure 4B:
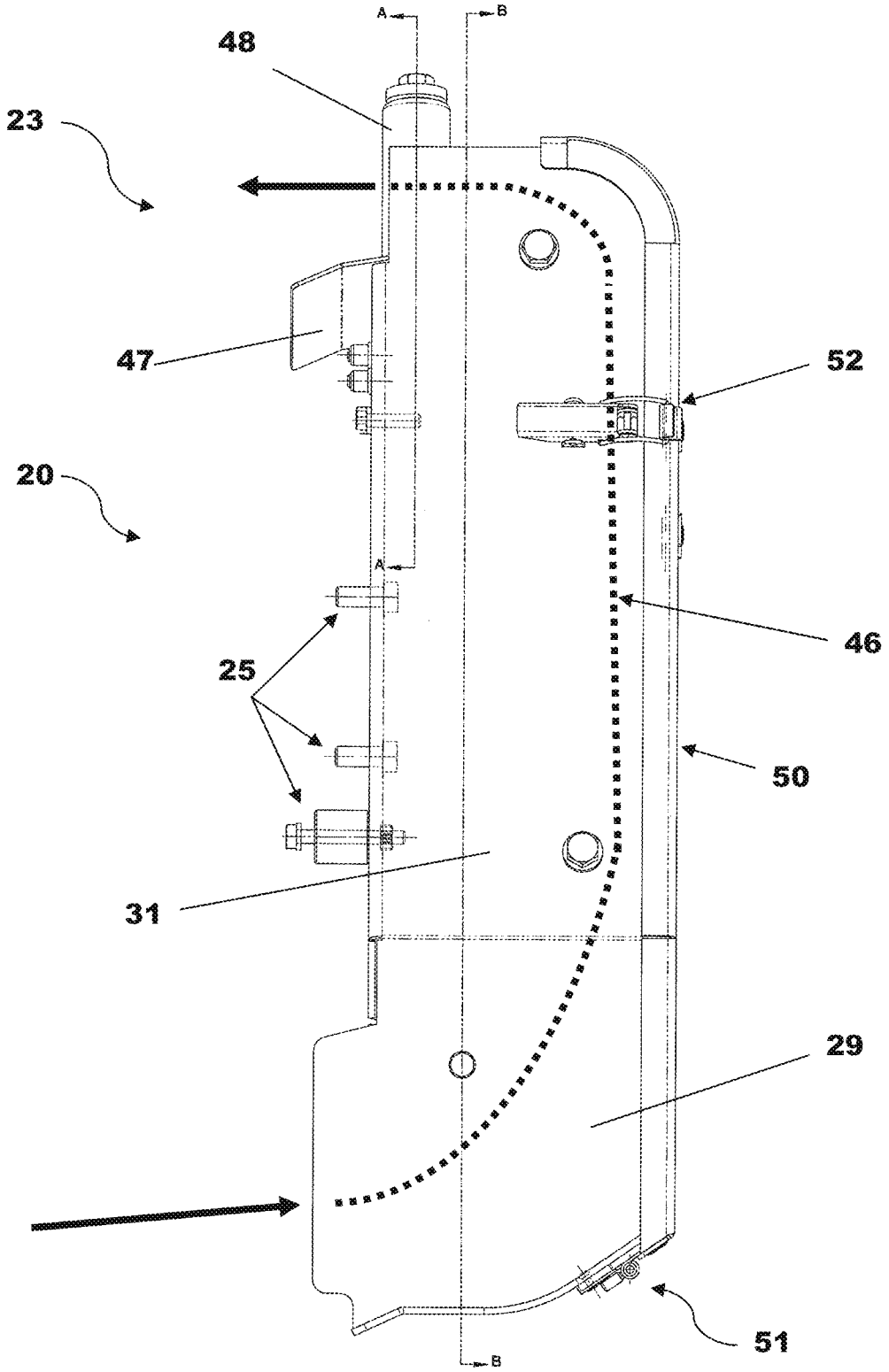
FIG. 4B is a front view of a load under armor ammunition feed chute.
Figure 4C:
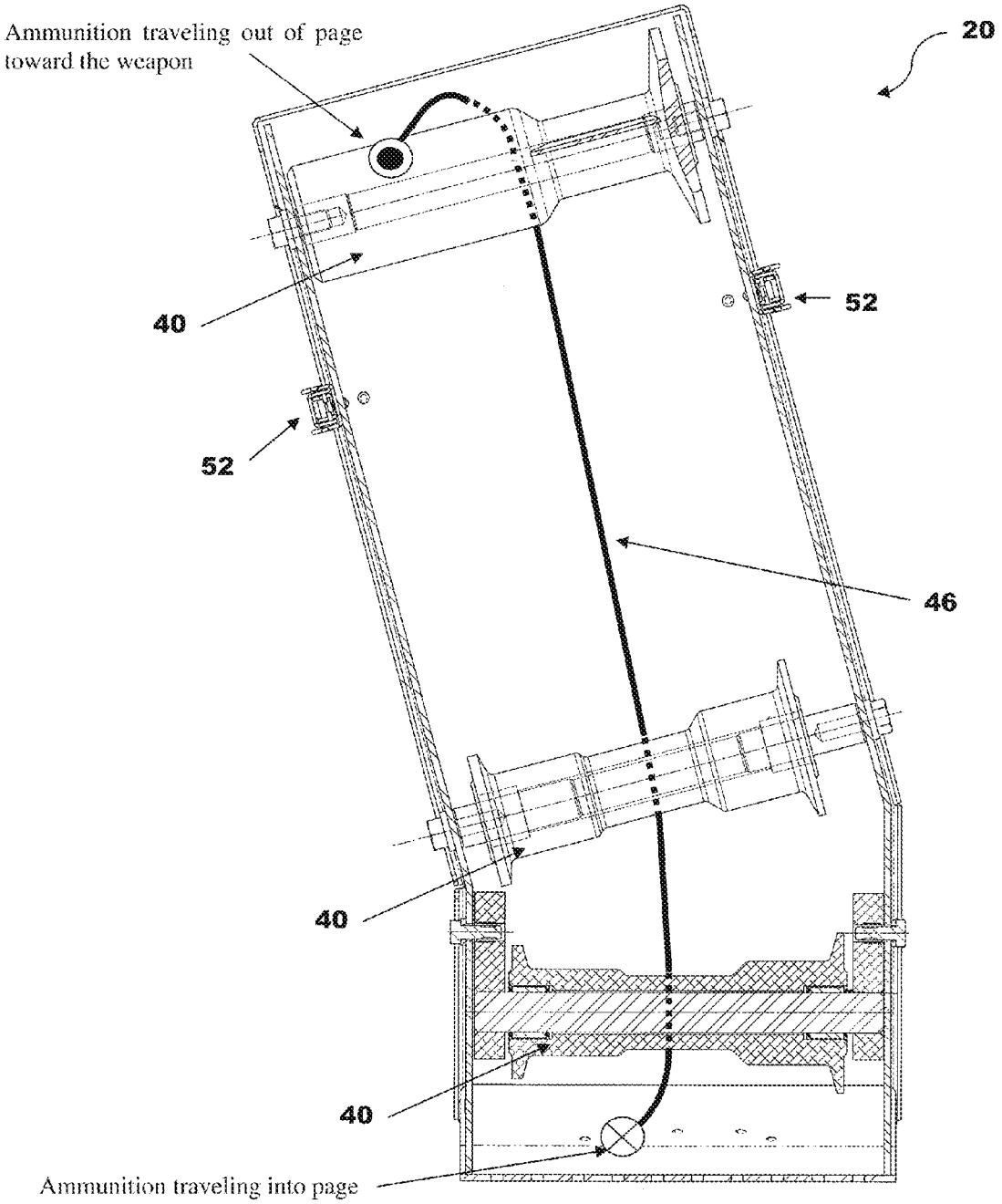
FIG. 4C is a cut away view taken along line A-A of FIG. 4B.
Figure 6A:
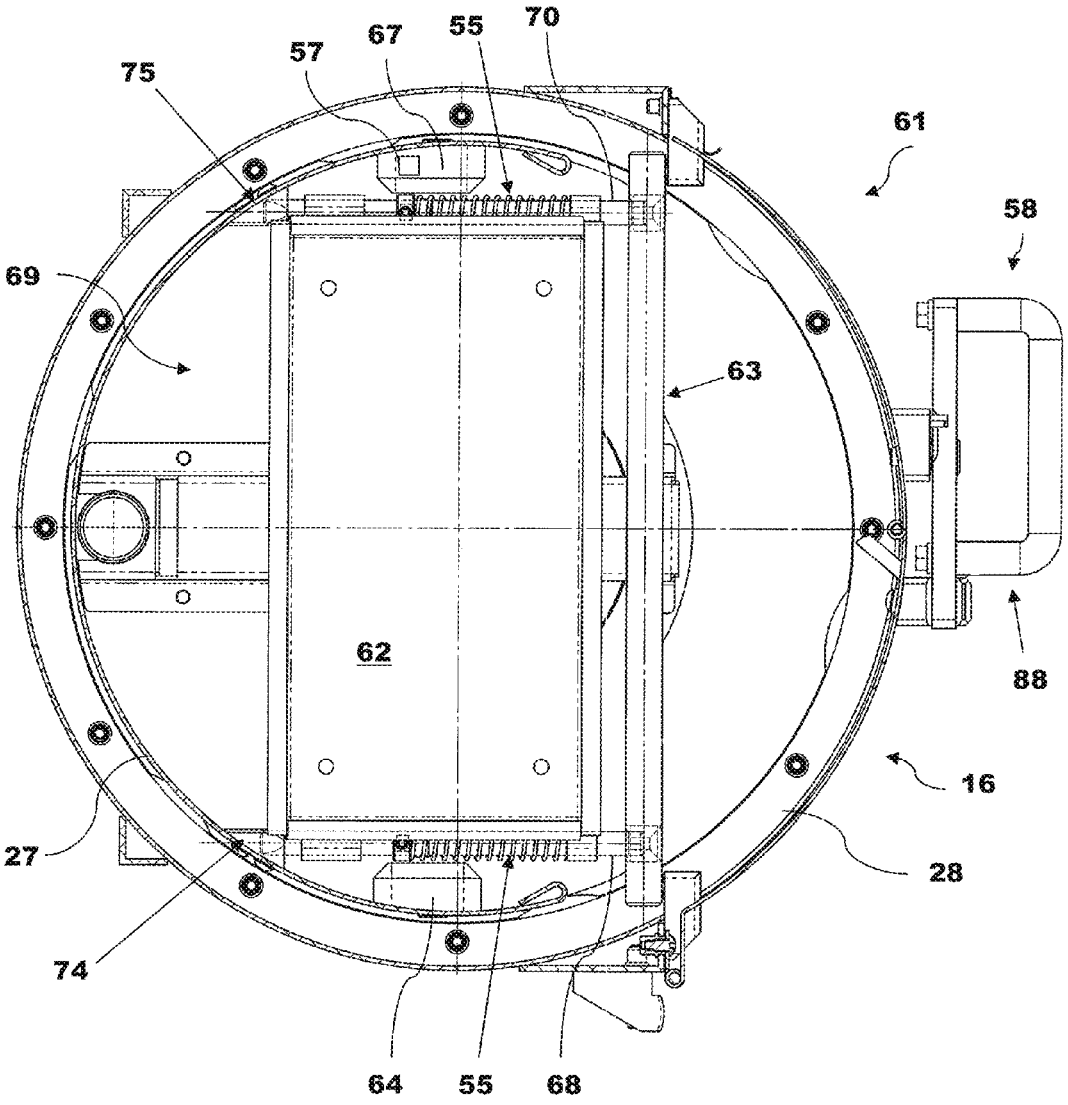
FIG. 6A is a cutaway view taken along line D-D of FIG. 5B that illustrates an ammunition tray within an inner drum assembly.
Figure 6B:
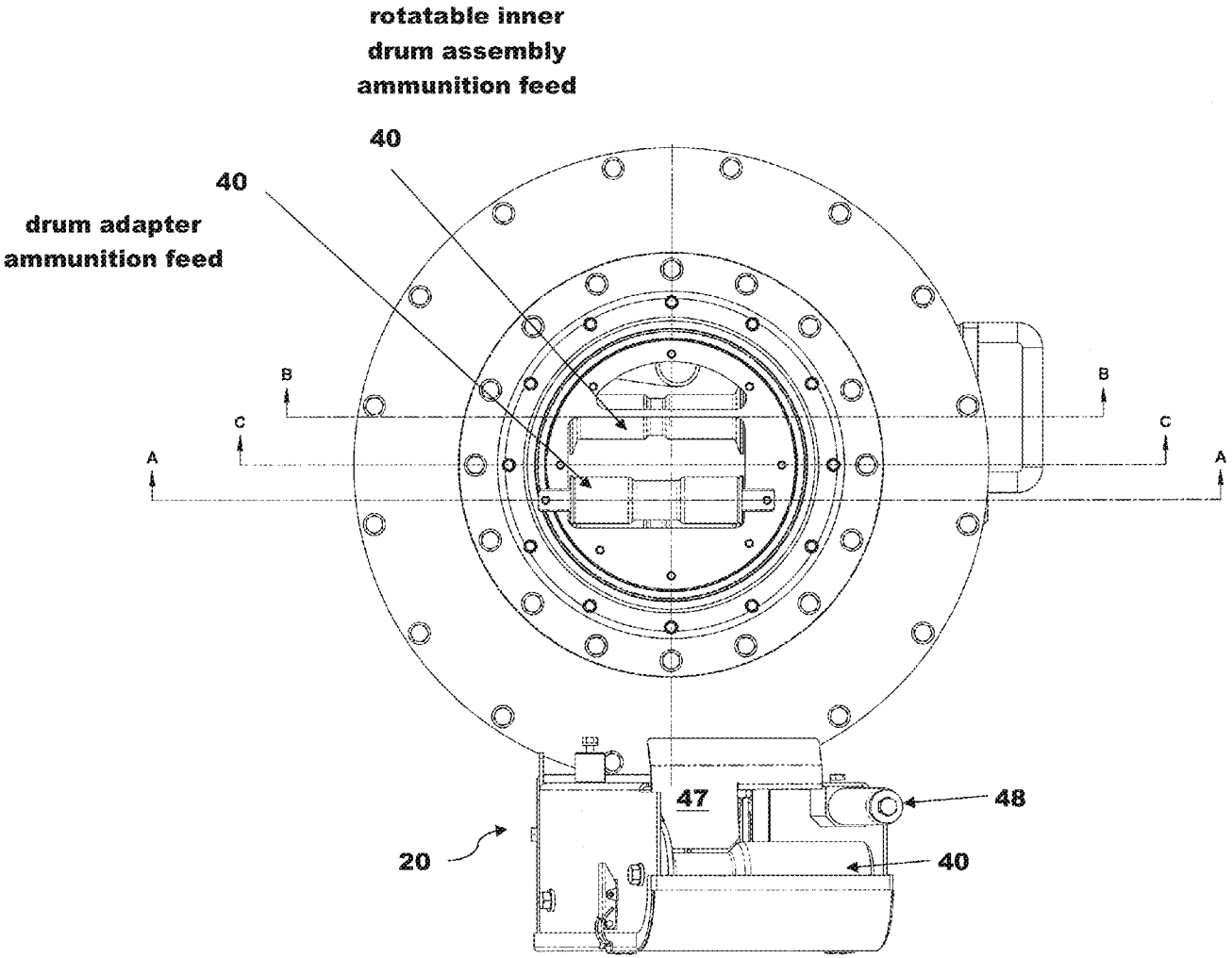
FIG. 6B is a top view of a load under armor weapon station's drum assembly, drum adapter, and ammunition feed chute.
Figure 6C:
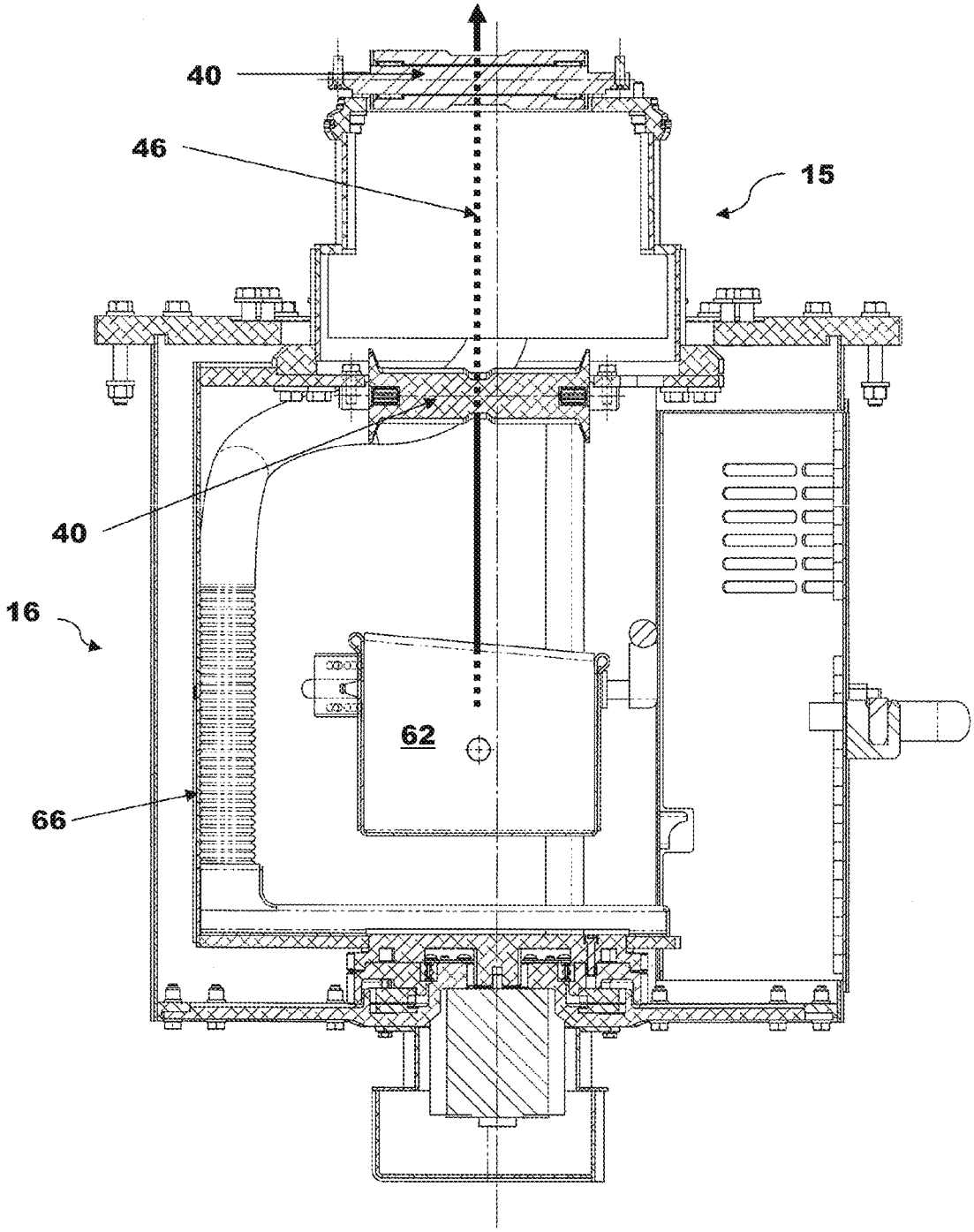
FIG. 6C is a cutaway side view taken along line A-A of FIG. 6B.

With continued reference to FIG. 6C, the ammunition is fed out of drum assembly 16 and into the drum adapter 15. Atop drum adapter 15, there is an additional ammunition feed 40 that assists the ammunition in traveling out of drum adapter 15 and through chute access opening 32, as shown in FIG. 3A. Then, as illustrated in FIGS. 3A and 4B, ammunition travels through ammunition feed chute 20. As shown in FIG. 4C, there are three ammunition feeds that assist ammunition rounds through ammunition feed chute 20. As ammunition reaches the top portion of ammunition feed chute 20, side ammunition feed 48 and ammunition guide 47 direct the belted ammunition toward weapon 21 to be fired.

The force required to move ammunition along ammunition feed path 46 may be supplied by a weapon's automatic feed mechanism driven by the recoil of a weapon's bolt and barrel. Automatic feed mechanisms may include a spring-loaded pawl to grip the belted ammunition and pull the next cartridge into the firing chamber as the bolt returns to battery. The positioning of the ammunition feeds 40 disposed along the ammunition feed path 46 allow belted ammunition to flow easily and freely from the ammunition tray 62 to weapon 21 by application of the weapon's automatic feed mechanism. Moreover, the positioning of the ammunition feeds 40 permit the ammunition to flow along the ammunition feed path 46 without the belted ammunition unduly bending, kinking, or twisting so as to increase the drag on the ammunition being fed along the ammunition feed path 46 or cause jamming of a weapon's automatic feed mechanism. Moreover, the positioning of the ammunition feeds 40 and other structural components along the ammunition feed path 46 also maintain the belted ammunition rounds in a generally longitudinal orientation, meaning they are oriented along a longitudinal axis as shown in FIG. 5B. The only point in which the belted ammunition rounds are bent is when ammunition rounds reach the angled top portion 31 of ammunition feed chute 20, which is done purposefully. The slight bending of the ammunition rounds will be discussed in greater detail later in the disclosure.

Alternatively, for weapons that utilize heavier and/or more bulkier ammunition, a booster may be used to hoist the ammunition rounds along the ammunition feed path 46 in the event that the automatic ammunition feed mechanism of a given weapon cannot supply enough force to move the rounds along the ammunition feed path 46.

Turning now to FIGS. 4A through 4F, various views of one embodiment of ammunition feed chute 20 are shown. Fastener systems 52 are shown securing chute access door 50 to ammunition feed chute 20. Fastener systems 52 may be released, and chute access door 50 may be pivoted about access door hinge 51 so that the interior of ammunition feed chute 20 may be accessed. Access to the ammunition feed chute 20 may be beneficial. For example, an operator may need to thread ammunition belts through the ammunition feed chute 20 or address ammunition jams in the chute.

FIG. 4B is a front view of ammunition feed chute 20. The ammunition feed chute 20 may be equipped with various fasteners 25 to permit secure fastening of the ammunition feed chute 20 to rotatable frame 24. Moreover, fasteners 25 also permit ease of disengagement of the ammunition feed chute 20 from rotatable frame 24 so that an operator may change to an external (or direct) load weapon system as the need dictates. In the case where an externally mounted direct ammunition feed assembly 96 is desired, the load under armor ammunition feed chute 20 is removed, access plate 33 is secured over chute access opening 32 to prevent harmful debris and dust from entering the modular weapon station 10, and a direct ammunition feed assembly 96 is secured in place.

Figure 4D:
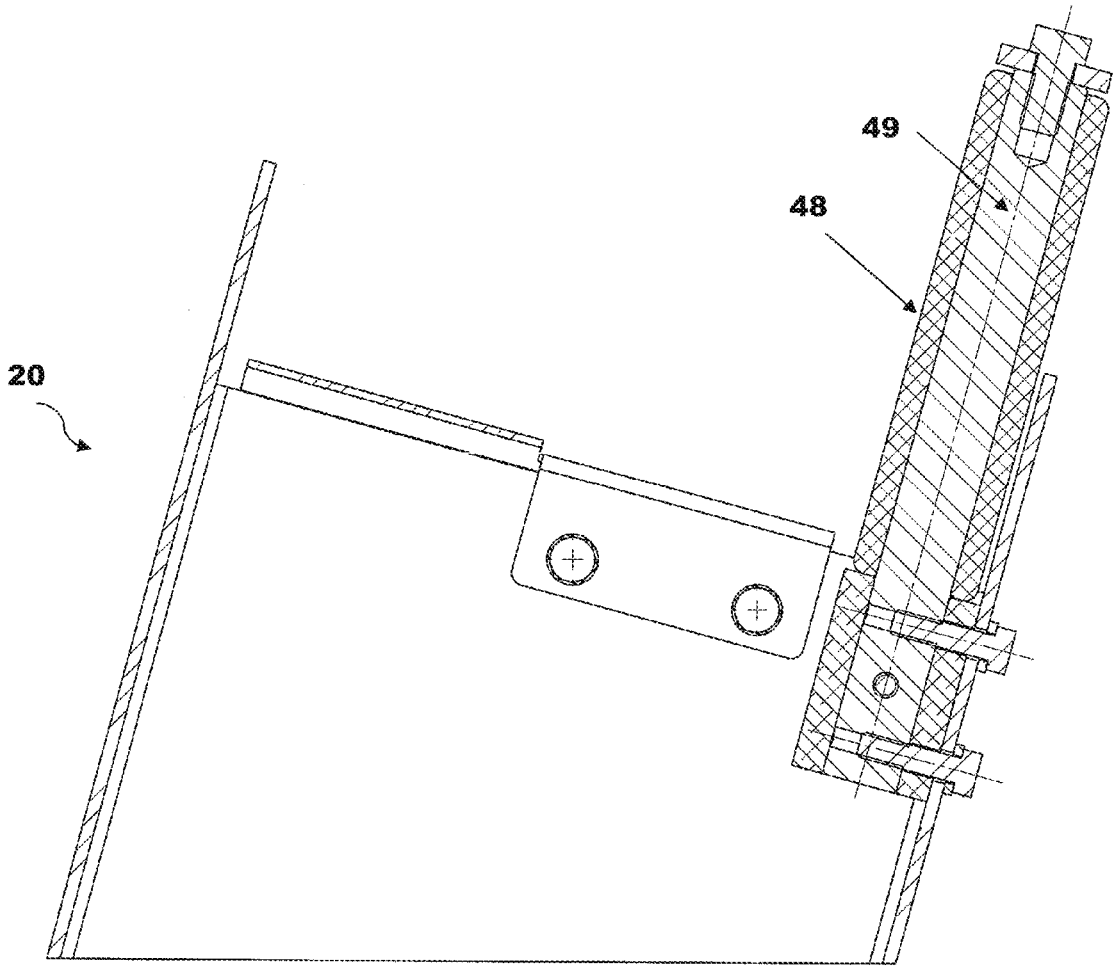
FIG. 4D is a cutaway view taken along line B-B of FIG. 4B.
Figures 4E, 4F:
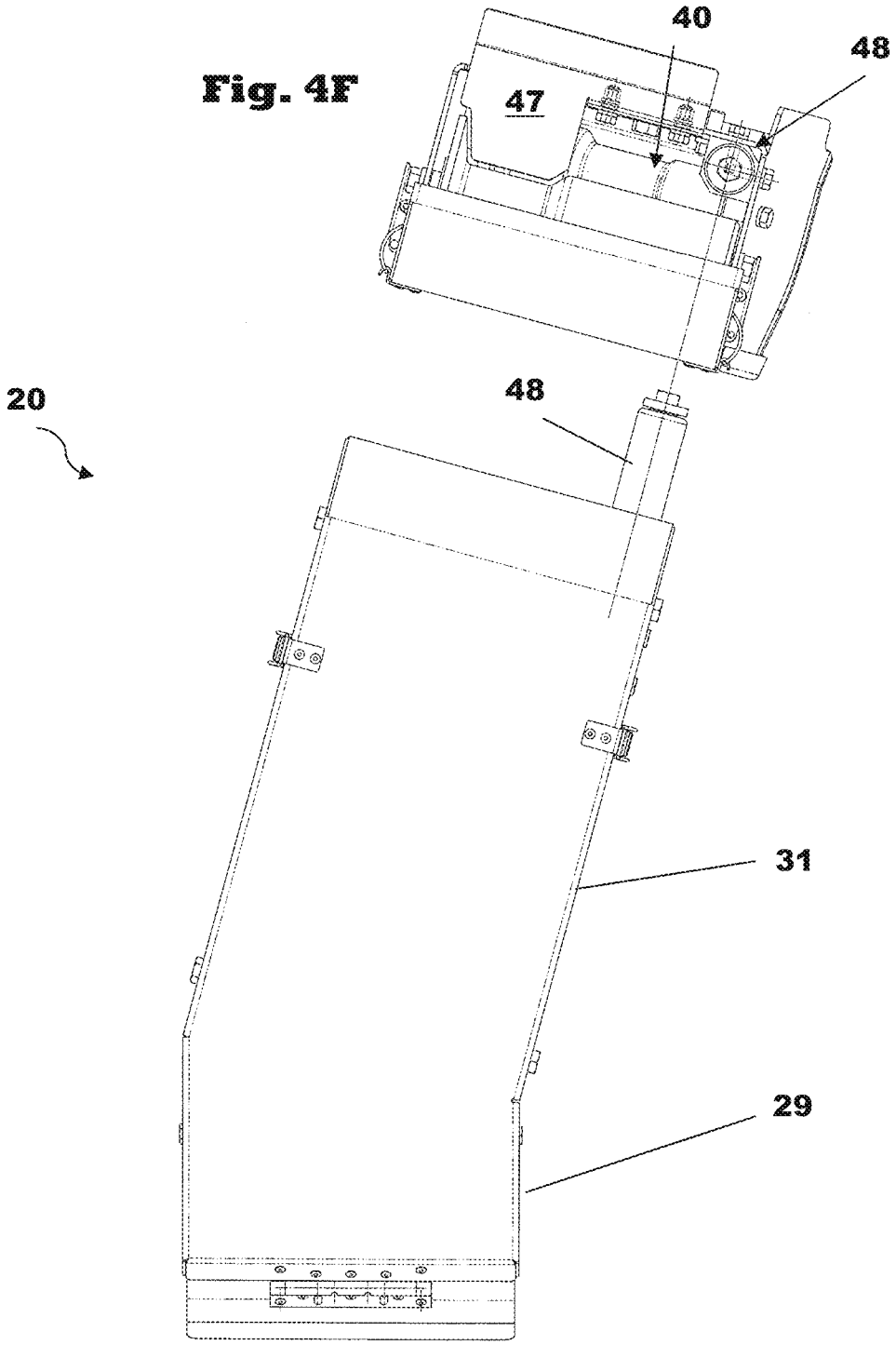
FIG. 4E is a right side elevation view of a load under armor ammunition feed chute.
FIG. 4F is a top view of the ammunition feed chute of FIG. 4E.

FIG. 4C is taken along line B-B of FIG. 4B and shows ammunition feeds 40 that direct ammunition belts through ammunition feed chute 20. In FIG. 4C, ammunition enters the ammunition feed chute 20 through the chute access opening 32, the ammunition is then guided upward by ammunition feeds 40 and then the ammunition finally travels out of the weapon feed end 23 of the ammunition feed chute 20 toward weapon 21. FIG. 4F shows the top of the ammunition feed chute 20. FIG. 4D shows a cutaway view along line A-A of FIG. 4B that illustrates the inner workings of side ammunition feed 48 and side ammunition feed shaft 49.

Figure 5A:
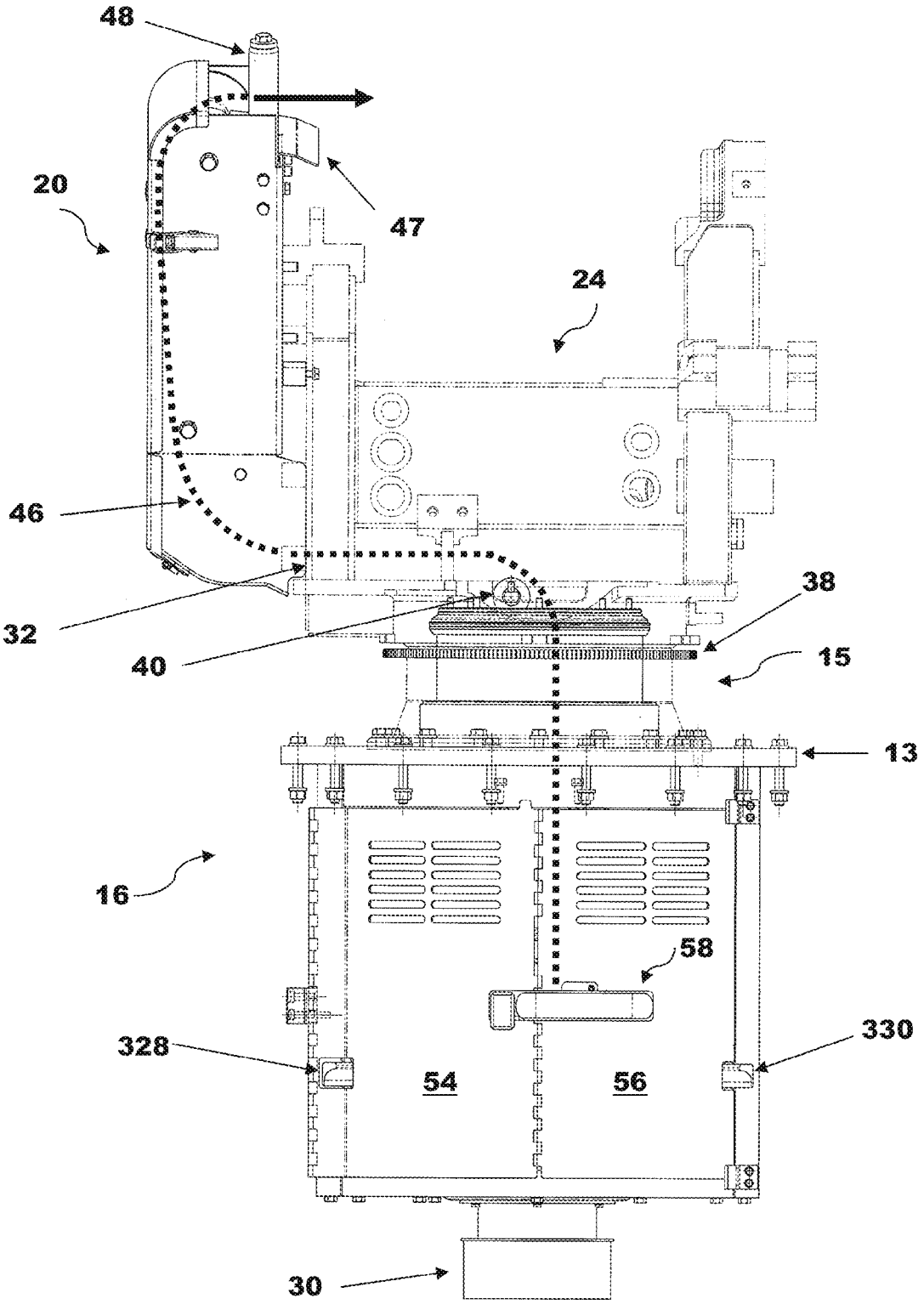
FIG. 5A is a front view of a load under armor modular weapon station coupled with a drum assembly.
Figure 5B:
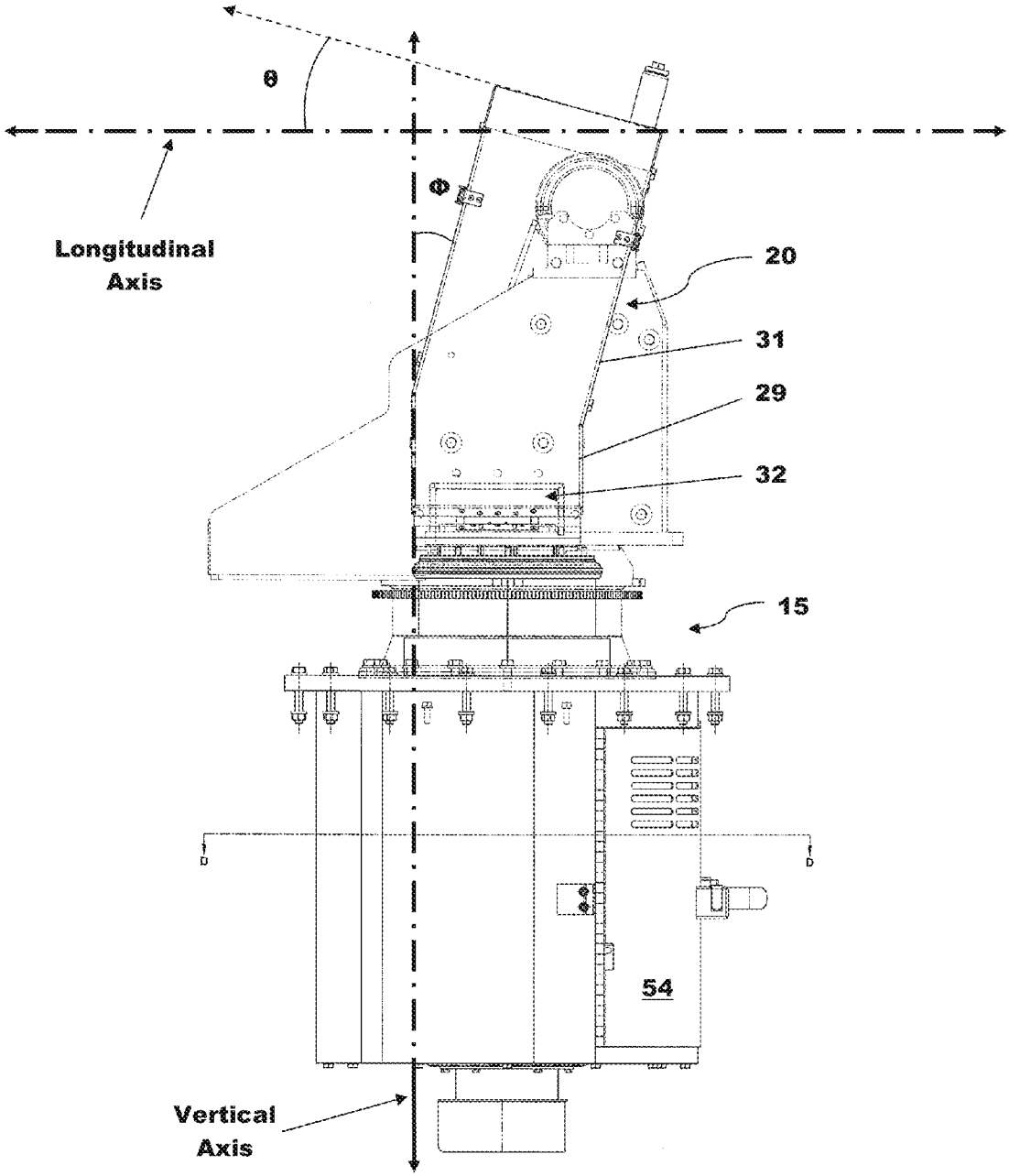
FIG. 5B is a left side elevation view of the modular weapon station of FIG. 5A.
Figure 5C:
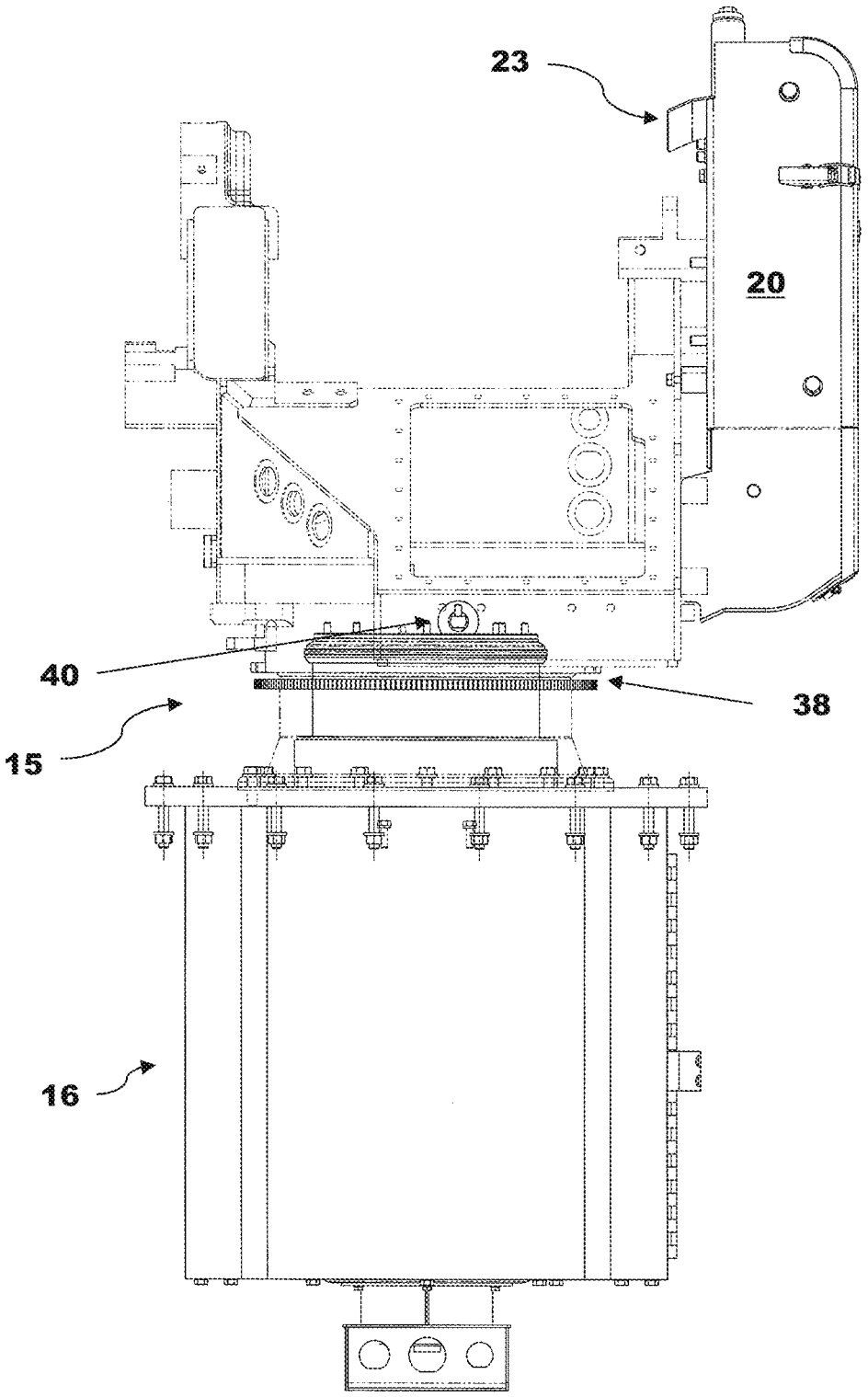
FIG. 5C is a rear view of the modular weapon station of FIG. 5A showing the drum assembly.

FIGS. 5A through 5C show views of the drum assembly 16, drum adapter 15, rotatable frame 24 (which is transparent in FIGS. 5A through 5C), and ammunition feed chute 20 (transparent in FIG. 5B). Specifically FIGS. 5A and 5B show that the ammunition feed chute 20 is in constant communication with the ammunition regardless of the rotational position (or azimuth position) of weapon 21. The rotatable frame 24 and the structures mounted thereto are in rotational synchronization with the inner drum assembly 27, as previously mentioned. FIGS. 5A through 5C show the drum assembly 16 having access doors 54 and 56 that may be opened with a latch 58. FIG. 5A also shows ammunition feed path 46, and how an ammunition feed 40 located at the top portion of the drum adapter 15 assists the flow of ammunition rounds through chute access opening 32 and into ammunition feed chute 20.

With reference to FIG. 5B, FIG. 5B is a left side elevation view of the load under armor weapon station of FIG. 5A. Ammunition feed chute 20 is transparent in FIG. 5B so that chute access opening 32 may be visible. Angled top portion 31 of ammunition feed chute 20 is shown angled with respect to a vertical axis by an angle Φ. The base portion 29 of ammunition feed chute 20 is not angled with respect to a vertical axis. The non-angled base portion 29 allows ammunition feed chute 20 to receive belted ammunition though chute access opening 32 without the belted ammunition being bent, kinked, or twisted from the ammunition tray 62 to the base portion 29 of the ammunition feed chute 20. Maintaining the belted ammunition in a longitudinal orientation without kinking or bending of the ammunition in a lateral direction minimizes the resistance to the pulling force of the ammunition feed mechanism of weapon 21. However, as ammunition reaches approximately the middle of the three ammunition feeds 40 in ammunition feed chute 20, the belted ammunition begins to travel upward through the angled top portion 31 of ammunition feed chute 20. FIG. 4C illustrates how ammunition travels along ammunition feed path 46 in ammunition feed chute 20.

As mentioned above, the ammunition feed chute 20 may be angled with respect to a vertical axis by angle Φ to allow for ammunition exiting the ammunition feed chute 20 to be directed in a more streamlined fashion to weapon 21, and more specifically to the ammunition feed mechanism of the weapon. Streamlined in this context means that the belted ammunition rounds exit the weapon feed end 23 of the ammunition feed chute 20 in a direct a line as possible to the weapon's automatic feed mechanism. A weapon 21 may be optimally positioned on cradle 22 of modular weapon station 10 such that the center of mass of the modular weapon station 10 is located in a position that permits balanced and stabilized azimuth movement of modular weapon station 10, and azimuth and elevation movement of weapon 21. Various weapons mountable upon removable cradle 22 may have different masses, physical configurations, and recoil characteristics. Thus, weapon 21 may be positioned at different locations along a longitudinal axis to optimize the modular weapon station's center of mass. Accordingly, to streamline the ammunition rounds from the weapon feed end 23 of the ammunition feed chute 20 to the feed mechanism of weapon 21, angled top portion 31 of ammunition feed chute 20 may be angled with angle Φ relative to a vertical axis. The modular design of ammunition feed chute 20 allows the chute to be readily removed and replaced with an appropriate chute that is optimized with an appropriate ammunition feed chute 20 having an angled top portion 31 for the given selected weapon. Angle Φ may be selected to streamline ammunition rounds to a weapon feed mechanism, but angle Φ is preferable not greater than the allowable lateral bending of the belted ammunition rounds as this would cause potential kinking and jamming of the weapon feed mechanism and/or ammunition rounds traveling along the ammunition feed path 46.

Referring again to FIG. 5B, it is shown that ammunition rounds exit the ammunition feed chute 20 at an angle θ relative to a longitudinal axis. Angle θ may be substantially the same as angle Φ or the two angles may be different. The weapon feed end 23 of ammunition feed chute 20 may be angled with respect to a longitudinal axis by angle θ based upon the elevation arc 26 of a given weapon 21. For example, if a weapon 21 has an elevation range of 90 degrees (−30 to +60 degrees), angle θ may be selected at or near the midpoint of this elevation range. The midpoint in this example would be 15 degrees, as 45 degrees is the half of 90 degrees, and if 45 degrees is added to the bottom of the elevation range (or maximum depression), which in this example is −30 degrees, the midpoint of the elevation range is 15 degrees. When the ammunition feed chute 20 is angled with respect to a longitudinal axis having an angle θ, there is less strain and contortion on the belted ammunition before it enters the gun to be fired at the weapon's maximum elevation angle (i.e., 60 degrees in this example) and/or minimum elevation angle (i.e., −30 degrees in this example). For example, if the weapon feed end 23 of ammunition feed chute 20 is set at an angle θ of 15 degrees, and the elevation range is 90 degrees (−30 to +60 degrees), the ammunition belt would only need to move up or down plus or minus 45 degrees at the most. On the other hand, if angle θ was set at 0 degrees and the elevation range of the weapon is 90 degrees (−30 to +60 degrees), if the weapon was fired from its maximum elevation angle of 60 degrees with respect to a longitudinal axis, the belted ammunition would be bent to accommodate the weapon 21 firing at 60 degrees. A gun capable of firing at an even greater maximum elevation angle would produce even more kinking of the belted ammunition if the weapon feed end 23 had an angle θ of 0 degrees with respect to a longitudinal axis. As the modular weapon station 10 may rely on a weapon's ammunition feed mechanism to produce the force required to move ammunition along the ammunition feed path 46, minimizing kinking and bending of belted ammunition rounds before they enter the weapon 21 is desirable.

Rotatable Inner Drum Assembly and Ammunition Tray

FIG. 6A is a cross sectional view taken along line D-D of FIG. 5B showing the internal structure of inner drum assembly 27 and the ammunition loading assembly 61, which includes ammunition tray 62, the components that allow ammunition tray 62 to be pivoted downward, and access door assembly 53. The ammunition tray 62 is pivotally mounted within the inner drum assembly 27 such that when the access doors 54 and 56 are opened, ammunition tray 62 may be pivoted downward into the ammunition loading position 65 to make the loading of ammunition rounds more ergonomically friendly. An operator may open access doors 54 and 56, grab tray handle 63 and slide it out, and then pivot ammunition tray 62 down into the ammunition loading position 65 as shown in FIG. 6J (the outer drum assembly 28 has been removed in FIG. 6J for clarity). After ammunition is added to the ammunition tray 62 and the new rounds are linked to the existing ammunition rounds hanging down into the inner drum assembly 27, the ammunition tray 62 may be pivoted upward and the tray handle 63 may be slid back into place. Once the access doors 54 and 56 are closed, the weapon 21 may be permitted to operate. The access doors 54 and 56 may include access door lock sensor 333, which may be a mechanical and/or electrical lock or sensor to prevent weapon 21 from firing when the access doors are open. This added safety feature ensures that the crew is not unintentionally injured when loading weapon 21 or injured by the rotating inner drum assembly 27. A low ammunition sensor 57 may be configured to alert an operator that ammunition has been depleted to a predetermined amount.

FIG. 6B is a top view of one exemplary drum assembly 16 and drum adapter 15 of a modular weapon station 10 having load under armor capabilities. Rotatable frame 24 has been removed for clarity. FIG. 6B shows ammunition feeds 40 and how they are positioned to facilitate ammunition traveling along ammunition feed path 46 from the drum assembly 16 to the drum adapter 15 of the modular weapon station 10.

As previously discussed, FIG. 6C is a cutaway side view taken along line A-A of FIG. 6B that shows the inner drum assembly 27 and detailing the electrical cable path 66 within the inner drum assembly 27. Inner drum assembly 27 may also include a lower cable cover 71 to protect the electrical cables from debris. The ammunition tray 62 is positioned in the inner drum assembly 27, and belted ammunition rounds are fed from the ammunition tray 62 through the ammunition feeds 40 and up to the weapon 21 in the manner previously described.

Figure 6D:
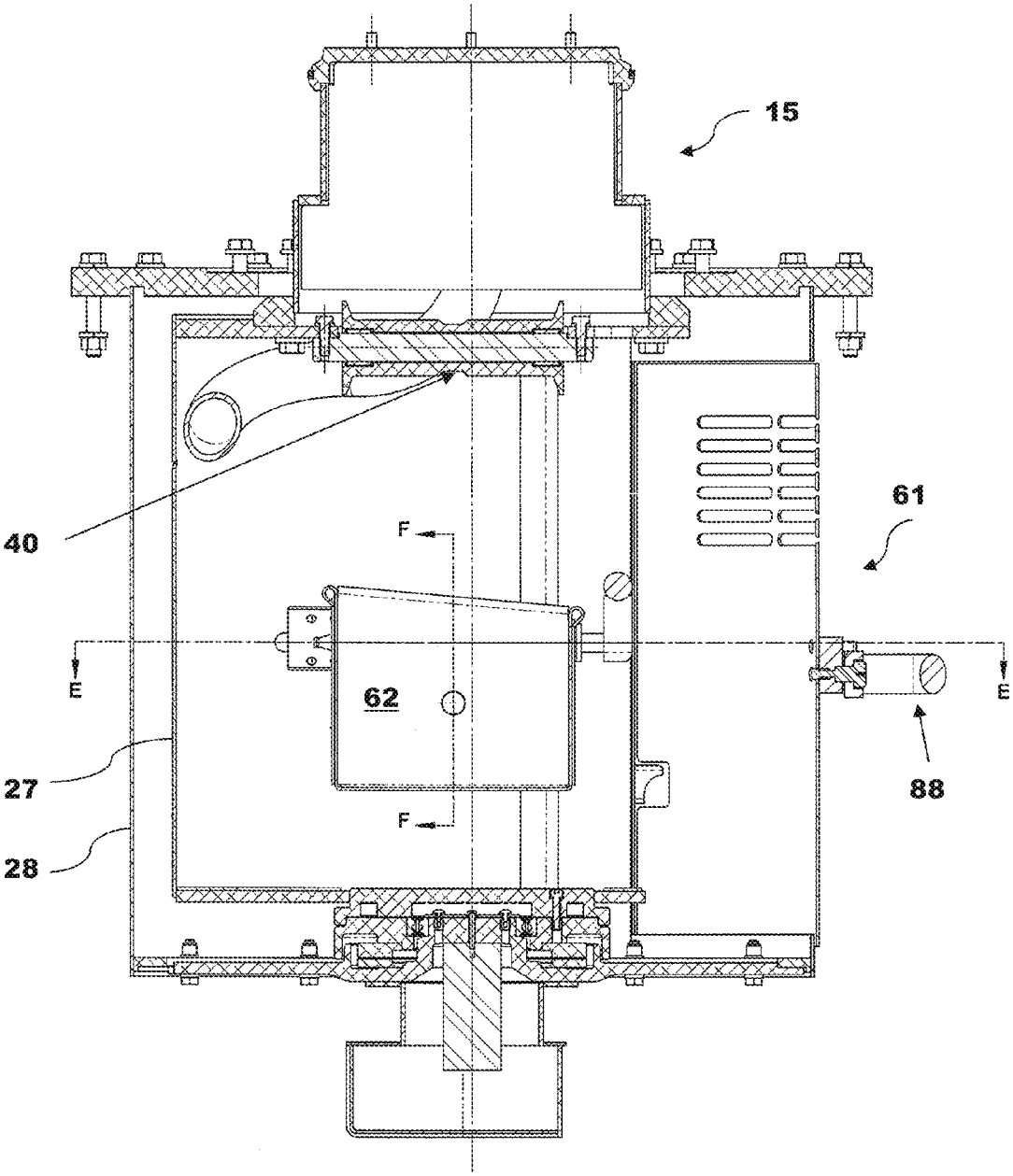
FIG. 6D is a cutaway view along line B-B of FIG. 6B.
Figure 6E:
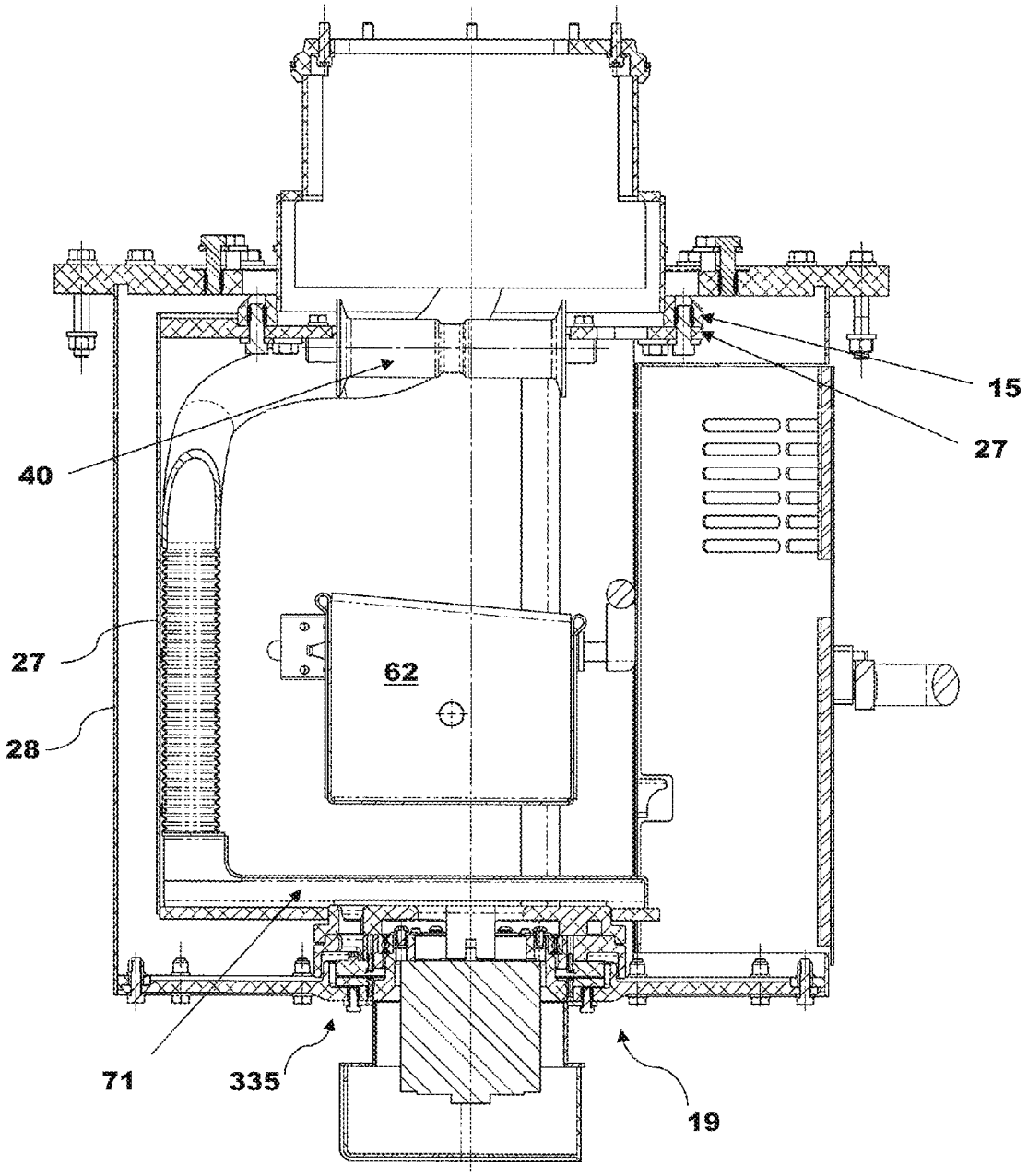
FIG. 6E is a cutaway view along line C-C of FIG. 6B.

FIG. 6D is another cutaway view taken along line B-B of FIG. 6B, showing the ammunition tray 62 situated within the inner drum assembly 27. Similarly, FIG. 6E is a cutaway view taken along line C-C of the drum assembly 16. FIG. 6E also details how the inner drum assembly 27 is rotatably coupled with the drum adapter 15, which in turn is connected with rotatable frame 24 of modular weapon station 10.

Figure 6F:
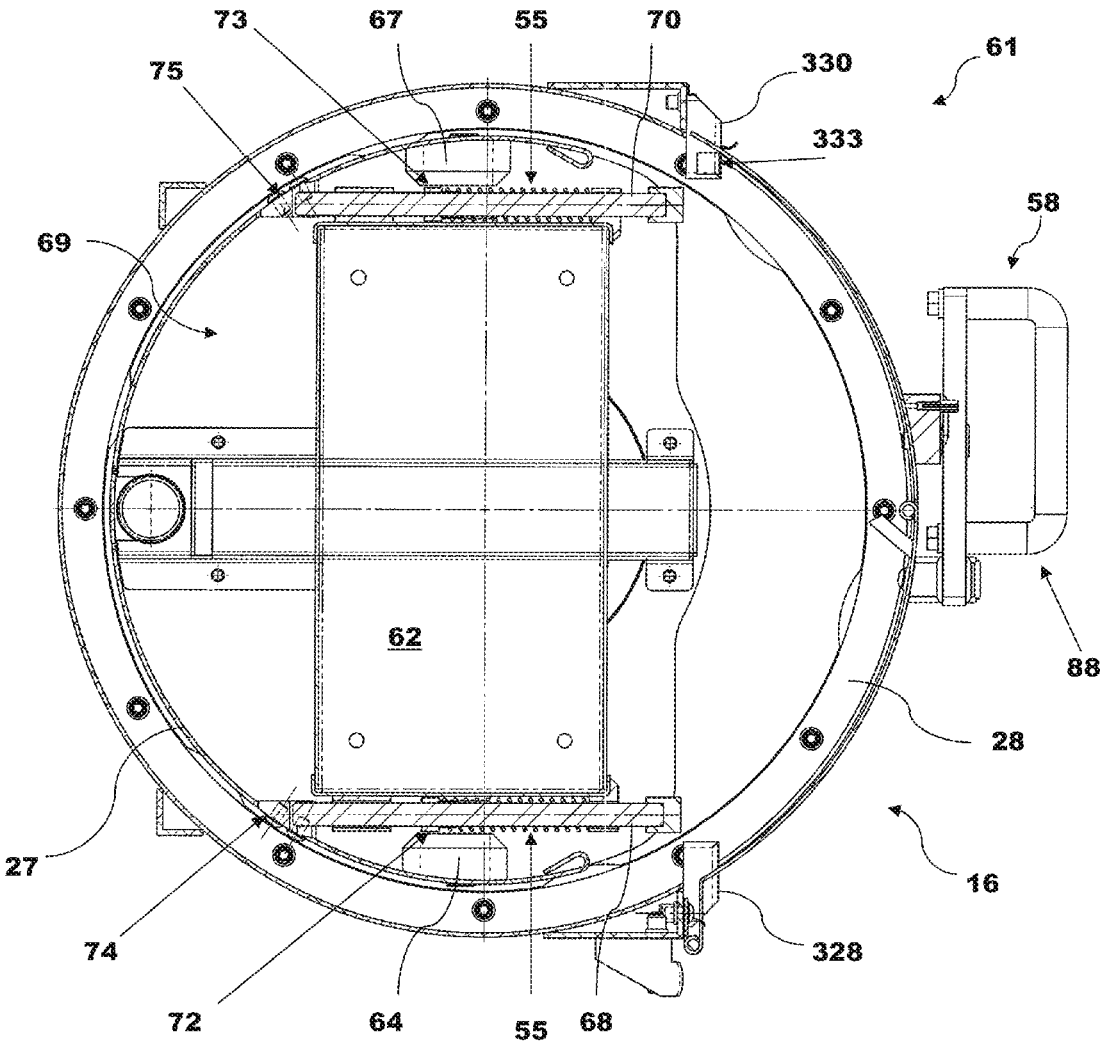
FIG. 6F is a cutaway view along line E-E of FIG. 6D.
Figure 6G:
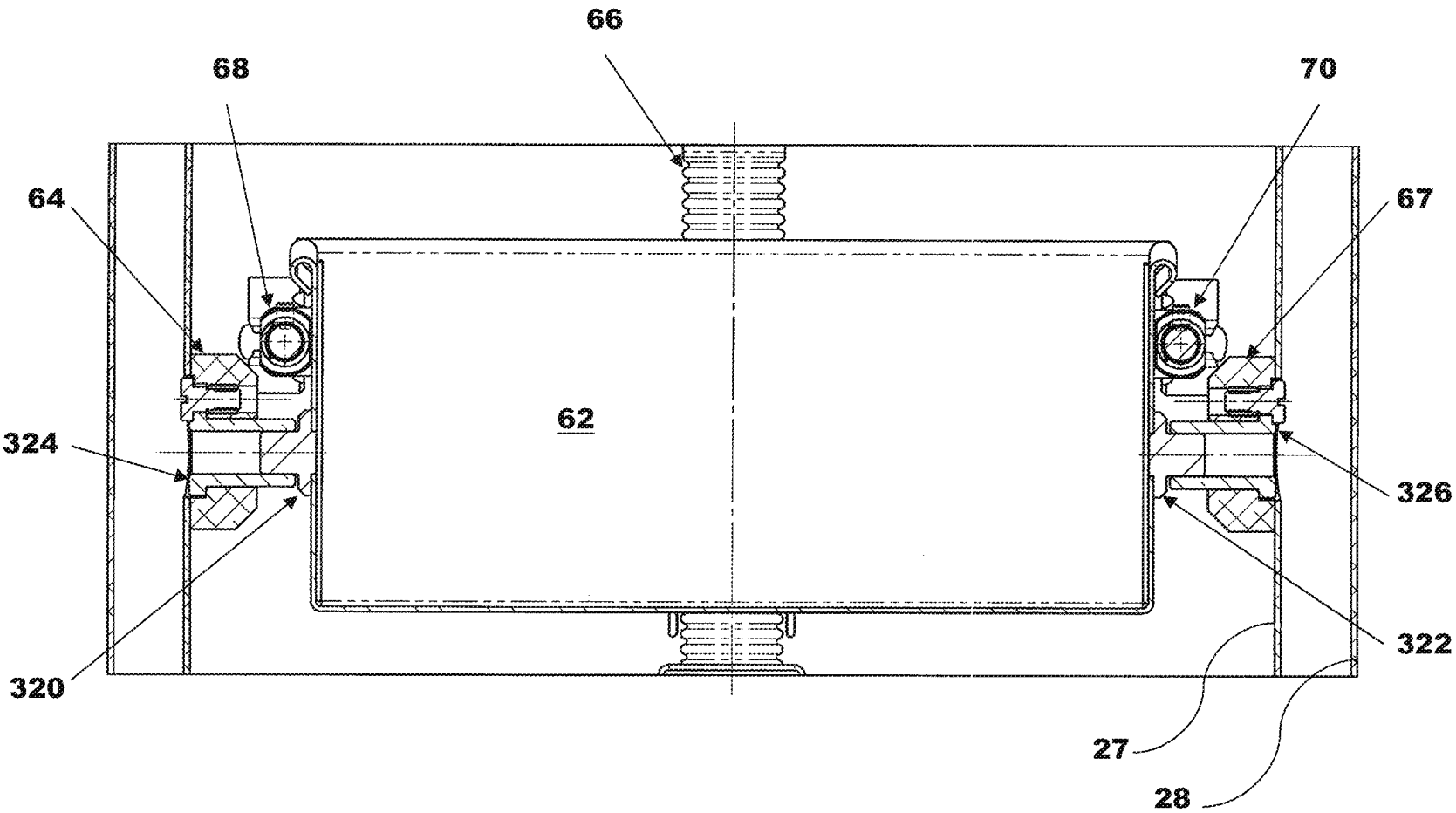
FIG. 6G is cutaway view of line F-F of FIG. 6B.
Figure 6H:
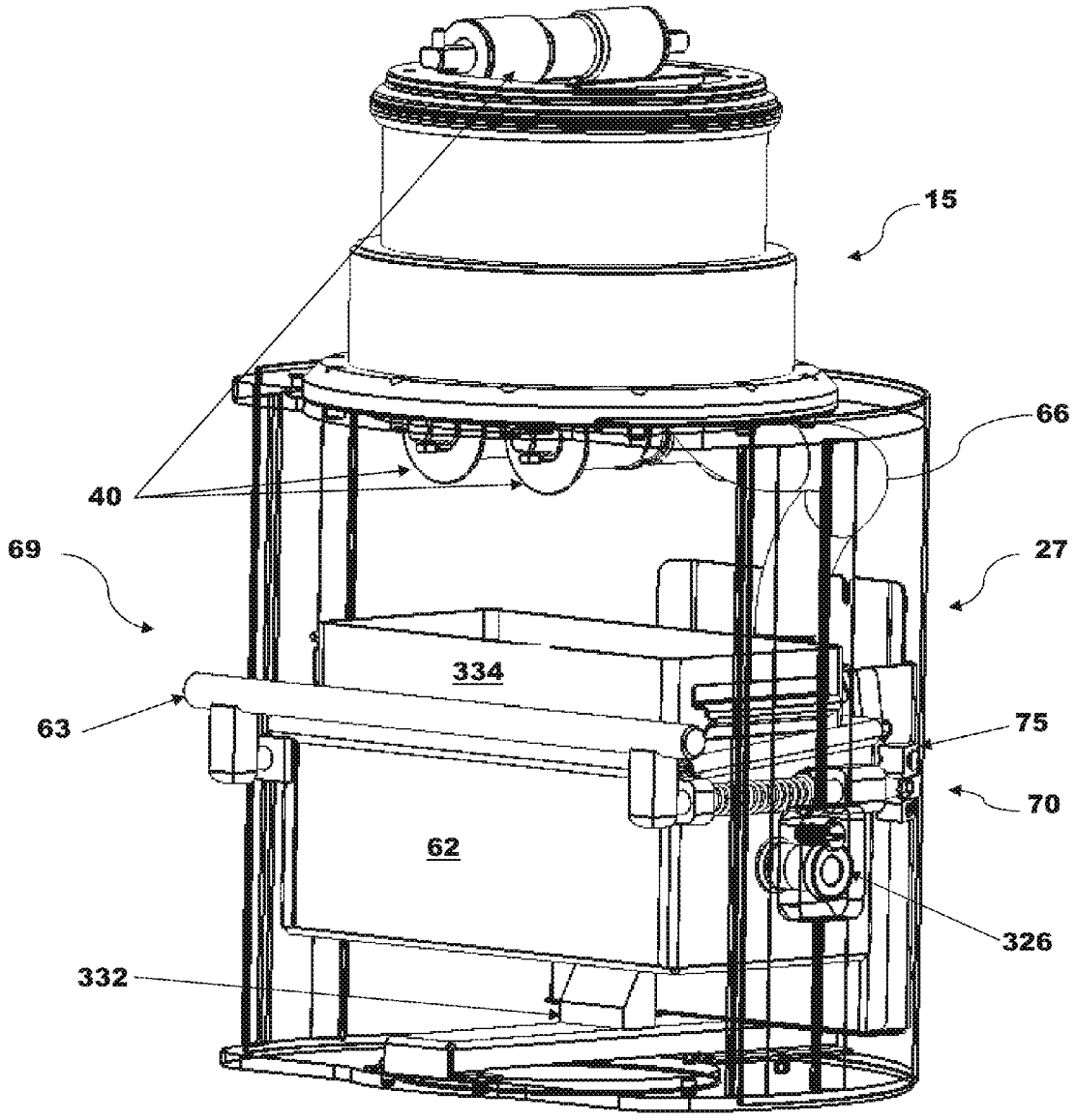
FIG. 6H is a perspective view of a drum assembly with an ammunition tray shown in the non-loading position.
Figure 6I:
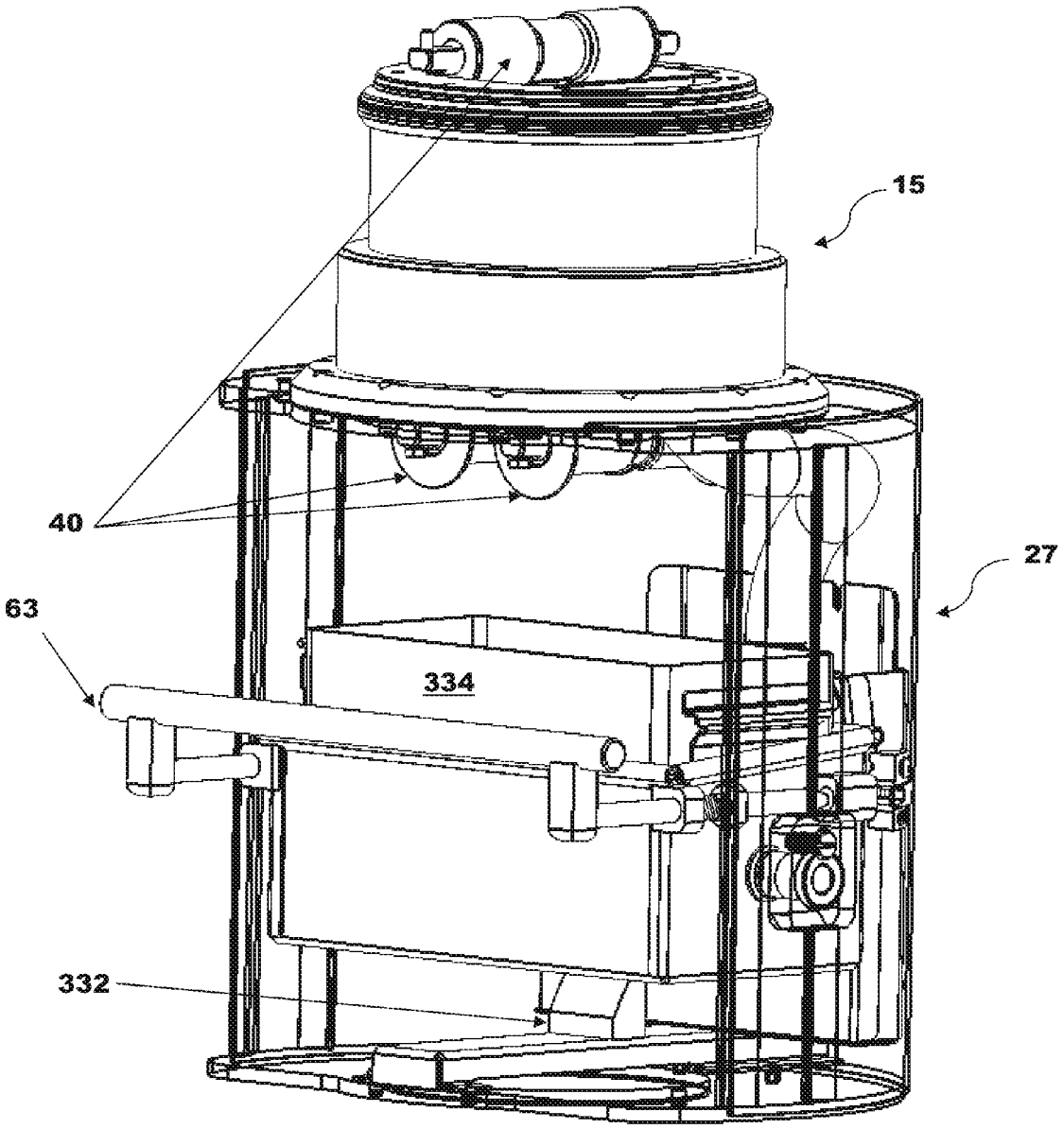
FIG. 6I is a perspective view of a drum assembly with an ammunition tray with its tray handle pulled out.
Figure 6J:
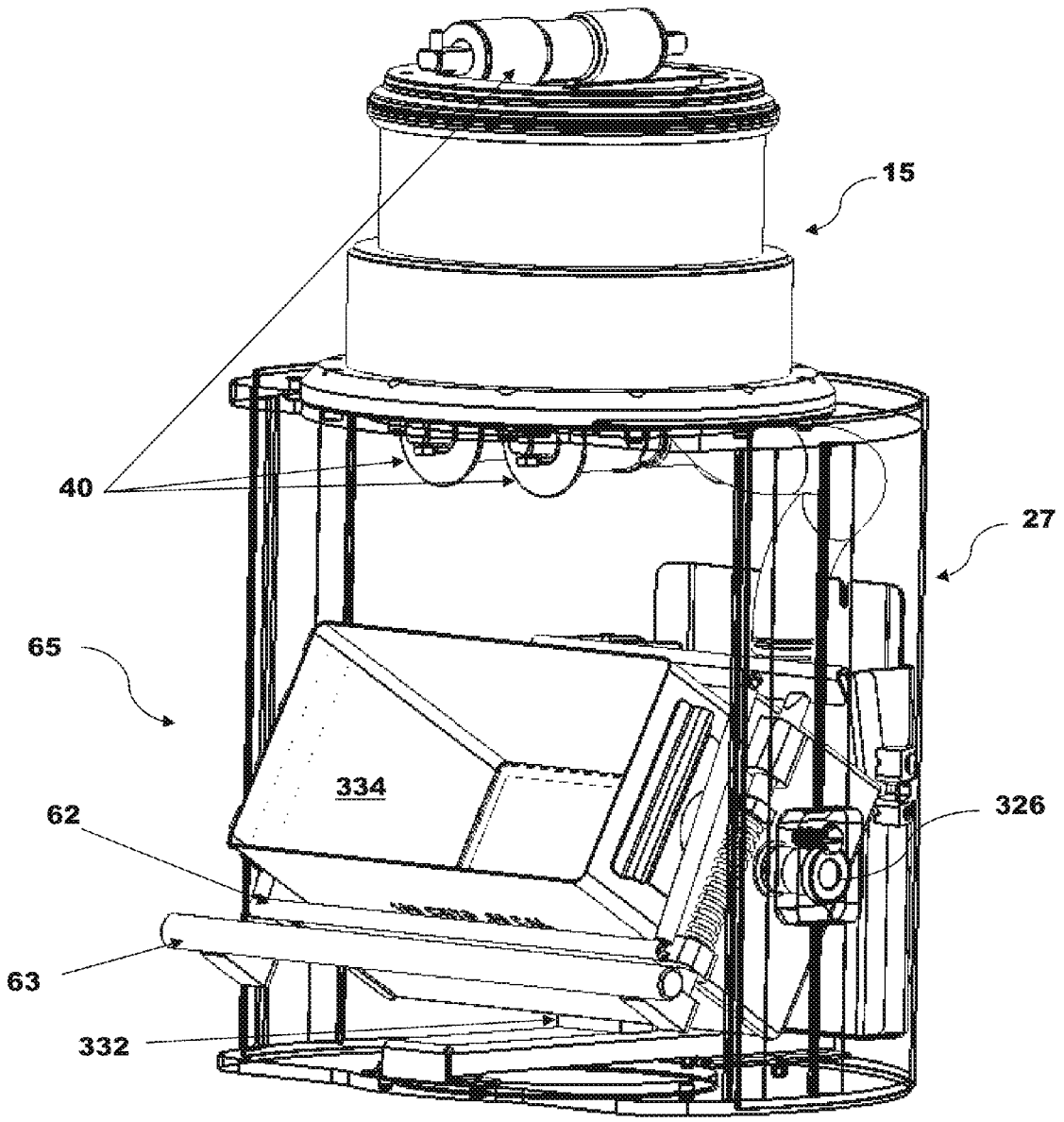
FIG. 6J is a perspective view of a drum assembly with an ammunition tray shown in the ammunition loading position.

Referring now to FIGS. 6F and 6J, FIG. 6F is a cutaway view taken along line E-E of FIG. 6D that illustrates the ammunition tray 62 mounted in the inner drum assembly 27, and FIG. 6G is a sectional view along line F-F of FIG. 6D showing a front view of ammunition tray 62. Ammunition tray 62 has opposed rails, first rail 68 and second rail 70, that are coupled with tray handle 63. The opposed rails 68 and 70 permit the tray handle 63 to slide out so that when the ammunition tray 62 is pivoted downward the tray handle 63 may catch on the first handle retention 328 and second handle retention 330 to secure the ammunition tray 62 in place for loading.

Referring now to FIG. 6H, the ammunition loading assembly 61 is shown in the non-loading position 69. An ammunition box 334 is shown inserted in ammunition tray 62. When weapon 21 is firing or when ammunition is not being replenished, ammunition tray 62 is fully secured in the non-loading position 69. First wedge block 74 receives first rail 68 and second wedge block 75 receives second rail 70 such that tray handle 63 does not inadvertently slide out and that ammunition tray 62 does not pivot downward into the loading position 65 when it is not desired.

With reference to FIG. 6I, the tray handle 63 is shown pulled out. The opposed rails 68 and 70 have been disengaged from wedge blocks 74 and 75, and rail compression springs 55 have been compressed. To pull the tray handle 63 from wedge blocks 74 and 75, no more than about fifteen $lb_f$ are required. The ammunition tray 62 may now be pivoted or actuated downward into the loading position 65.

FIG. 6J illustrates the ammunition loading assembly 61 with ammunition tray 62 in the loading position 65. To accomplish the pivoting of the ammunition tray 62 into the loading position 65, ammunition tray 62 is equipped with opposed pivots, first pivot 64 and second pivot 67. First pivot 64 includes first pivot support 324, which provides a bore for the ammunition tray's first pivot pin 320 to be inserted into. Likewise, second pivot 67 includes second pivot support 326, which provides a bore for the ammunition tray's second pivot pin 322 to be inserted into. Ammunition tray 62 utilizes its first pivot pin 320 and second pivot pin 322 to pivot about first pivot 64 and second pivot 67, respectively. A tray stop 332 located beneath the ammunition tray 62 facilitates the ammunition tray 62 in reaching the correct pivot orientation.

When the ammunition tray 62 is in the loading position 65, tray handle 63 may be fit into the radii of the first handle retention 328 and second handle retention 330 so that the ammunition tray 62 may be secured in position while the operator is replenishing ammunition (handle retentions 328 and 330 are not shown in FIG. 6J). This may be advantageous, for example, when an armored vehicle is going over bumps. The ammunition tray 62 is permitted to stay firmly in place when the tray handle 63 is placed into the handle retentions 328 and 330. Compression springs 55, which are allowed to return to their static equilibrium positions when tray handle 63 is caught on the handle retentions 328 and 330, dampen vibrations experienced by an armored vehicle. Once the tray handle 63 is secured, ammunition box 334 may then be removed and replaced with a loaded ammunition box. The new ammunition rounds may then be linked to the existing ammunition rounds draping down into the rotatable inner drum assembly 27.

When loading is complete, tray handle 63 may be removed from handle retentions 328 and 330, the ammunition tray 62 with loaded ammunition box 334 may pivoted upward into the non-loading position, the tray handle 63 may then be pushed into the wedge blocks 74 and 75, the access doors 54 and 56 may be closed, and the weapon 21 is then ready to be fired.

Loading of the weapon 21 is made easier by the downward pivoting of ammunition tray 62 and, as previously discussed, a low ammunition sensor 57 may be placed in proximity to the ammunition tray 62 to alert the operator that ammunition is low and must be replenished. FIG. 6A represents an example position of low ammunition sensor 57; low ammunition sensor 57 could be located practically anywhere along ammunition feed path 46. There could also be multiple sensors. It is particularly important that the ammunition, which for heavy machine guns (HMG), medium machine guns (MMG), and some light machine guns (LMG) may generally be carried on an ammunition belt, is not permitted to entirely feed through the drum assembly 16 such that the operator is forced to "rethread" the ammunition belt through and around the various ammunition feeds 40 disposed along ammunition feed path 46. Rather, ammunition tray 62 should have a low ammunition sensor 57, such as a spring loaded switch sensor that makes contact with the ammunition tray 62 once the ammunition belt is detected to be at a predetermined level in the ammunition tray 62. Alternatively, an electronic low ammunition sensor 57 may be configured to sense that an ammunition round has been depleted to a predetermined amount. The electronic low ammunition sensor 57 could then send a signal to alert an operator by way of a warning light or voice command, for example. Low ammunition sensor 57 may even be a round counter located at various strategic locations along ammunition feed path 46. After it has been determined that ammunition has been depleted to a predetermined amount, the weapon operation may be mechanically or electrically ceased; the new ammunition rounds may be placed into the ammunition tray 62 (or a new ammunition box 334 can be set into the tray) and connected or linked to the existing ammunition belt that is draping down into the drum assembly 16. The ammunition tray 62 is returned to its non-loading position 69, the access doors 54 and 56 are closed, and the weapon 21 is ready to be fired again.

An operator or soldier may replenish ammunition in the manner described above in approximately ten seconds. Replenishing ammunition using the exemplary embodiments disclosed herein is an ergonomically friendly process: the access doors 54 and 56 may be opened with one hand, the access doors may fold into each so that the doors may be easily closed after loading is complete, the ammunition tray 62 pivots downward for quick loading and easy access, the operator is not required to lift an ammunition box above his or her head, linking the new ammunition belt to the existing ammunition belt is well within the reach of the operator, and there may be various safety features that prevent the weapon 21 from firing and the inner drum assembly 27 from rotating when the access doors are opened, preventing injury. All elements of the ammunition loading assembly 61 are easy to operate and safe to use. Furthermore, an operator is not required to leave the safety of an under armor position to replenish ammunition.

Access Doors

Figure 7A:
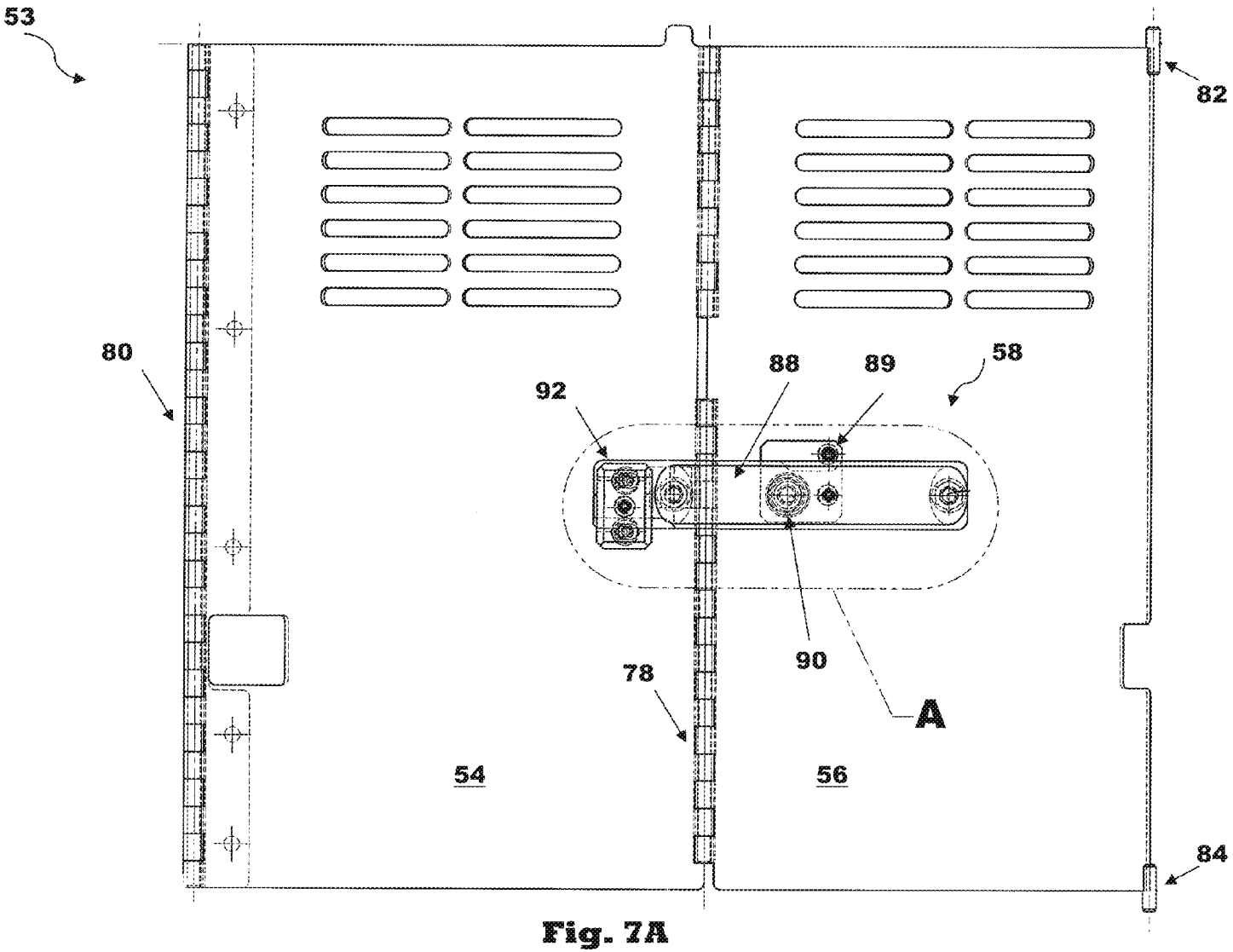
FIG. 7A is a detailed view of access doors on an ammunition drum assembly.
Figure 7B:
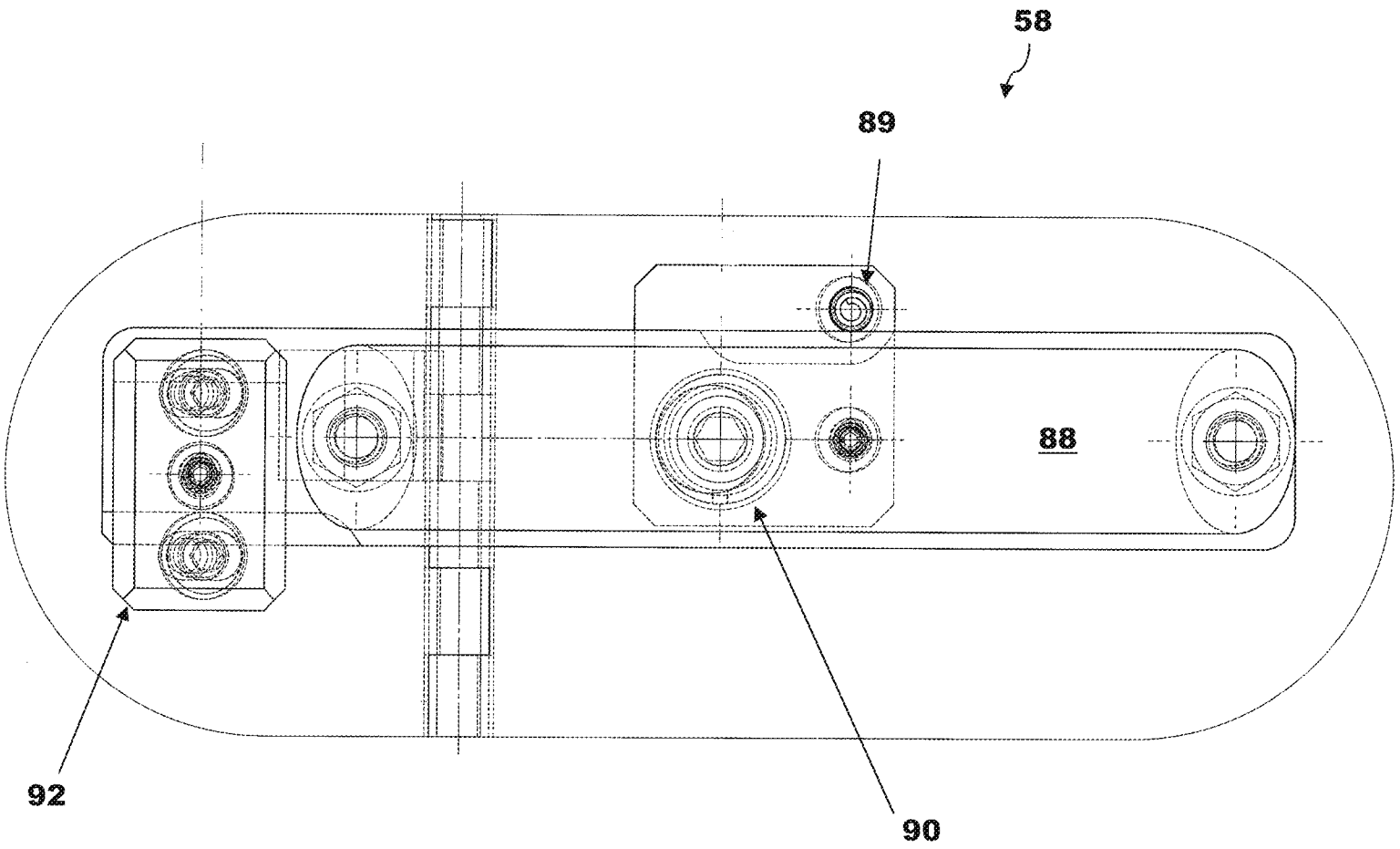
FIG. 7B is a close up view of section A in FIG. 7A.

FIG. 7A is a detailed view of an access door assembly 53. In this exemplary embodiment, access door assembly 53 comprises a bi-fold door assembly that includes access doors 54 and 56, which provide access to drum assembly 16 when opened. In one embodiment, access doors 54 and 56 may be pivotally or hingedly connected to each other at first hinge 78. Access door 54 further has second hinge 80 that hingedly connects the entire access door assembly 53 to the outer drum assembly 28. Access door 56 has stops 82 and 84 that lock into place on the outer drum assembly 28 so that the access door assembly 53 remains closed when the ammunition tray 62 does not need to be accessed. A latch mechanism 58 is provided to permit one handed operation of the access door assembly 53 by rotating the latch with either hand, unlatching the access doors 54 and 56, and permitting the doors to be opened. A detailed view of latch mechanism 58 is shown in FIG. 7B, which shows a handle 88, with a pivot 90 and a latch receiver 92. The handle 88 may be rotated from a horizontal position (access doors closed) to a vertical position (access doors opened) about pivot 90. A coiled spring pin 89 prevents handle 88 from being overrated past the vertical position.

Figure 7C:
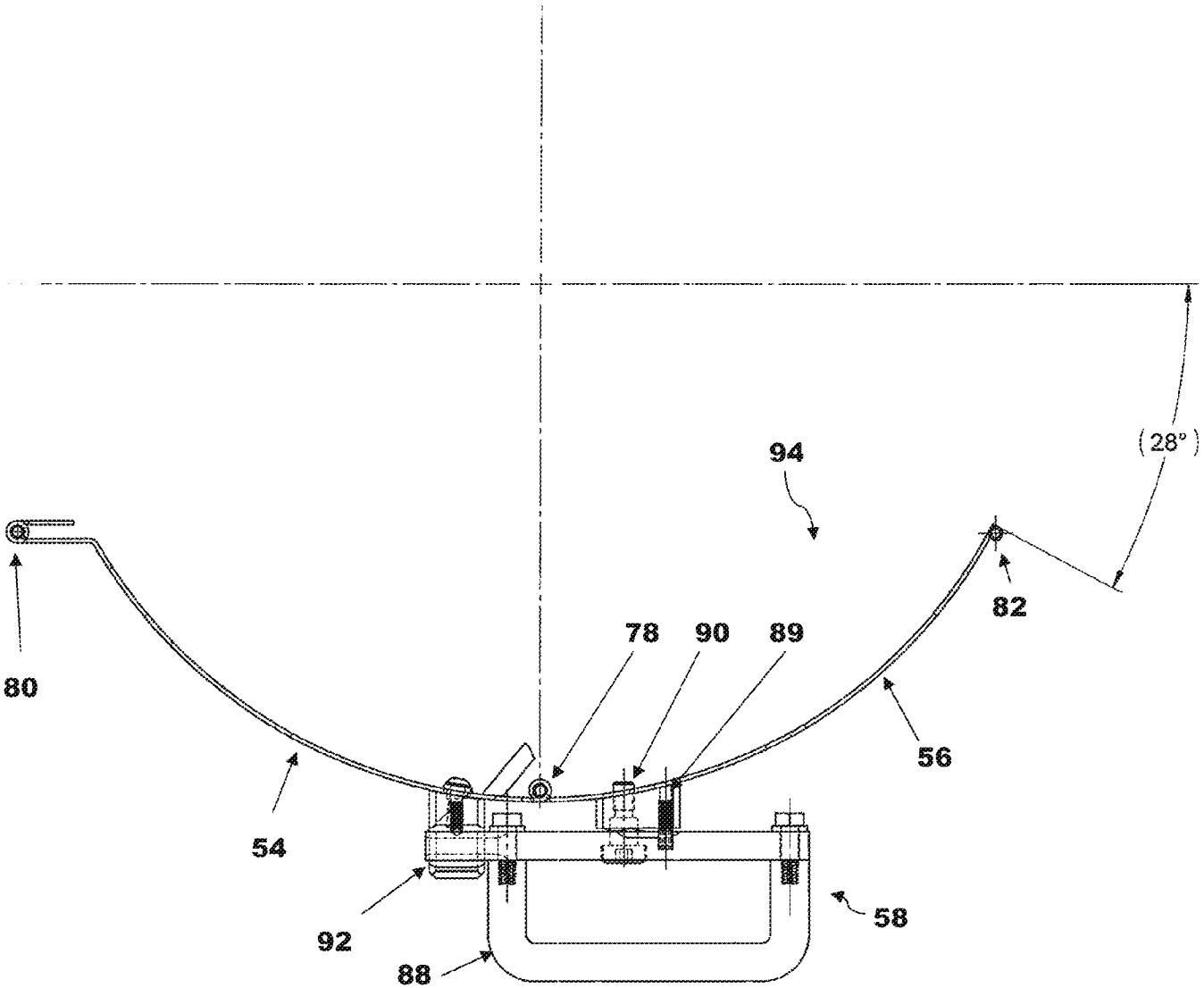
FIG. 7C is a top view of the access doors in FIG. 7A.
Figure 7D:
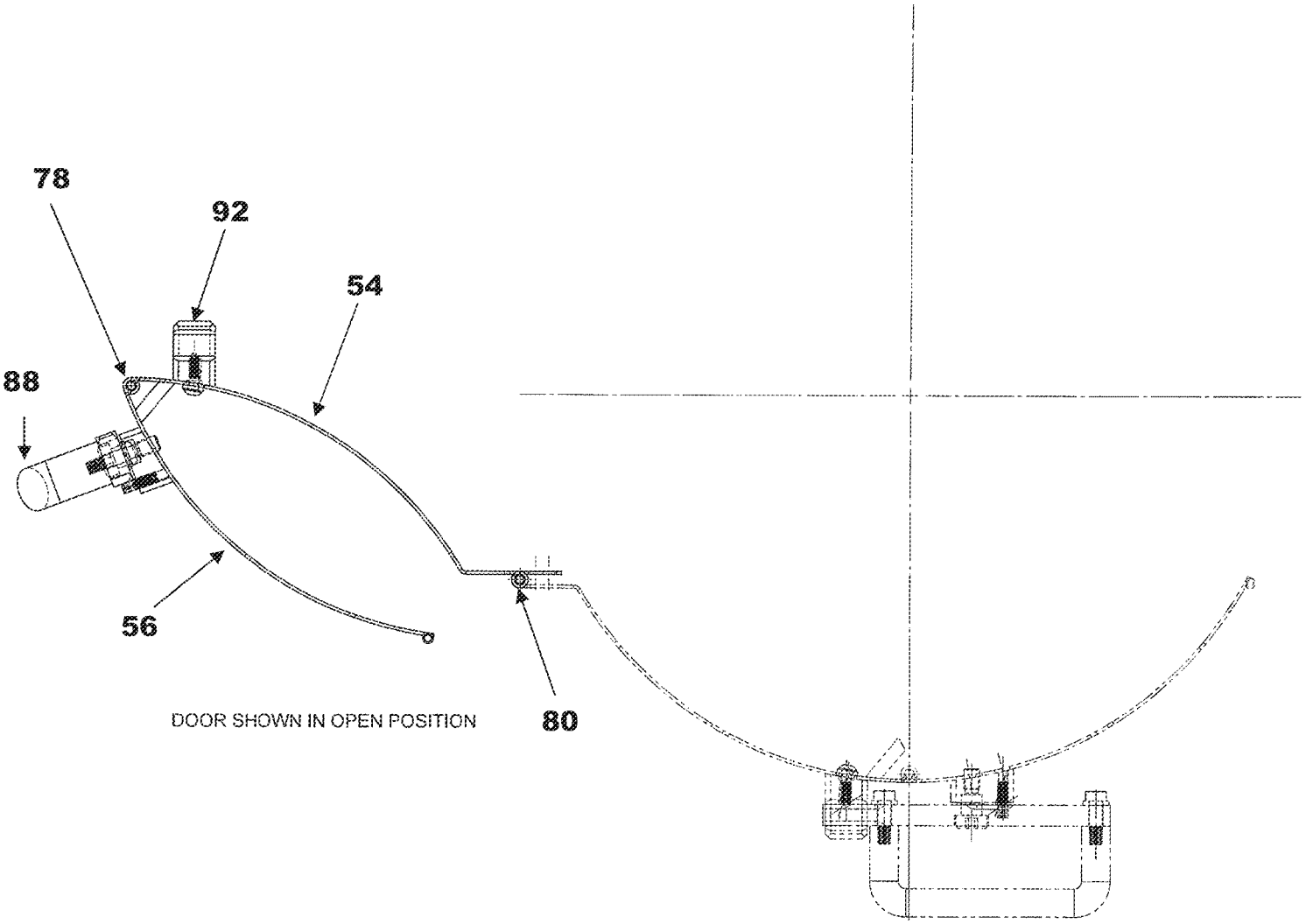
FIG. 7D is a view of the access doors of FIG. 7C showing their operation.

In operation of the access door assembly 53, reference is made to FIGS. 7C and 7D. As seen in FIG. 7C, when the access doors 54 and 56 are in their closed locked position 94, they assume an arcuate configuration such that they form a part of the periphery of outer drum assembly 28. When the handle 88 of latch mechanism 58 is unlatched and rotated, in this case in a CW direction so that the handle 88 is an upright or vertical position, the bi-fold access doors 54 and 56 are adaptable to assume the open folded position 95 as seen in FIG. 7D, wherein the access doors fold in on each other. This configuration saves space in the interior of an armored structure or vehicle where space is a premium. An operator may open and close the access doors 54 and 56 with only one hand, which is ergonomically desirable, especially in view of certain battle situations where a soldier may only have use of one hand. The opening and closing of access doors 54 and 56 also permits efficient loading of ammunition rounds to occur without the bother of constantly repositioning the doors. Access door 54 may include a latch mechanism (not shown) to latch and secure the access doors 54 and 56 in place onto the outer drum assembly 28 when they are in the open folded position 95. This would be advantageous if the armored structure or vehicle upon which modular weapon station 10 is mounted is experiencing considerable vibration. For example, if an armored vehicle was driving over rocky terrain and an operator wished to load or replenish ammunition rounds from an under armor position, the ability to secure access doors 54 and 56 in place would facilitate efficient loading of the new rounds.

Moreover, resolver/slip ring assembly 19 may include an azimuth position sensor 335 (e.g., an encoder) that may signal to a controller modular weapon station's azimuth positioning. If there is a desired designated azimuth position for loading, modular weapon station 10 may be configured to return to the designated azimuth position when low ammunition sensor 57 alerts an operator that ammunition has been depleted to a predetermined amount, such as when there are only a few rounds draping into inner drum assembly 27. For example, if a crew is operating a Humvee, there may be a loader. It would be beneficial for the access doors 54 and 56 to open consistently to where the loader is seated. Azimuth position sensor 335 may coordinate with a controller to ensure modular weapon station rotates to the designated azimuth position.

In another embodiment, access door assembly 53 may only have one access door. FIG. 12A shows an example of a modular weapon station 10 having under armor loading capabilities with only one access door. This type of access door may be advantageous in the event space within the armored structure or vehicle is not an issue.

Trunnion Assembly

An exemplary trunnion assembly 100 will now be discussed with reference to FIGS. 8A through 8G. Trunnion assembly 100 functions to adjust the elevation position of cradle 22 and weapon 21. At one end, trunnion assembly 100 has a V retaining recess 150 that allows for the quick release system 169 of cradle 22 to be inserted into it and secured by fastening mechanisms 271. At the other end of the trunnion assembly 100, an elevation sector gear 102 is coupled with the trunnion assembly 100 via sector gear mounting plate 113. Elevation sector gear 102 may be driven by an elevation pinion 173 to adjust the elevation of cradle 22 and weapon 21. When elevation pinion 173 is activated by elevation motor/brake assembly 175 (an electric motor), elevation sector gear 102 moves the weapon 21 along its elevation arc 26, which may, for example, be along a 90 degree arc (−30 to +60 degrees) or more. The elevation pinion 173 and its relationship to the elevation drive sector 102 will be described in more detail later in the disclosure.

Figure 8A:
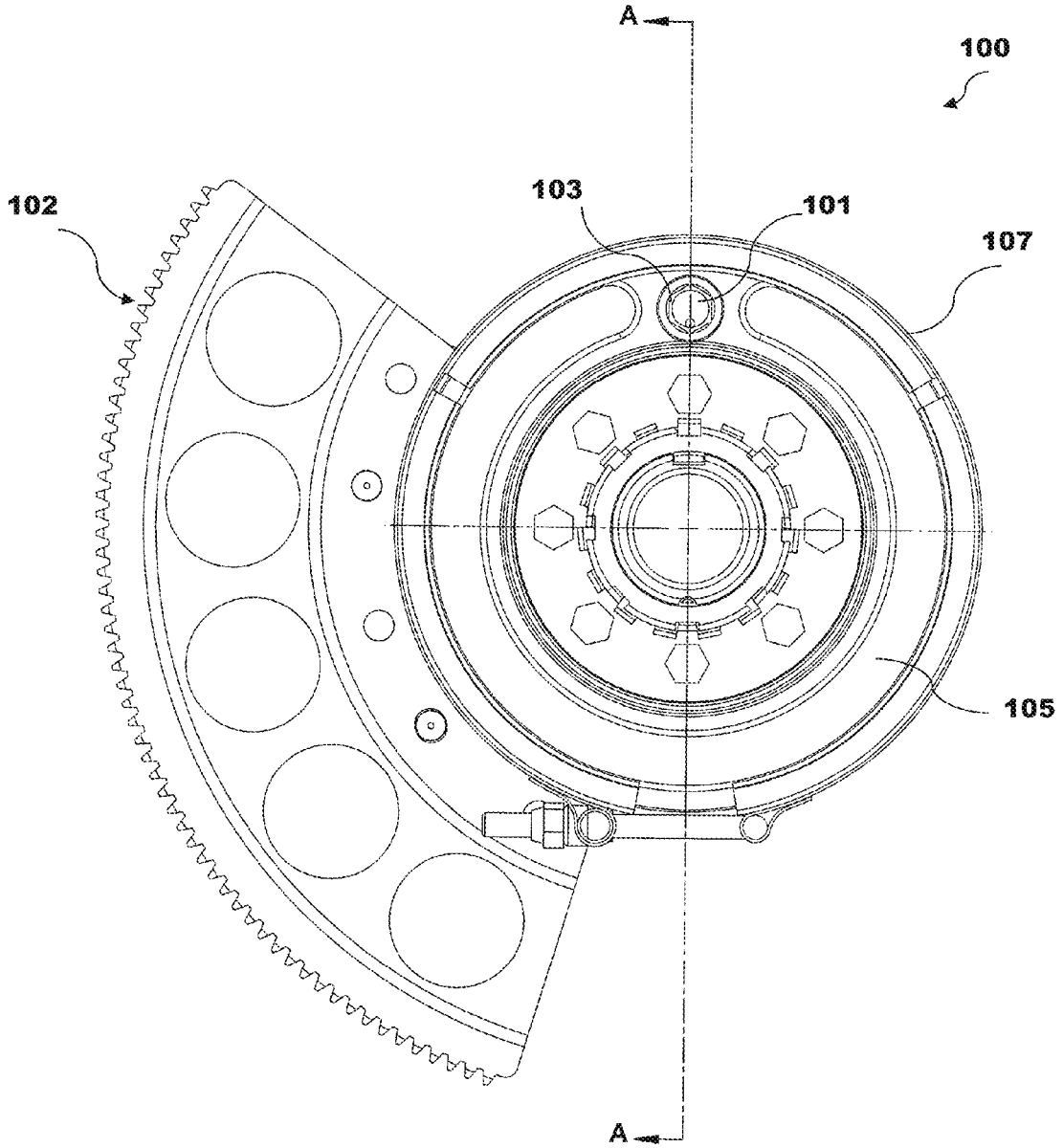
FIG. 8A is a side view of a trunnion assembly that may be used is one embodiment of the disclosure.

FIG. 8A is a side view of a trunnion assembly 100 according to one embodiment of the disclosure. Elevation sector gear 102 is shown coupled to the trunnion assembly 100. Sector gear hub 107 may have an annular recessed portion 105. Sector gear hub 107 may also have a pin bore 101 having a recessed bore portion 103. Pin bore 101 receives a bore sight adjust pin 118. Recessed bore portion 103 helps position the bore sight adjust pin 118 within the pin bore 101. The bore sight adjust pin 118 may be rotated to fine tune the elevation of cradle 22, weapon 21, and/or the optical sighting unit 18.

Figure 8B:
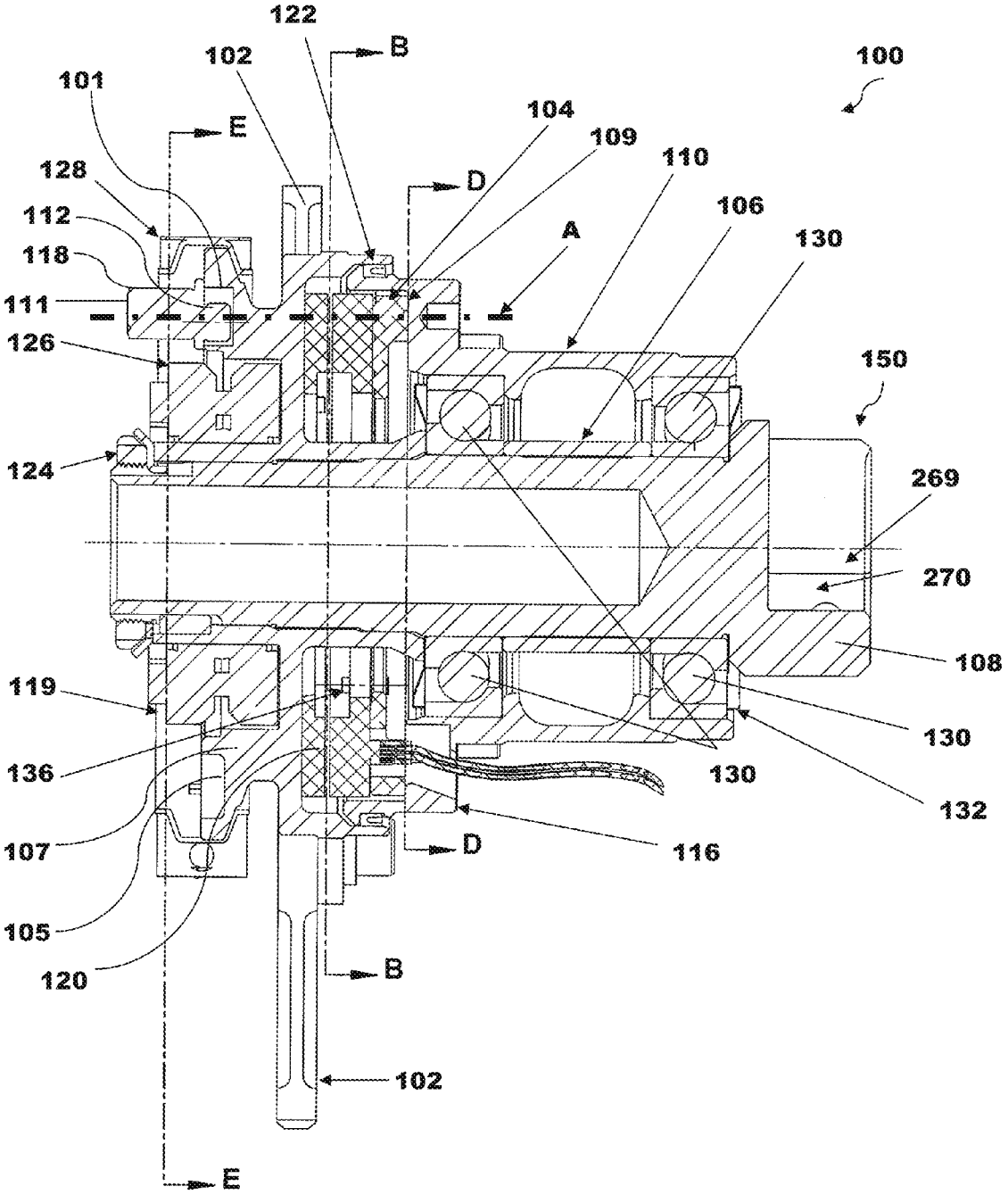
FIG. 8B is a cutaway side view of the trunnion assembly of FIG. 8A taken along line A-A.
Figure 8C:
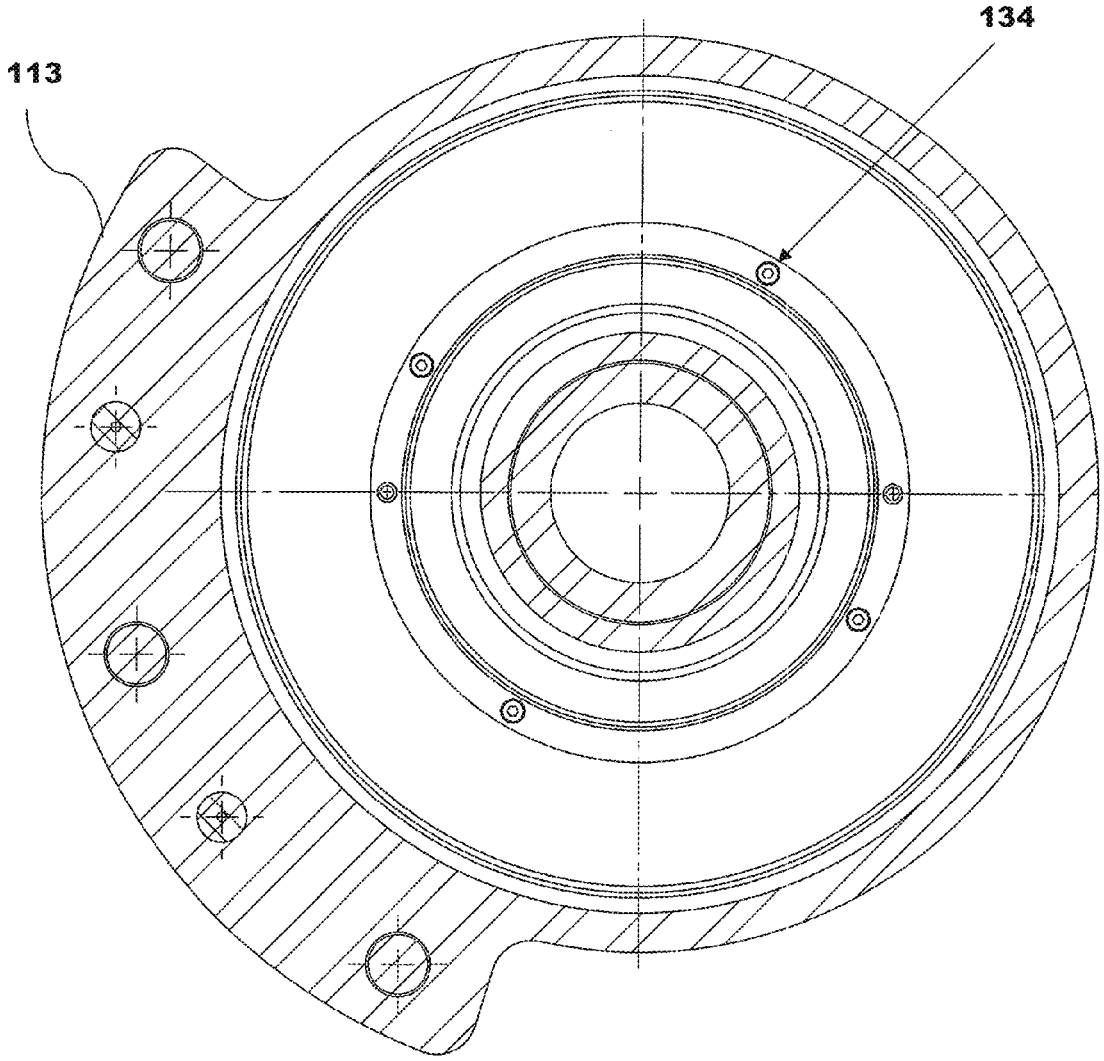
FIG. 8C is a view of the trunnion assembly of FIG. 8B taken along line B-B.
Figure 8D:
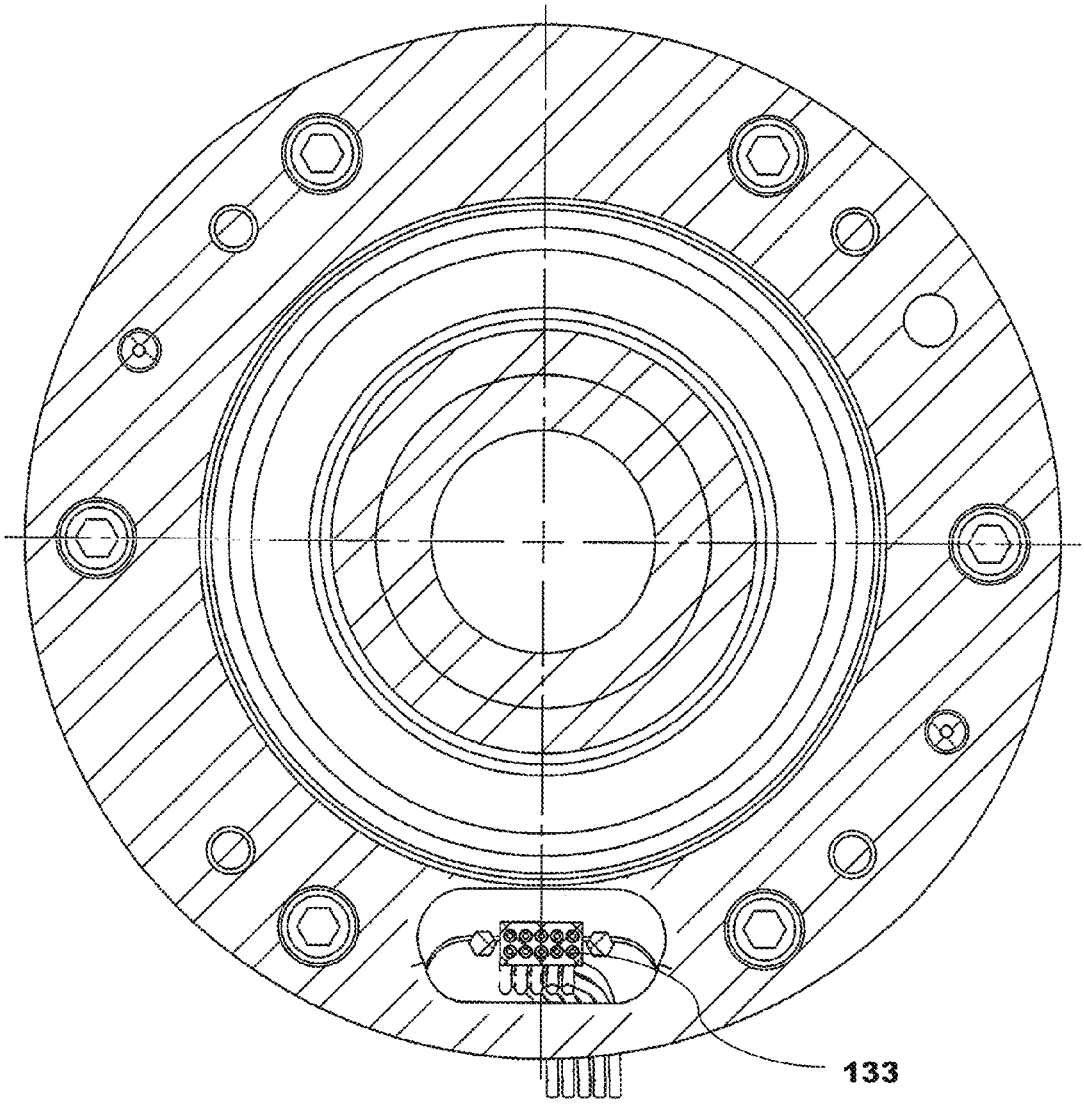
FIG. 8D is a view of the trunnion assembly of FIG. 8B taken along line D-D.
Figure 8E:
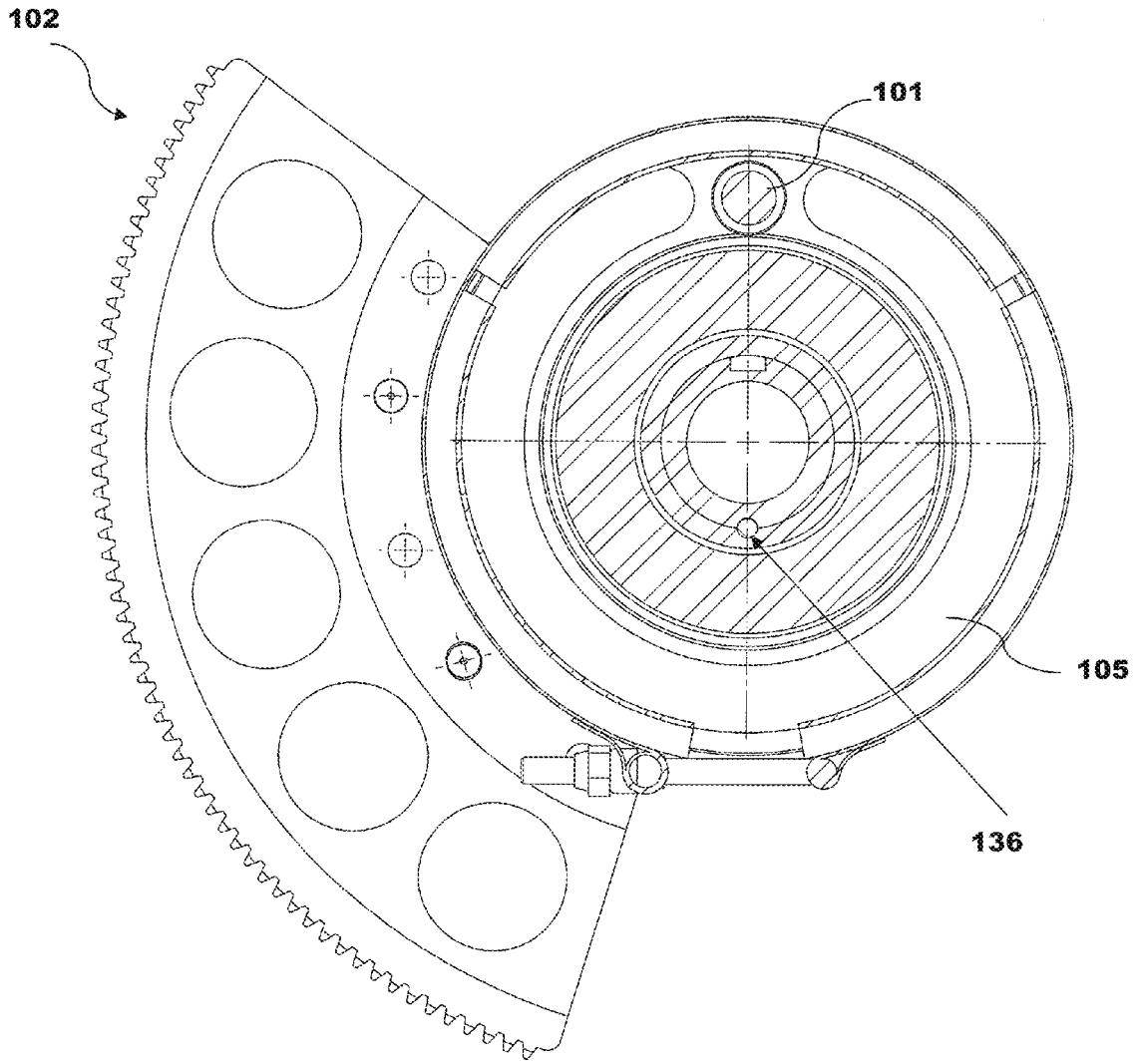
FIG. 8E is a view of the trunnion assembly of FIG. 8B taken along line E-E.
Figure 8F:
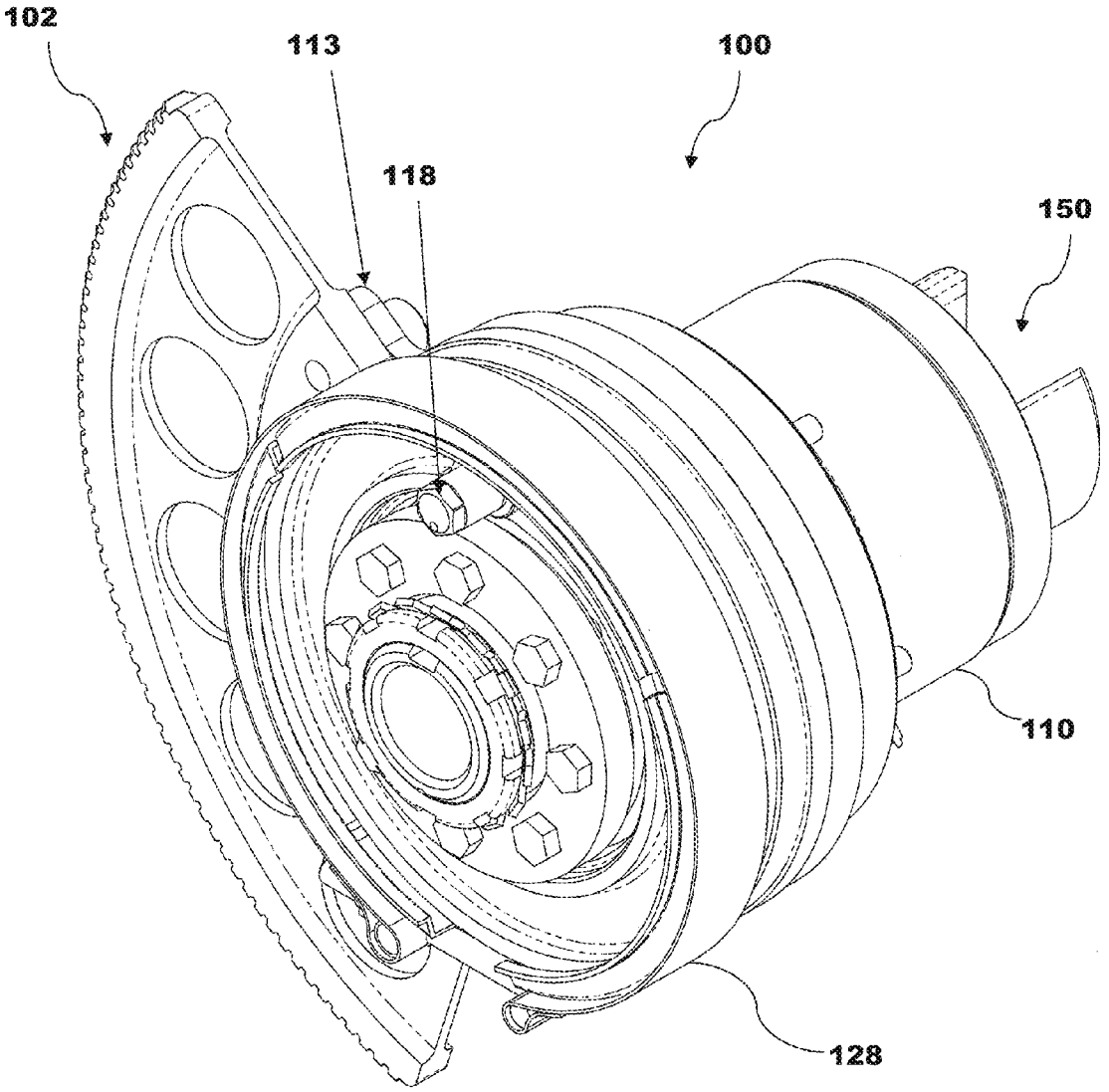
FIG. 8F is a perspective front view detail of the trunnion assembly of FIG. 8A.

FIG. 8B is a cutaway view of the trunnion assembly 100 taken along line A-A of FIG. 8A. Trunnion assembly 100 may have a resolver adaptor ring assembly 104, including a stator 109 and an encoder 120 (which is the rotor portion of the resolver adapter ring assembly 104). Stator 109 remains stationary, while the encoder 120 spins or rotates along with trunnion shaft 108. Encoder 120 may be configured to detect the elevation angle of weapon 21 and reposition the elevation arc 26 as directed by a tracking system or an operator input.

Trunnion shaft 108 is coupled with fixed bearing housing 114 by angular contact bearings 130. Angular contact bearings 130 permit smooth rotation of trunnion shaft 108 within the fixed bearing housing 114. Angular contact bearings 130 may be held in place by retainer 132. Spacer bearing 106 further allows rotation of the trunnion shaft 108. A gasket 116 seals the unit.

Referring still to FIG. 8B, elevation adjustment of the optical sighting unit 18, cradle 22, and weapon 21 may be accomplished by adjusting the bore sight adjust pin 118. When the bore sight adjust pin 118 is adjusted, the sector gear hub 107 rotates as well, causing the cradle 22, weapon 21, and optical sighting unit 18 to rotate along with it. Before adjusting the bore sight adjust pin 118, however, V clamp 128 must be removed. After the V clamp 128 is removed, the hexagonal head 111 of the bore sight adjust pin 118 may be rotated in a CW or CCW direction, depending on the desired elevation adjustment. As the hexagonal head 111 of the bore sight adjust pin 118 is rotated, eccentric portion 112 of the bore sight adjust pin 118 is rotated about axial axis A. Rotation of the bore sight adjust pin 118 causes a rotation of the sector gear hub 107 and in turn elevation sector gear 102 about axis A; hence, the cradle 22, weapon 21, and optical sighting unit 18 may be adjusted upward or downward in an elevation direction. After the bore sight adjust pin 118 has been adjusted, the V flange 119 must be realigned with the sector gear hub 107, and the V clamp 128 must clamp the V flange 119 with the sector gear hub 107 to keep them axially stabilized.

A piston seal 122, retainer unit 124, and shrink disc 126 further secure the trunnion assembly 100 together. Roller pin 134 is placed in the hub mechanism as are dowel pins 136. The pins may be retained in place by a retaining compound, such as, for example, LOCTITE compound.

Cradle

Figure 9A:
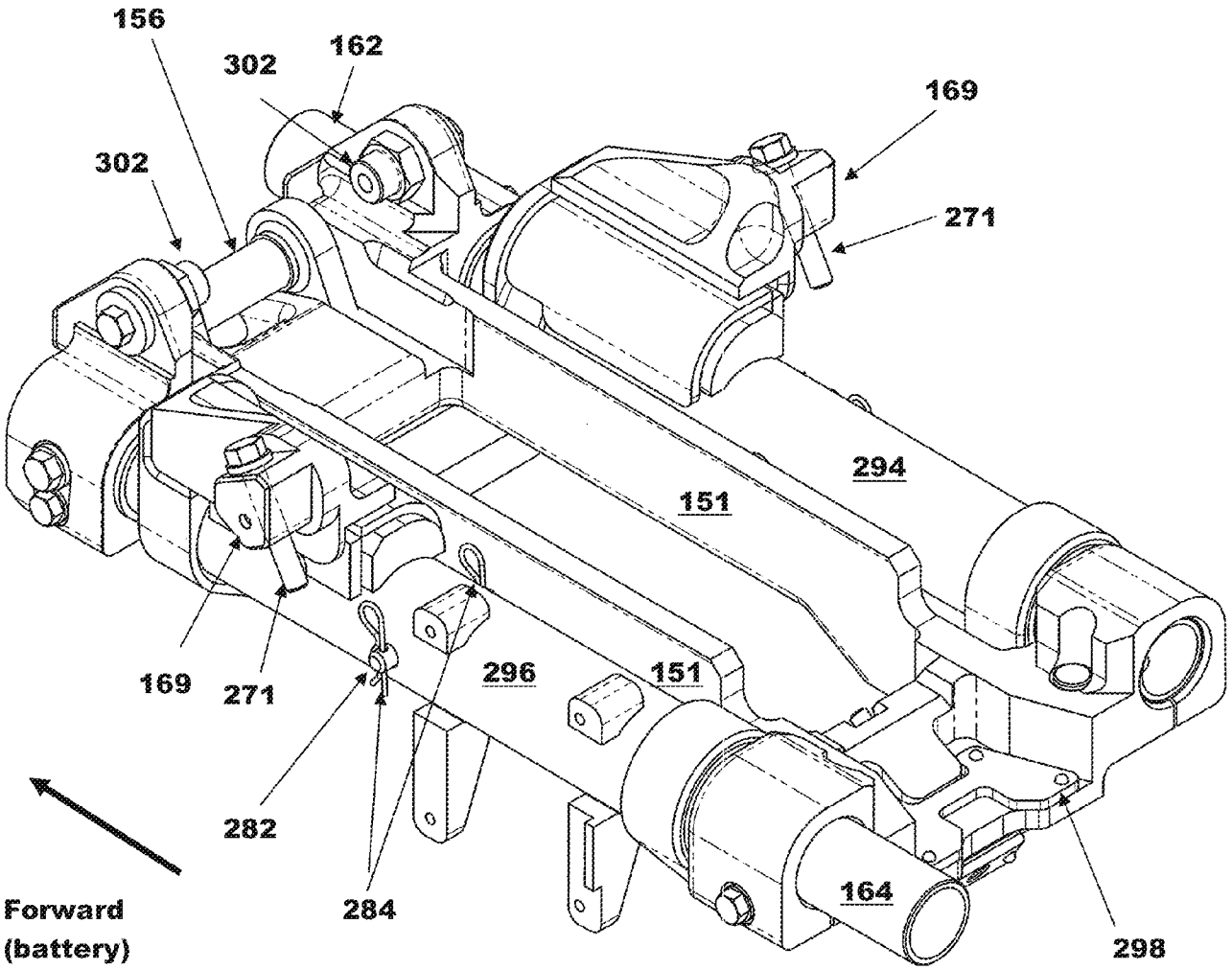
FIG. 9A is a perspective view of the cradle assembly of a modular weapon station according to one embodiment.

Cradle 22 of modular weapon station 10 will now herein be disclosed. It must be noted that modular weapon station 10 may be fitted with many different classes of weapons. Accordingly, cradle 22 is designed to be readily removed from modular weapon station 10 so that various cradles may be mounted upon modular weapon station 10. A cradle 22 may be designed to fit a series of weapons within a weapon class. In this context, a weapon class comprises weapons that are of similar weight, physical size, and weapons that have comparable recoil characteristics. For example, the exemplary cradle 22 shown in FIG. 9A is configured to fit an M2 0.50 caliber heavy machine gun and an MK19 40 mm grenade machine gun. Both of these weapons are of comparable size, weight, and have similar recoil characteristics; thus cradle 22 is designed to fit this class of weapons and may accommodate both an M2 and MK19. Although cradle 22 may be configured to secure different classes of weapons, the inventive concepts of cradle 22 disclosed herein are a staple for all cradles configured to be mounted upon modular weapon station 10.

Exemplary embodiments of cradle 22 will be discussed in detail with reference to FIGS. 9A through 9E. Cradle 22 is equipped with an inner cradle assembly 152 and outer cradle assembly 154. The inner cradle assembly 152 and outer cradle assembly 154 are coupled together and allow for a weapon 21 to be mounted thereon. As can be seen in FIG. 9C, inner cradle assembly 152 and outer cradle assembly 154 are separated by a recoil travel clearance 153, which in this example is approximately one inch. A weapon's lateral movement may be limited by weapon support bars 151, which run the length of cradle 22. A weapon's receiver unit is placed between the weapon support bars 151. The rear of a weapon's receiver unit is supported by rest pad 298 and may be further secured by rear clamp assembly 34.

Cradle 22 has a first guide tube 166 and a second guide tube 168 that are on opposed sides of the cradle assembly (i.e., the left and right sides), and both guide tubes generally run the length of cradle 22, extending from the inner cradle assembly 152 to the outer cradle assembly 154. First guide tube 166 and second guide tube 168 have two primary functions: to house the recoil damping units (one dampening unit in each guide tube) and to act as elevation stops to prevent a given weapon 21 from exceeding its allowable elevation limits.

In the exemplary embodiment shown in FIG. 9A, cradle 22 has a first guide tube 166. At the forward portion of the cradle 22, a part of first guide tube 166 extends out beyond cradle 22. This portion is denoted as forward guide stop 162. Forward guide stop 162 acts to prevent weapon 21 from exceeding its minimum elevation limit (or maximum depression), such as −30 degrees, by bumping up against an elastomeric pad or similar mechanical stop located on rotatable frame 24. Cradle 22 also has a second guide tube 168 shown in FIG. 9A. At the rear portion of cradle 22, a part of the second guide tube 168 extends out beyond the rear or aft portion of cradle 22. This extending portion is denoted as rear guide stop 164. Rear guide stop 164 functions to prevent weapon 21 from exceeding its maximum elevation limit, such as +60 degrees, by bumping up against an elastomeric pad or similar mechanical stop located on rear side of rotatable frame 24. In this manner, first guide tube 166 and second guide tube 168 act to prevent a weapon 21 from exceeding its allowable elevation limits.

As mentioned previously, first guide tube 166 and second guide tube 168 each have damping recoil units. A first damping recoil unit 286 housed within first guide tube 166 and a second damping recoil unit 288 housed within second guide tube 168 are configured to dampen and absorb recoil forces when weapon 21 is fired, and to a smaller extent, the counter-recoil forces experienced by cradle 22 as the weapon 21 returns to battery (or the forward position). First damping recoil unit 286 and second damping recoil unit 288 are configured and function the same, except that they are housed in different guide tubes.

Figure 9B:
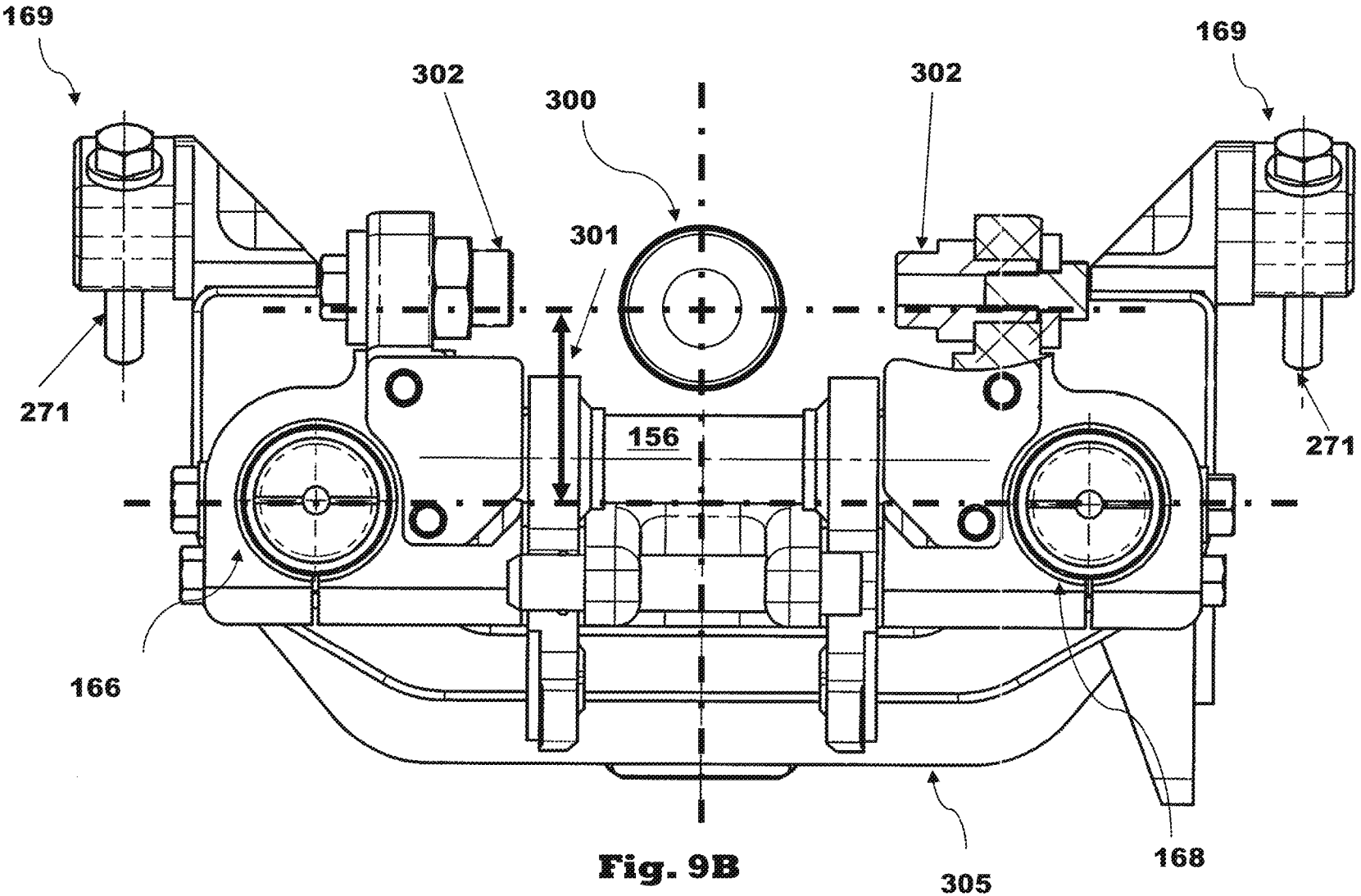
FIG. 9B is a front view of the cradle assembly of FIG. 9A.
Figure 9C:
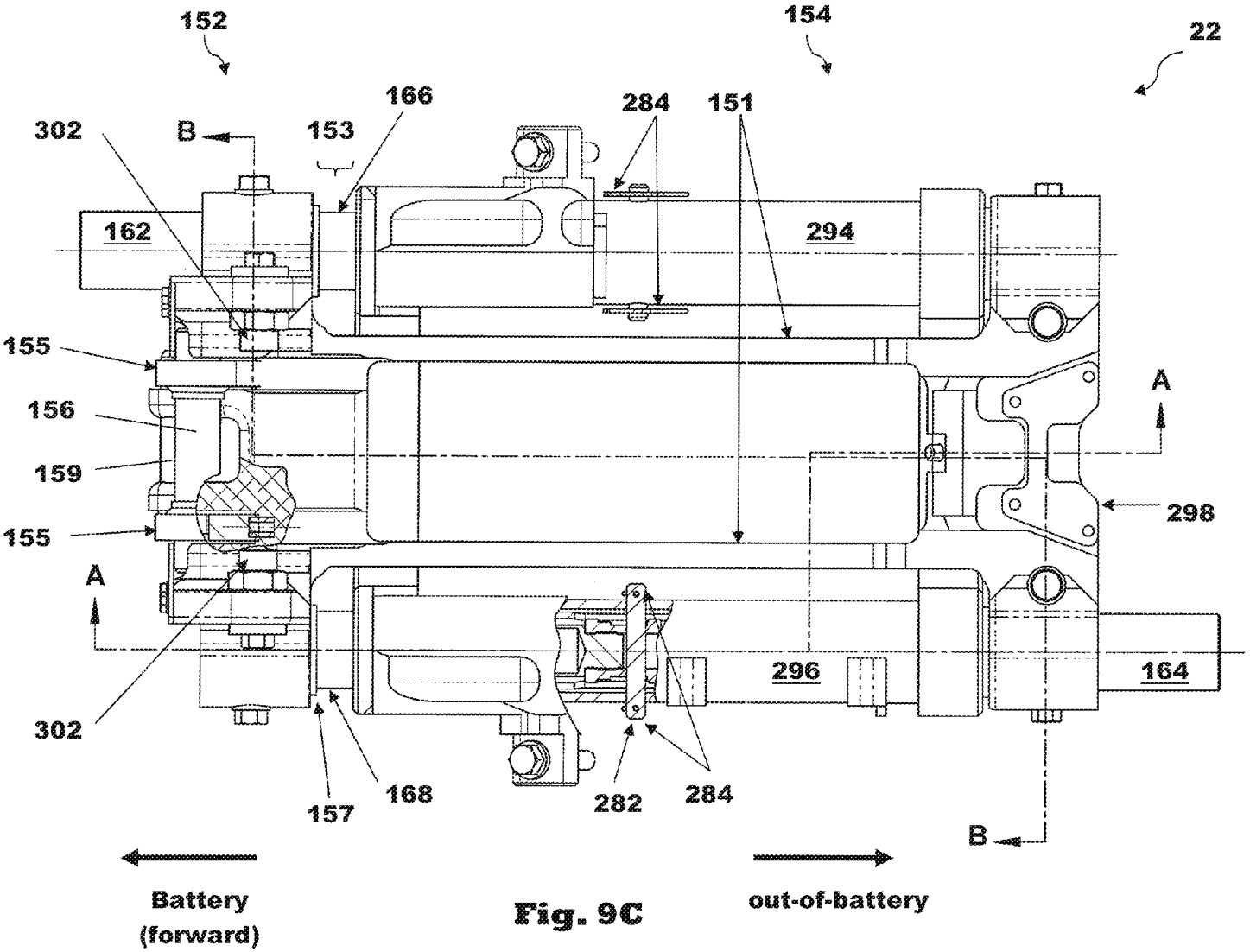
FIG. 9C is a top plan view of the cradle assembly of FIG. 9A
Figure 9D:
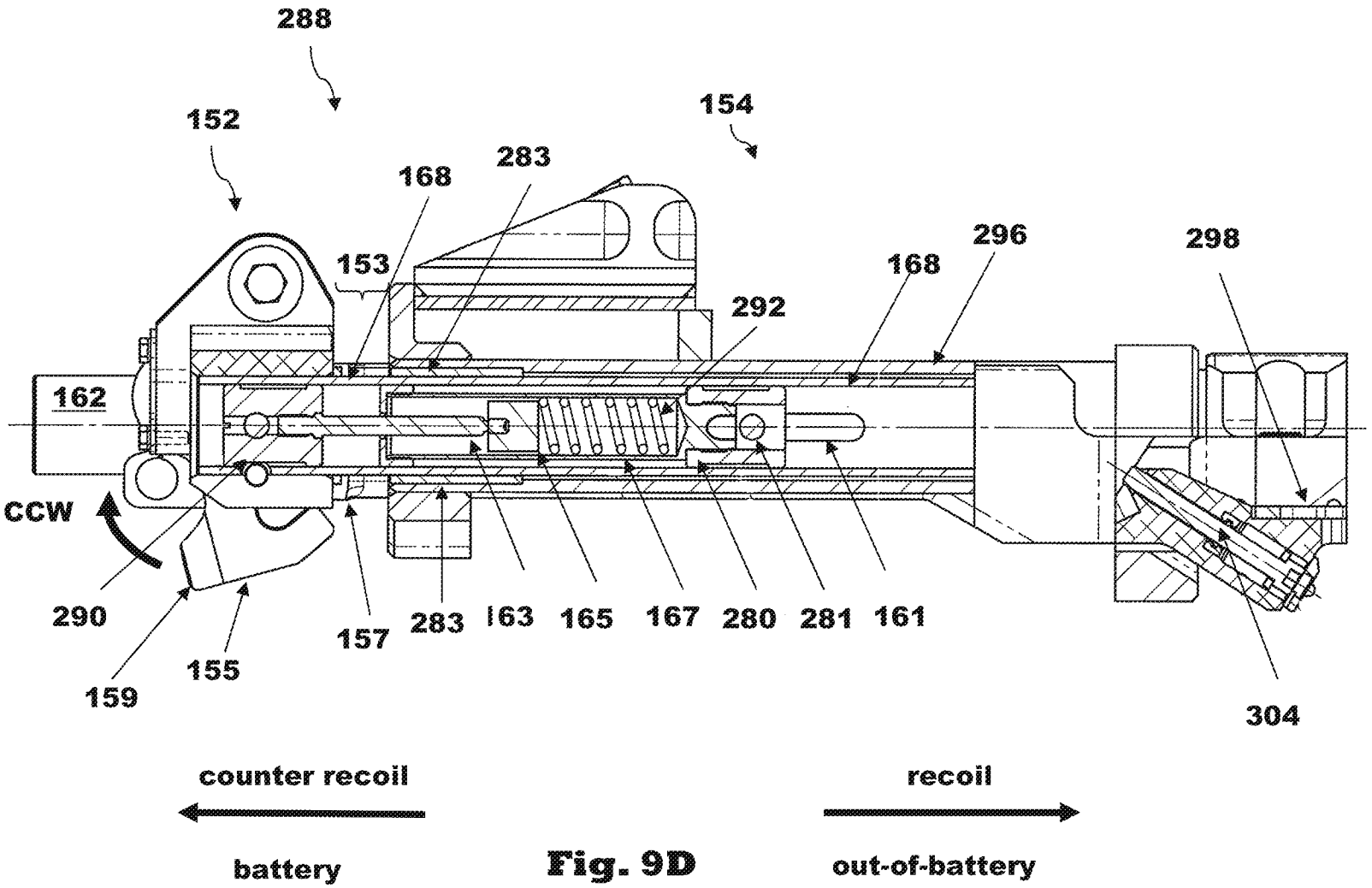
FIG. 9D is a view taken along line A-A of FIG. 9C.
Figure 9E:
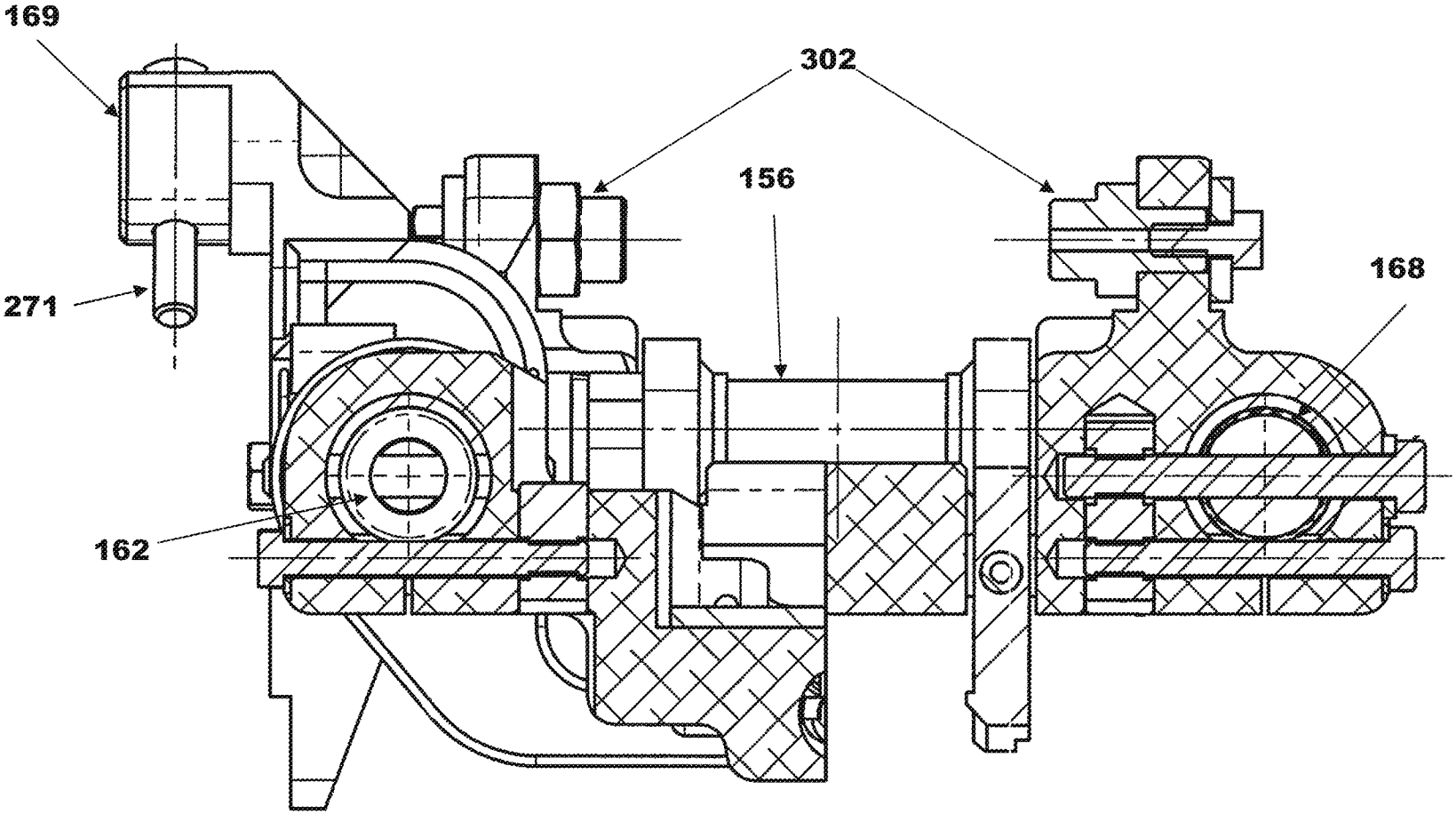
FIG. 9E is a view taken along line B-B of FIG. 9C.
Figure 9F:
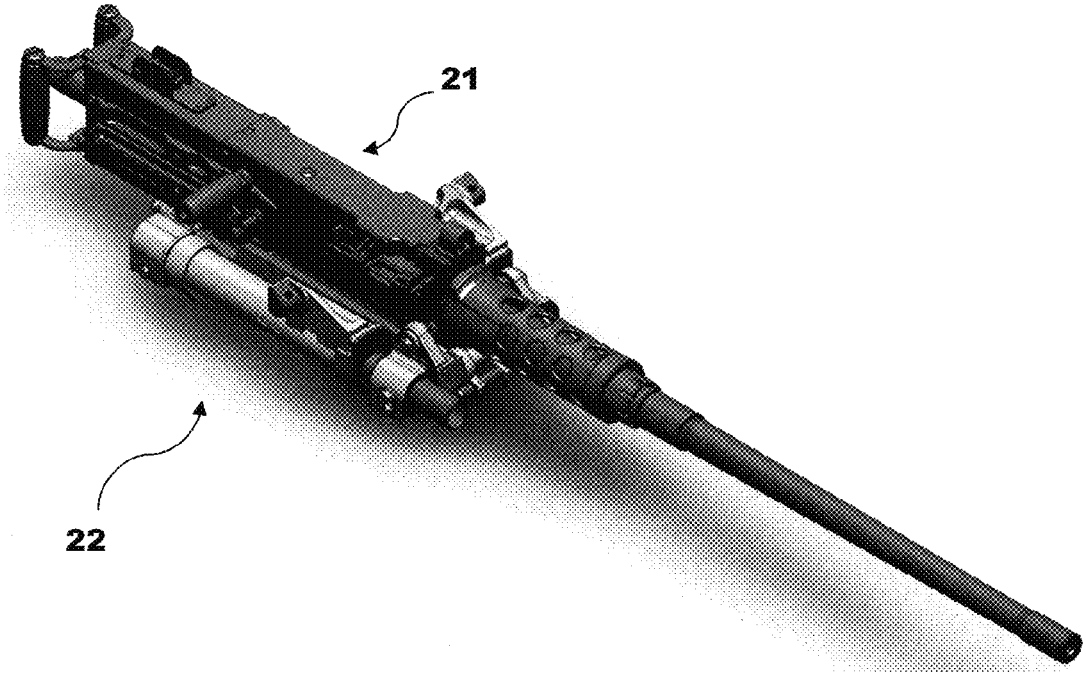
FIG. 9F is a schematic perspective view of an M2 0.50 caliber heavy machine gun mounted on an exemplary cradle.

Referring now to FIG. 9D, second damping recoil unit 288 is shown extending within second guide tube 168 from the inner cradle assembly 152 to the outer cradle assembly 154. Within the inner cradle assembly 152 portion of the second damping recoil unit 288, a damper recoil nut 290 provides a threaded bore for rod 163. Rod 163 is threaded into recoil nut 290. Rod 163 extends from the inner cradle assembly 152 to the outer cradle assembly 154, and is coupled with a piston 165 by conventional means (such as by way of a gudgeon pin and snap rings). Piston 165 reciprocates within a shock absorber 167, a generally cylindrical hollow body. Shock absorber 167 may be filled with a high viscosity hydraulic fluid throughout. Piston 165 may have an orifice or multiple orifices (not shown) that allow hydraulic fluid to flow throughout the entire shock absorber 167. This permits cradle 22 to dampen the recoil and counter-recoil forces exerted on cradle 22 when weapon 21 is fired. A shock compression spring 292 may further be provided within shock absorber 167 to further dampen the recoil forces experienced by cradle 22 when weapon 21 is fired. Shock absorber 167 is held into place by a damper support nut 280 which is in turn held in place by a damper support nut pin 282. Damper support nut pin 282 passes through damper support nut pin hole 281. Cotter pins 284 hold damper support nut pin 282 in place. Slot 161 allows second guide tube 168 to reciprocate without damaging or catching on damper support nut pin 282. Slot 161 is only within the second guide tube 168; slot 161 does not extend to the second guide tube housing 296. Thus, slot 161 cannot be seen from an outside view of cradle 22 (e.g., slots 161 cannot be seen in the perspective view of cradle 22 in FIG. 9A). Although the second damping recoil unit 288 of second guide tube 168 was explained in detail, the first damping recoil unit 286 of first guide tube 166 is configured identically to second damping recoil unit 288 of second guide tube 168.

Cradle 22 dampens recoil and counter-recoil forces as follows. The inner cradle assembly 152 is forward of the outer cradle assembly 154, as shown in FIG. 9D. Inner cradle 152 may reciprocate in a back-and-forth linear motion when weapon 21 is fired. When weapon 21 is discharged and experiencing recoil forces, the inner cradle assembly 152 is forced backwards (out-of-battery) toward the outer cradle assembly 154. The inner cradle 152 translates substantially the length of recoil travel clearance 153. A square o-ring 157 or like buffer may be attached to inner cradle assembly 152 (or outer cradle assembly 154) to avoid metal on metal contact between the inner cradle assembly 152 and outer cradle assembly 154. Bushings 283 may be provided to protect the translating guide tubes from shearing and rubbing against the housing of the guide tubes. As the inner cradle assembly 152 translates, first guide tube 166 and second guide tube 168 also translate towards an out-of-battery direction. The first guide tube housing 294 and second guide tube housing 296 do not translate; they are fixed. As the guide tubes translate, rods 163 in both tubes force their respective pistons to compress the hydraulic fluid and shock compression springs 292 within shock absorbers 167. Orifices in the piston allow hydraulic fluid to pass though it in a battery direction so as to provide hydraulic fluid for piston 165 to compress on its counter-recoil reciprocation. As the guide tubes translate back toward the out-of-battery position, the fixed damper support nut pins 282 ride in the slots 161 of first guide tube 166 and second guide tube 168.

When weapon 21 begins to counter-recoil or return to battery, inner cradle assembly 152 also translates toward battery. As this occurs, rod 163 forces piston 165 towards battery as well. Piston 165 compresses the hydraulic fluid on the side of the shock absorber 167 opposite the shock compression spring 292. Orifices in the piston allow hydraulic fluid to pass though it in an out-of-battery direction so as to provide hydraulic fluid for piston 165 to compress on its recoil reciprocation. Shock compression spring 292 is allowed to decompress and elongate back toward a static equilibrium position. As the guide tubes translate forward toward the battery position, the fixed damper support nut pins 282 ride within slots 161 of first guide tube 166 and second guide tube 168.

The reciprocation of the pistons 165 within shock absorbers 167 along with the other damping components of the first damping recoil unit 286 and second damping recoil unit 288 provide maximum stiffness while only adding minimal weight to the cradle 22 of modular weapon station 10. First damping recoil unit 286 and second damping recoil unit 288 are also completely protected within their respective housings.

Not only do the first damping recoil unit 286 and second damping recoil unit 288 provide maximum stiffness while adding minimal weight to the cradle 22, cradle 22 allows a weapon 21 to be recessed into cradle 22 such that the offset distance 301 between weapon barrel 300 and first damping recoil unit 286 and second damping recoil unit 288 only has a vertical offset distance 301 of about two inches or less, as shown in FIG. 9B. The vertical offset distance 301 is measured from the center point of the weapon barrel 300 to the center point of the first damping recoil unit 286 and second damping recoil unit 288 as shown in FIG. 9B. In FIG. 9B, only the weapon barrel 300 is shown for clarity. In the past, cradle assemblies have not been able to achieve this minimal offset. The offset distance 301 is of critical importance. The greater the offset distance 301, the more friction that occurs on the side loads of the shock absorbers 167 of the damping recoil units. With a large offset distance, the structural components of cradle 22 may begin to oscillate when a weapon 21 is recoiling and counter-recoiling rapidly, which may cause deformation (bending) of the cradle 22. Bending of the cradle 22 decreases accuracy and creates undesired vibration on modular weapon station 10.

As mentioned previously, the exemplary cradle 22 shown in FIGS. 9A through 9E may be mounted with an M2 or an MK19. An M2 may be mounted by the following steps. Weapon retainer 156 contains two hooks 155. When the hooks 155 are not in use, they are allowed to hang down as shown in FIG. 9D (only one hook 155 is shown in FIG. 9D because it is a cross sectional view). To secure the receiver assembly of the M2, with reference to FIG. 9D, the hooks 155 may swing in a CCW direction approximately 270 degrees so that the hooks 155 are pointing upward. Hook bumpers 159 allow hooks 155 to catch on the weapon retainer 155 so that they are in the proper position for the receiver unit of the M2 to fit into place. An M2 may be configured to have a cross hole in the lower forward position of its receiver body. A retainer pin 158 may be removed from its stowage position shown in FIG. 9C and inserted through the M2 receiver's cross hole so that it may be secured. The rotated hooks 155 secure the ends of the retainer pin 158 after it has been inserted through the cross hole of the M2 receiver. Additional means to hold the retainer pin 158 in place may be used. For example, cotter pins may be used.

To secure the back portion of the M2 receiver assembly, the M2 receiver may have a rear clevis with a cross hole. A retainer pin 158 may be stored at the back portion of cradle 22. The retainer pin 158 may be inserted through the cross hole and secured by cotter pins or the like. Furthermore, a rear clamp assembly 34 (shown in FIG. 3A) may further secure the rear portion of an M2 receiver assembly.

Figure 9G:
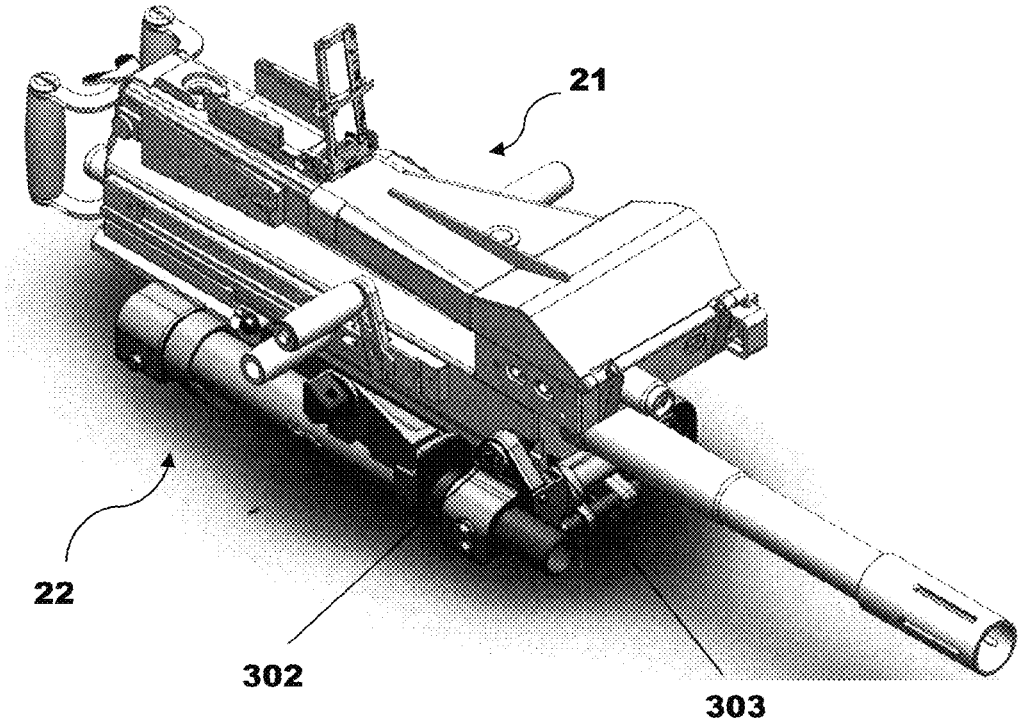
FIG. 9G is a schematic perspective view of an MK19 40 mm grenade machine gun mounted on an exemplary cradle.
Figure 10A:
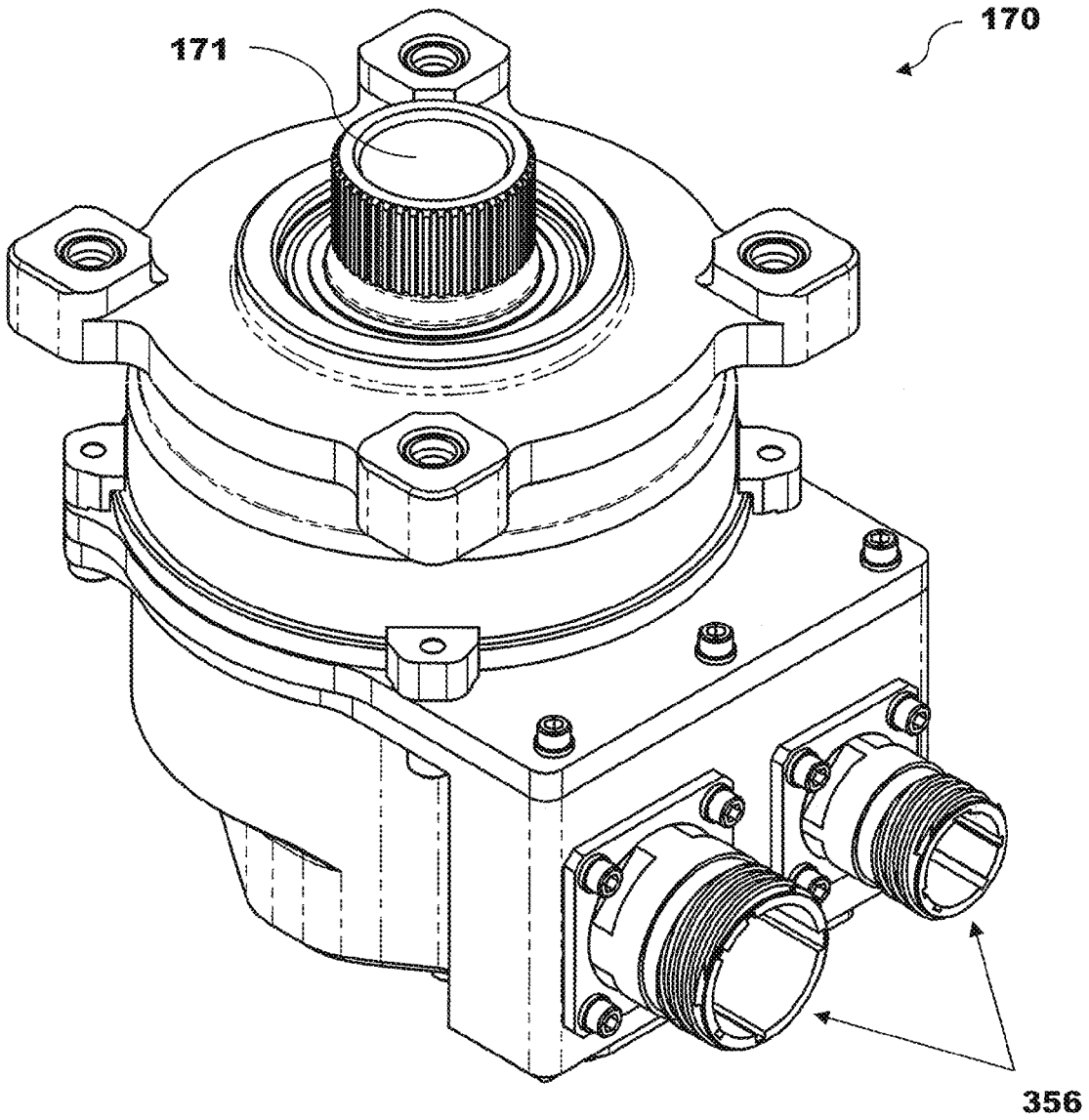
FIG. 10A is perspective view of a motor/brake assembly used in one embodiment of the disclosure.
Figure 10B:
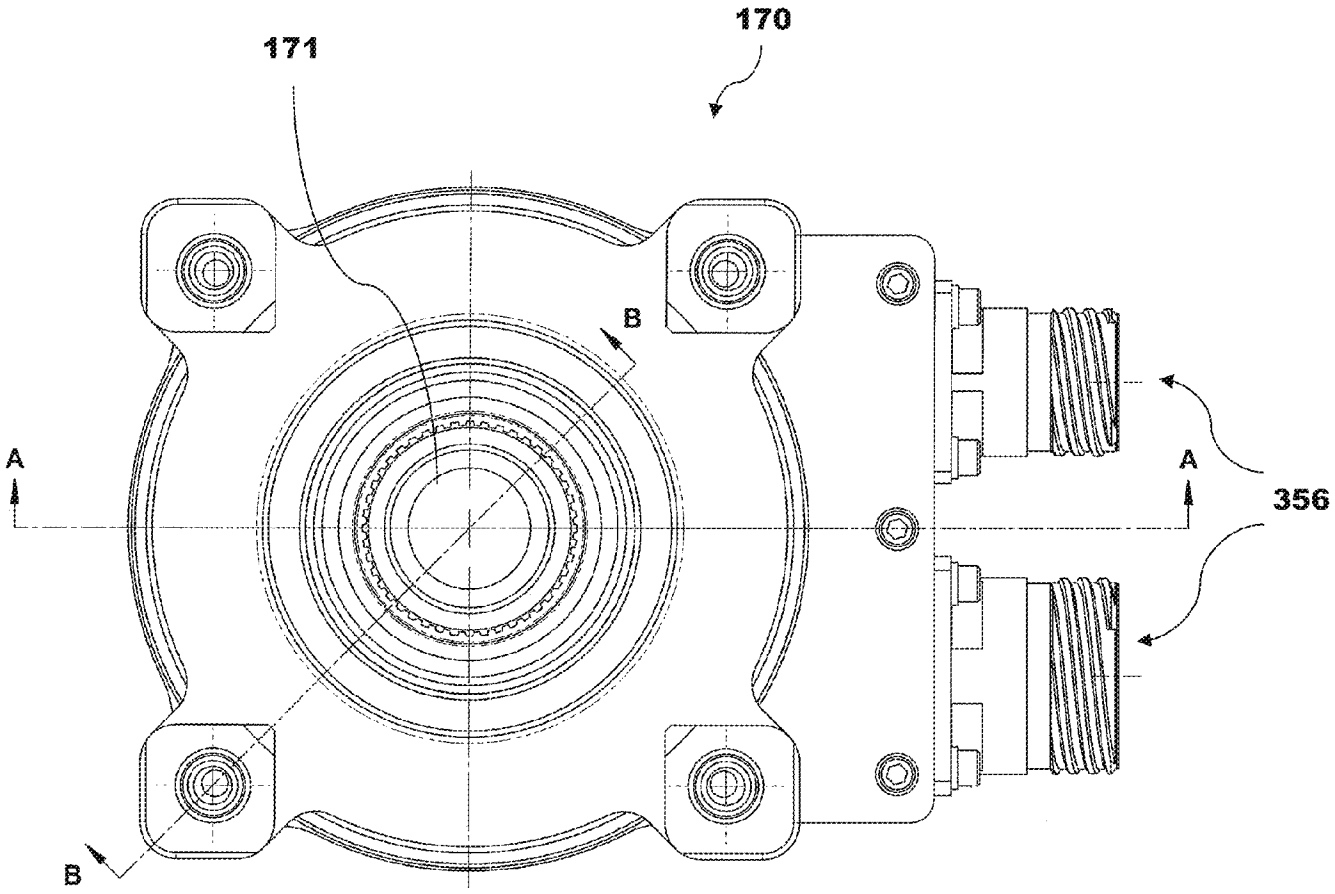
FIG. 10B is a top view of the motor/brake assembly of FIG. 10A.
Figure 10C:
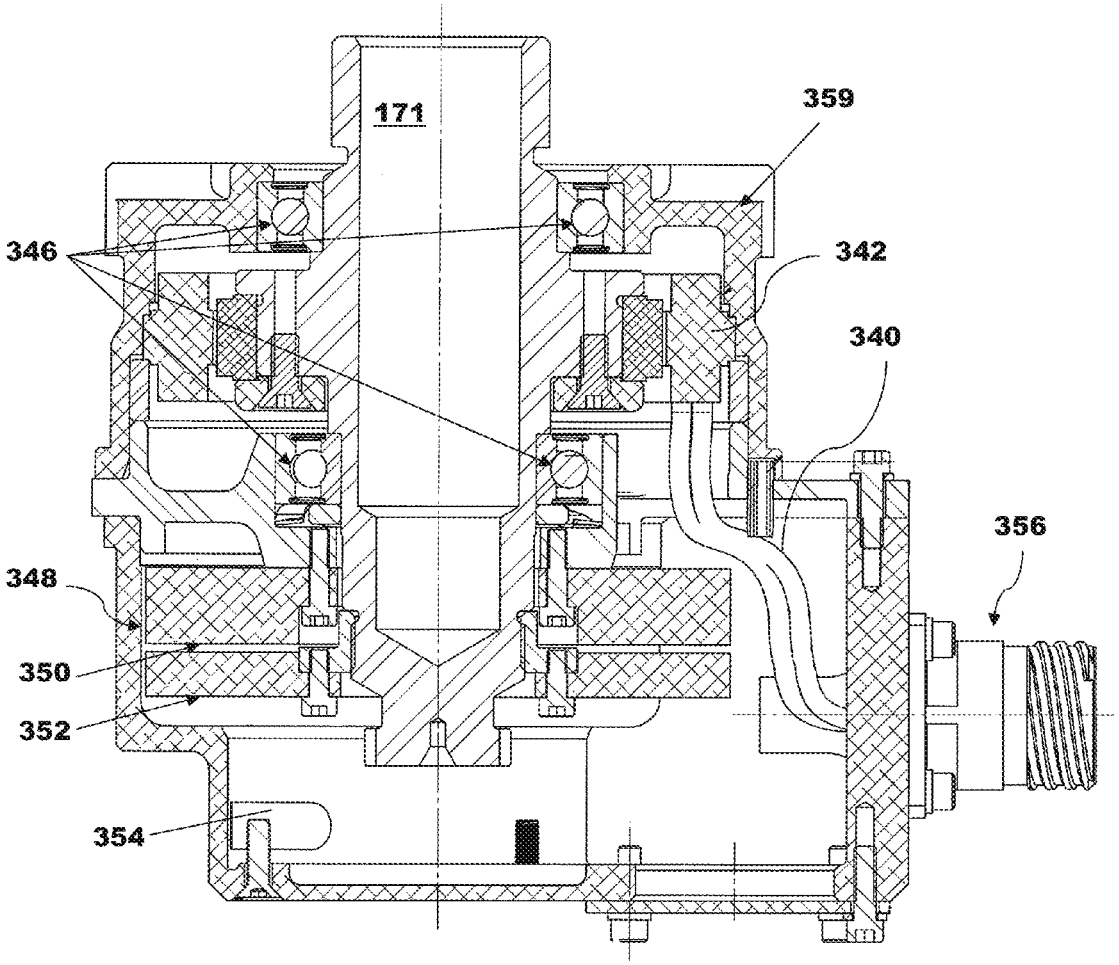
FIG. 10C is a cutaway view taken along line A-A of FIG. 10B.
Figure 10D:
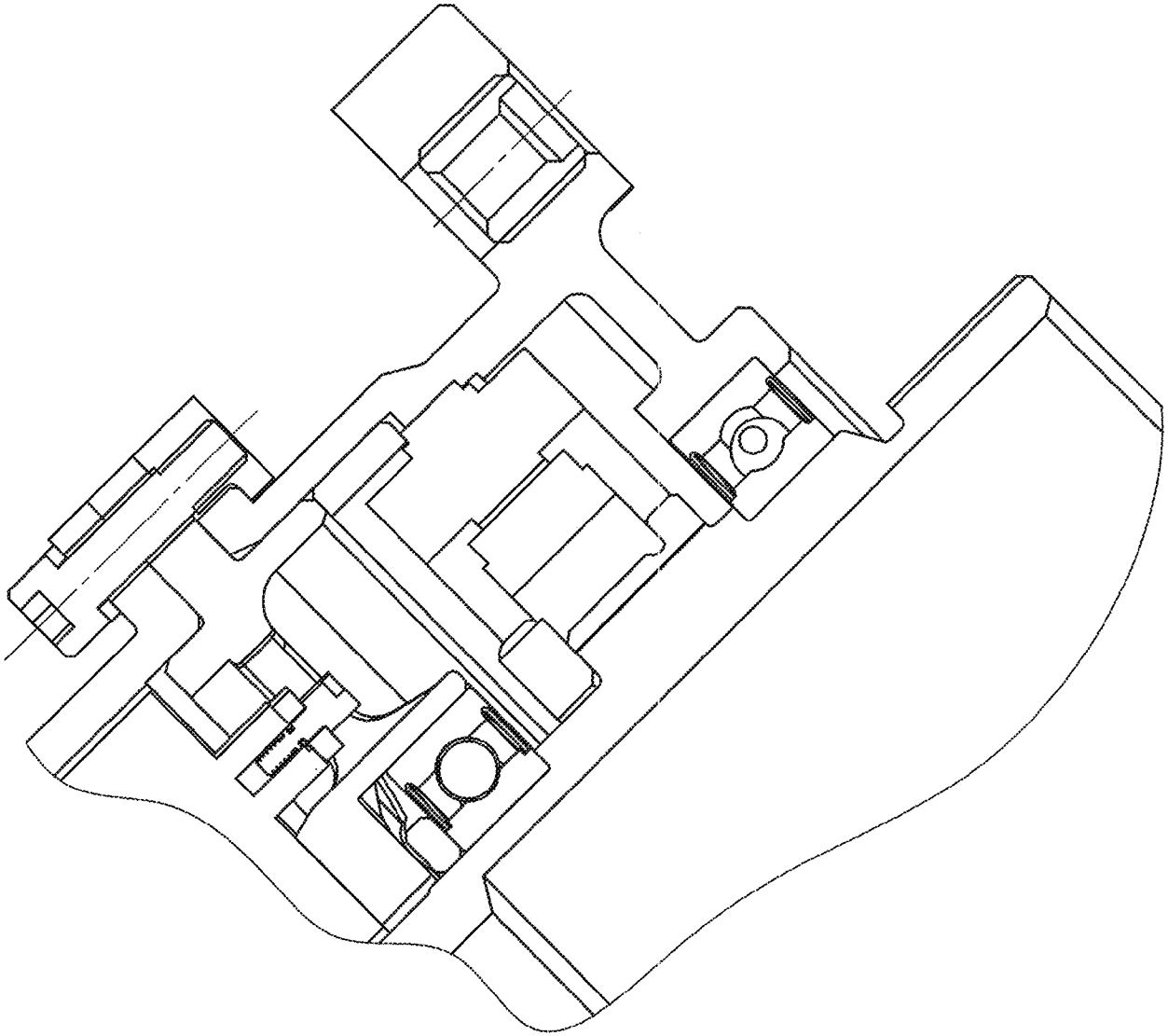
FIG. 10D is a cutaway view taken along line B-B of FIG. 10B.
Figure 10E:
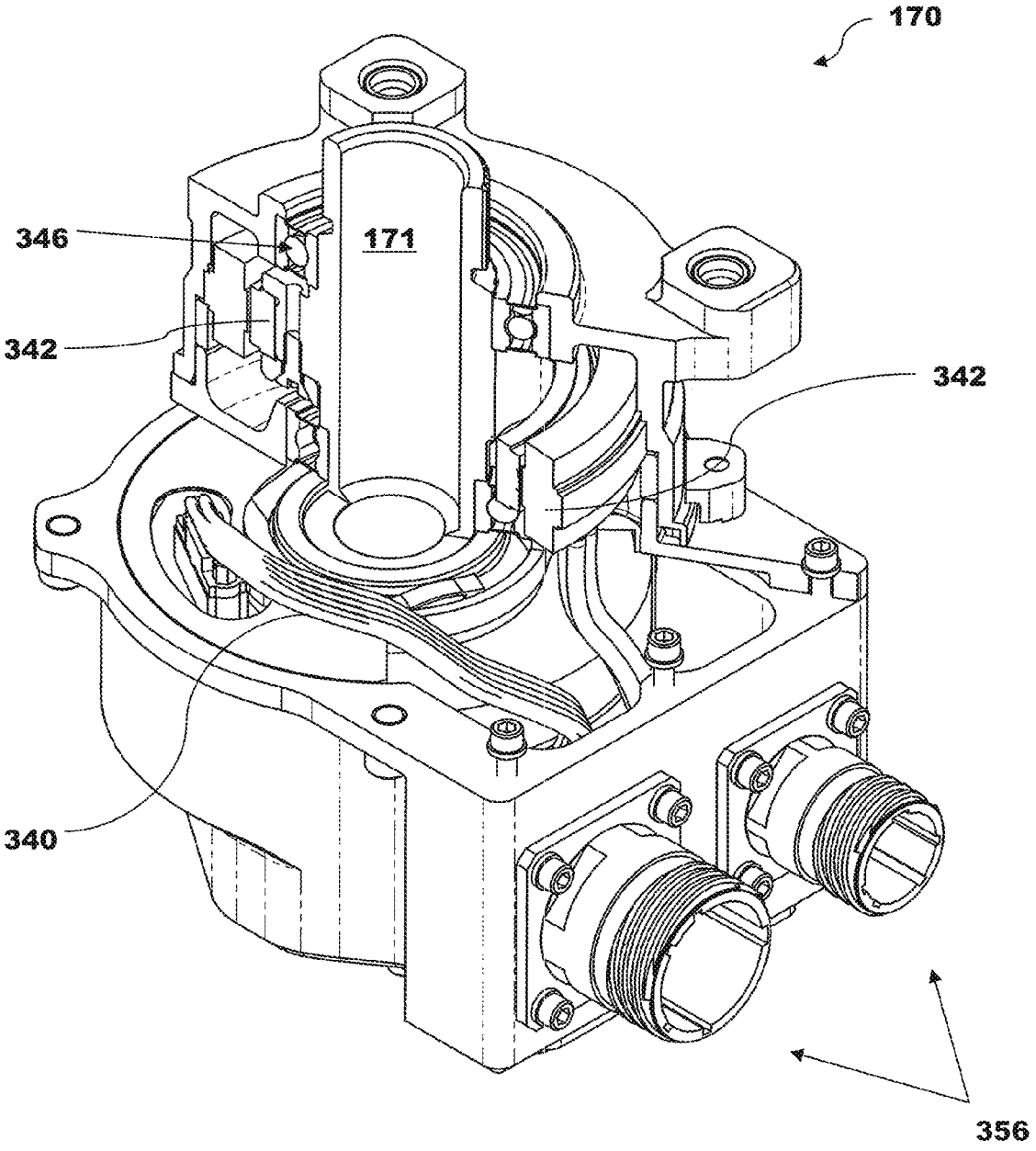
FIG. 10E is a cutaway perspective view of the motor brake assembly of FIG. 10A.

The exemplary cradle 22 may also be mounted with an MK 19. An MK19 may be mounted by the following steps. Retainer pin 158 is left in its stowage position as shown in FIG. 9C. Hooks 155 are also left in their stowage position. The receiver assembly of the MK19 may be configured to have two MK19 slots 303 located on the forward and lower portion of the receiver assembly as shown in FIG. 9G. Two MK19 front pins 302 slide into their respective MK19 slots 303. Then, a retainer pin 158 is inserted into a rear cross hole of the MK19 receiver body. An MK19 may be further secured by a retaining screw 304 that may inserted into a threaded bore located on the lower rear of the MK19 receiver assembly.

Figure 8G:
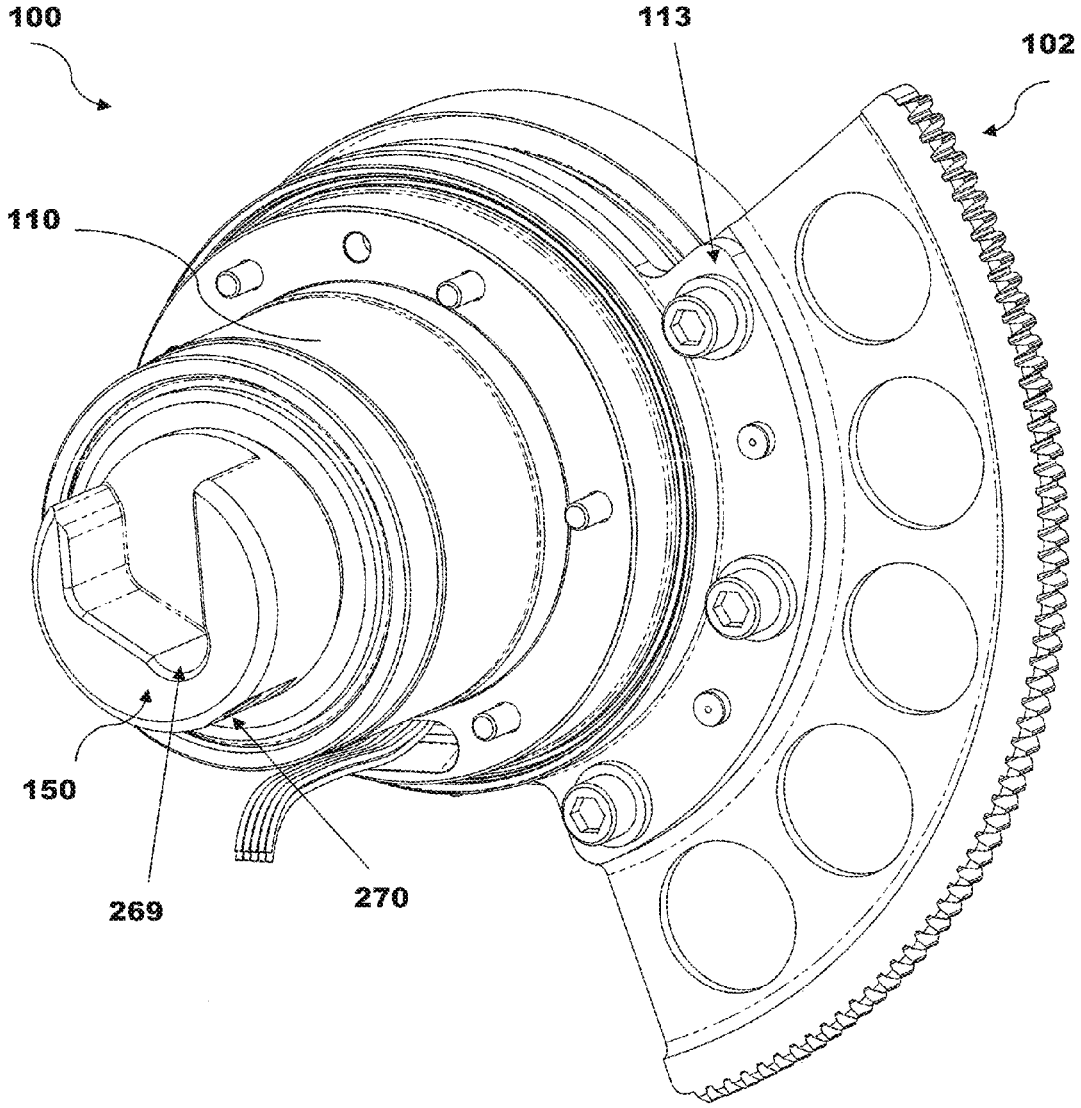
FIG. 8G is a detailed rear view of the trunnion assembly of FIG. 8F showing the cradle hub.

Cradle 22 may be readily and quickly removed from modular weapon station 10 so that the appropriate cradle 22 may be chosen depending on the class of weapon 21 selected. Quick release assemblies 169 may be provided on the outer cradle assembly 154, and may be fixedly attached to the V retaining recesses 150 of trunnion assembly 100. FIG. 8G shows the V retain recess in detail. Quick release assemblies 169 have V-shaped geometries that are complementary to their respective V retaining recesses 150. Additionally, quick release assemblies 169 may have fastening mechanisms 271 that are inserted through bores 270 of V retaining recesses 150. Each V retaining recess 150 has a radius 269 to prevent a stress riser when the quick release assemblies 169 are inserted into the V retaining recesses 150. Quick release assemblies 169 permit various cradles 22 configured to support a given weapon 21 or weapon class to be changed very quickly in the field.

Motor/Brake Assembly

FIGS. 10A through 10E will be discussed together. They depict an exemplary motor/brake assembly 170 used in one embodiment of the disclosure. As previously discussed, the azimuth movement of weapon 21 may be electrically powered by a motor/brake assembly 170 that receives signals from a controller (located either within the armored structure or remotely). A substantially similar elevation motor/brake assembly 175 may further control the height or elevation of weapon 21. Motor/brake assembly 170 and elevation motor/brake assembly 175 are functionally the same, yet the motor/brake assembly 170 drives the azimuth pinion 230 and the elevation motor/brake assembly 175 drives the elevation pinion 173. The motor/brake assemblies are also mounted approximately adjacent to their respective assemblies and may have different mounting orientations.

The motor/brake assemblies must be compact, powerful, durable, and responsive. Motor/brake assembly 170 will herein be described in more detail. Motor/brake assembly 170 includes a main motor shaft 171 that is configured to drive a timing belt 246 of the azimuth drive assembly 207 (or the timing belt of the elevation mode select assembly 172). The motor shaft 171 is rotated by a frameless motor 342. A data connector 340 may provide signals from a controller (not shown), which may be located remotely or within an armored structure, to the frameless motor 342. Deep groove ball bearings 346 allow the motor shaft to rotate within the housing 358 of the motor/brake assembly 170. Motor/brake assembly 170 may also include a resolver 348, which may include a stationary stator 350 and a rotating rotor 352. Rotor 352 may include an encoder so that feedback signals may be sent to the controller (not shown). Receptacles 356 may provide input/output electrical access from the controller to the motor/brake assembly 170 and vice versa. A brake 354 may be provided in case the motor output (or motor speed) need be reduced.

Elevation Mode Select Assembly

FIG. 12A is a schematic illustration of an elevation mode select assembly 172 and azimuth drive assembly 207 according to one embodiment of modular weapon station 10.

Modular weapon station 10 may operate in one of three modes: stabilized, power, and manual. In stabilized mode, modular weapon station 10 is receiving electrical power, and weapon 21 is isolated from the movement of an armored structure, such as an armored vehicle, by the action of gyro assembly 36 and control electronics thus improving the aiming and accuracy of weapon 21. Hence, the term "stabilized." In power mode, weapon 21 is not stabilized from the movement of an armored structure, but the modular weapon station 10 is still receiving electrical power. Thus, weapon 21 may be electrically powered to elevate or depress in an elevation direction. Modular weapon station 10 can move from stabilized mode to power mode if, for example, gyro assembly 36 fails, signals fail to reach the modular weapon station 10, or if a processor controlling modular weapon station's stabilization functions fails. In manual mode, modular weapon station 10 has lost power and thus weapon 21 can no longer be moved about in an elevation direction by electrically powered means. Hence, in the event of power loss, weapon 21 must be aimed by manual means. The elevation mode select assembly 172 allows the weapon 21 to be operated in either a manual or stabilized/power modes.

Figure 12B:
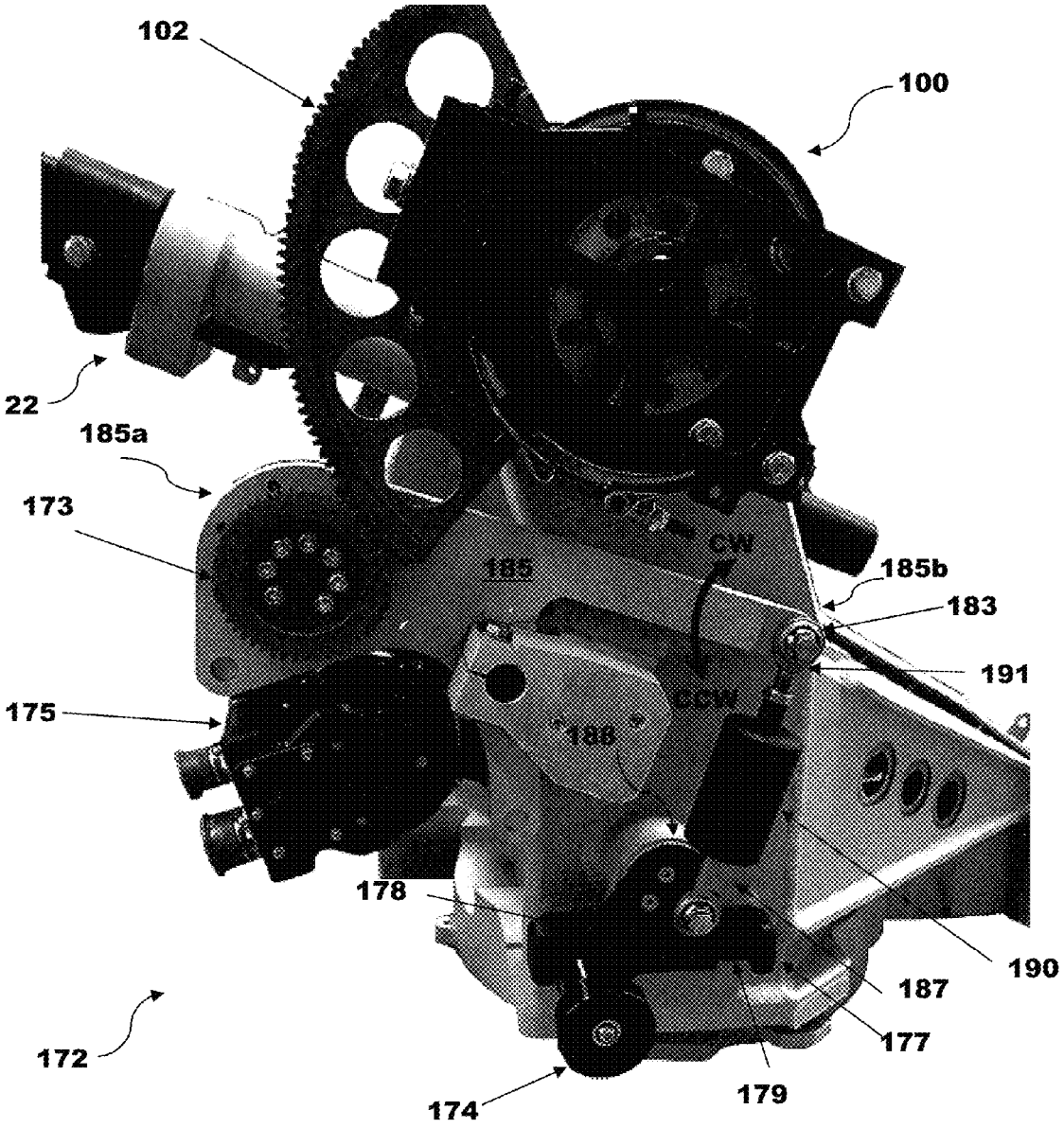
FIG. 12B is a schematic view of an elevation mode select assembly with the frame cover removed for clarity.
Figure 12C:
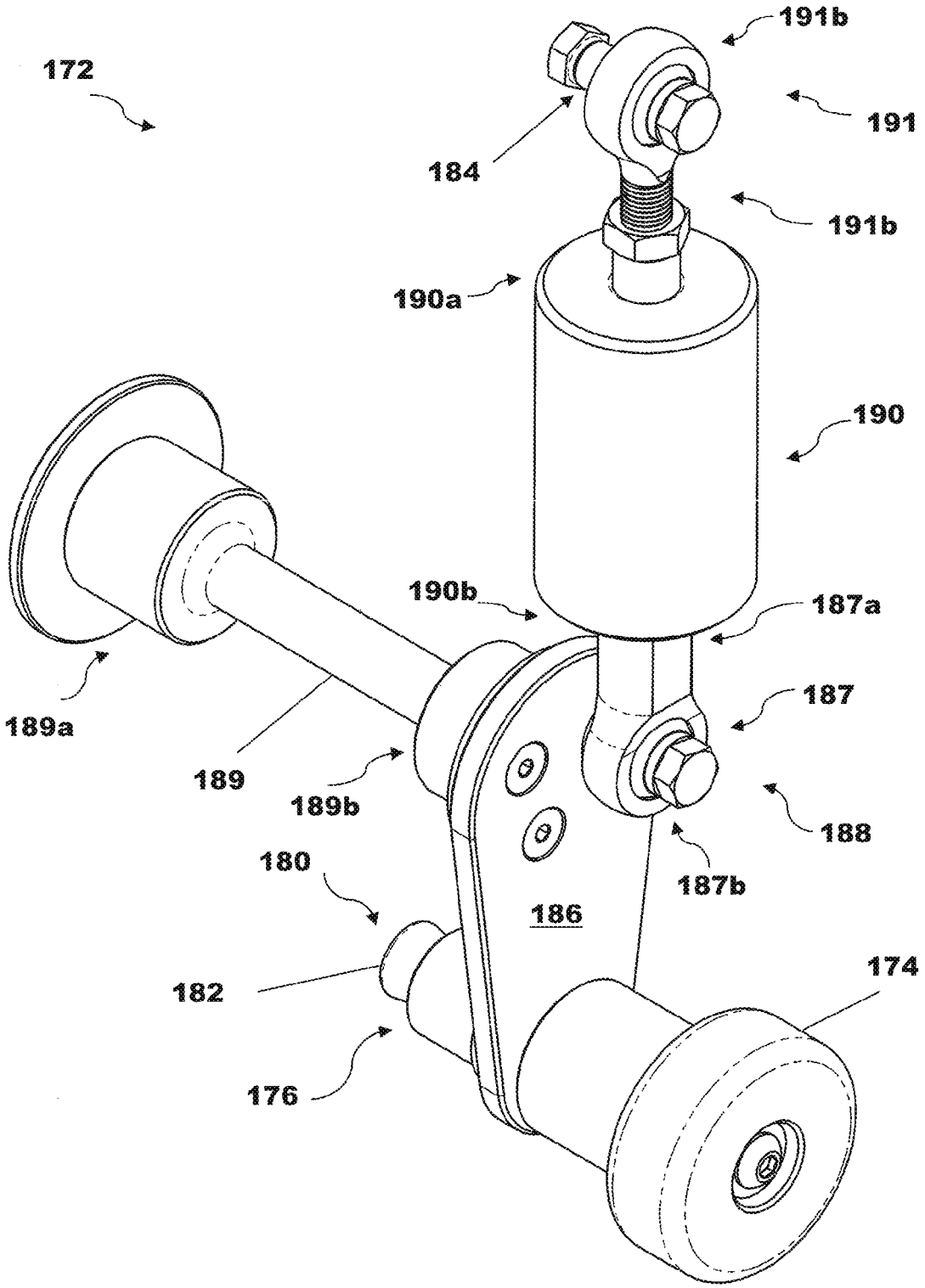
FIG. 12C is a perspective side view of an elevation mode select assembly according to one embodiment of the disclosure.

Referring now to FIGS. 12B through 12F, illustrations of an exemplary elevation mode select assembly 172 are shown. The elevation arc 26 of weapon 21 may be electrically or manually controlled. When the elevation arc 26 of weapon 21 is electrically controlled, an elevation pinion 173 coupled to an engagement portion 185*a* of elevation lever 185 engages and is in meshing communication with elevation sector gear 102, as shown in FIG. 12B. Elevation pinion 173 may be electrically powered by elevation motor/brake assembly 175 to rotate clockwise (CW) or counterclockwise (CCW) to drive elevation sector gear 102 to rotate in a direction opposite the elevation pinion 173. Elevation sector gear 102 is coupled with trunnion assembly 100, which is in turn coupled with cradle 22, weapon 21, and optical sighting unit 18. Thus, when elevation pinion 173 is driven in a given direction, elevation sector gear 102 rotates opposite the elevation pinion 173, causing the trunnion assembly 100 along with cradle 22, weapon 21, and optical sighting unit 18 to move about an elevation arc 26. This allows weapon 21 to be positioned at a given elevation to accurately strike a target.

When circumstances necessitate the need to manually fire weapon 21, elevation arc 26 of weapon 21 may be manually controlled by an operator. To switch from a powered/stabilized firing mode to a manual firing mode, elevation pinion 173 is disengaged from elevation sector gear 102. The disengagement of the elevation pinion 173 from the elevation sector gear 102 permits an operator to adjust the elevation arc 26 of weapon 21 manually.

Elevation mode select assembly 172 functions to permit an operator to switch from a power/stabilized firing mode to a manual firing mode by pivoting an elevation lever 185 about a pivot shaft 184. The elevation lever 185 is pivoted or rotated about pivot shaft 184 by an operator input in a manner to be herein described.

Figure 12D:
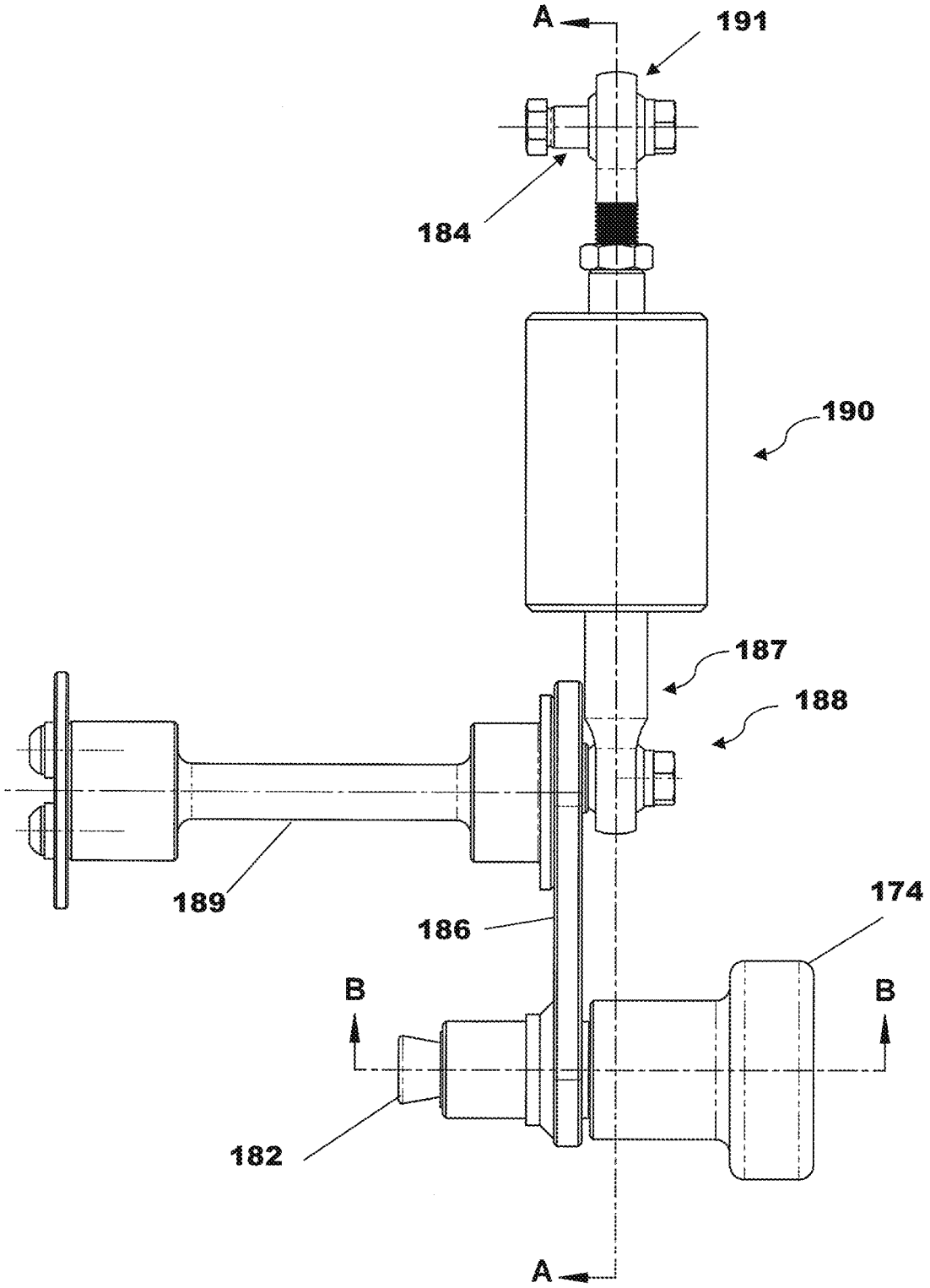
FIG. 12D is a side view of the elevation mode select assembly of FIG. 12C.
Figure 12E:
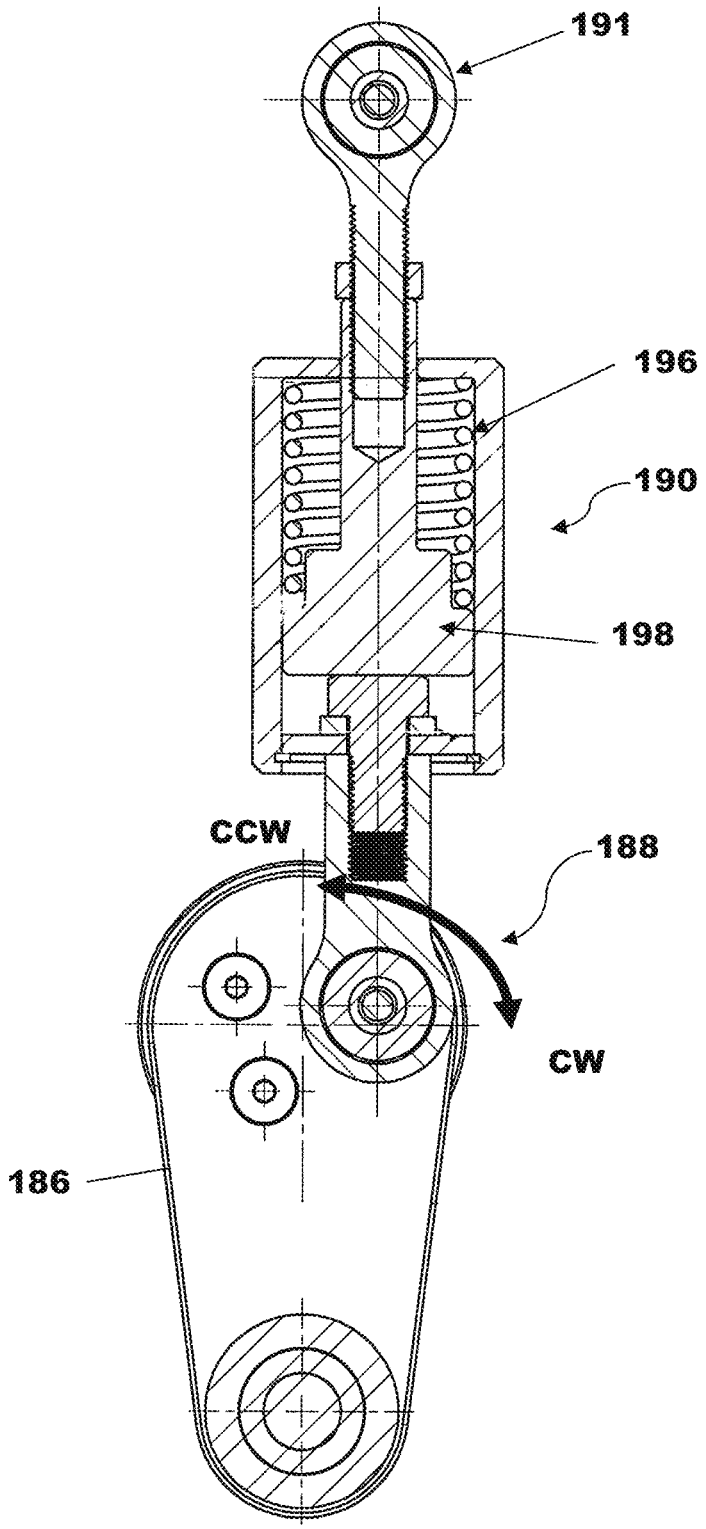
FIG. 12E is a cut away view taken along line A-A of FIG. 12D.
Figure 12F:
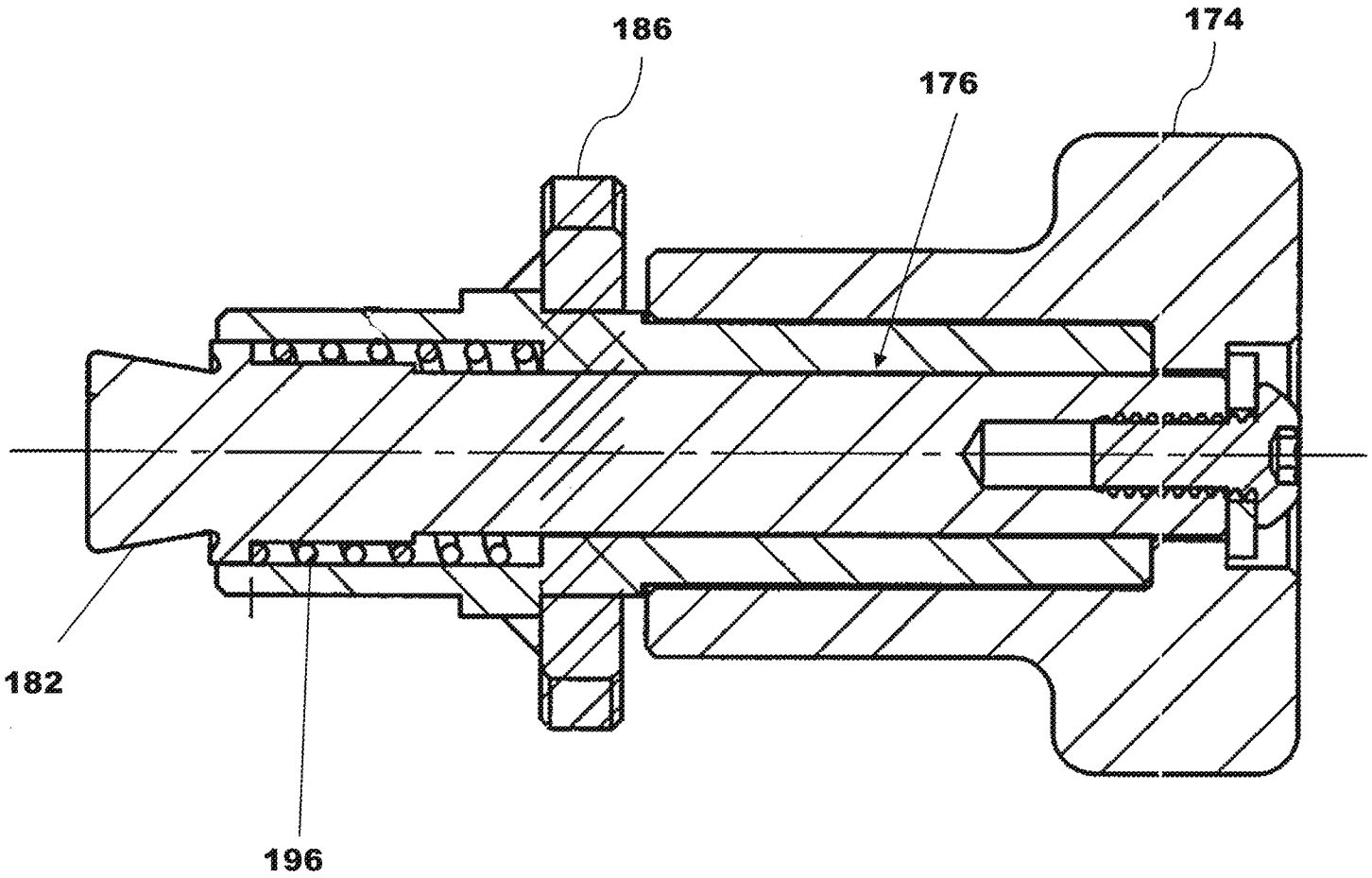
FIG. 12F is a cutaway view taken along line B-B of FIG. 12D.

Block 177 of elevation mode select assembly 172 has two positions, a power/stabilized position 178 and a manual position 179. Both positions, in this case the positions are slots, are geometrically complementary to the conical frustum 182 located at the end 180 of lockshaft 176. Conical frustum 182 is configured to cooperate with each position such that it does not disengage due to vibrational forces during operation of the weapon, which can be substantial. It has been an issue in the past that a square or round lockshaft end will necessarily undergo a degree of deformation in response to vibrational forces incurred during operation of weapon 21. Such deformation has been so significant that the square and/or round lockshaft ends have disengaged from their corresponding position, adversely affecting the elevation setting of the firing weapon. FIG. 12F, taken along line B-B of FIG. 12D, shows a side profile view of conical frustum 182.

When it is desired to switch from a power/stabilized mode to a manual firing mode, an operator would grip handgrip 174 and pull it out, causing conical frustum 182 to be removed from power/stabilized position 178. Then, an operator would translate handgrip 174 along block 177 to insert the conical frustum 182 into the manual position 179. The pulling out of handgrip 174 and translating it between the power/stabilized position 178 and manual position 179 may be accomplished with about fifteen $lb_f$ or less. As the operator is translating handgrip 174 from one position to the other, eccentric 188 rotates in a CCW direction.

Eccentric 188 is comprised of eccentric shaft 189, elevation arm 186, and eccentric rod end ball joint 187. Eccentric shaft 189 has a first portion 189*a* coupled with the rotatable frame 24 of modular weapon station 10 and a second portion 189*b* coupled with elevation arm 186. Eccentric rod end ball joint 187 has a top portion 187*a* and a bottom portion 187*b*. The top portion 187*a* is coupled with plunger bottom portion 190*b* of elevation plunger 190, and the bottom portion 187*b* is coupled with elevation arm 186.

When handgrip 174 is translated to the manual firing position, elevation arm 186 rotates in a CCW direction, which is permitted by the CCW rotation of eccentric shaft 189. Simultaneously, eccentric rod end ball joint 187 rotates with elevation arm 186 in a CCW direction. If the elevation arm 186 was labeled with hour hands as they are disposed around the face of a clock, in the power/stabilized mode, eccentric rod end ball joint 187 is in a four or five o'clock position, but when elevation arm 186 and eccentric rod end ball joint 187 are rotated about eccentric 188 in a CCW direction to a manual firing mode, it is set in the one or two o'clock position. To clarify, the eccentric rod end ball joint 187 is in a four or five o'clock position when in the power/stabilized mode and in a one or two o'clock position when in manual mode.

The CCW rotation of eccentric 188 (or the CCW rotation of eccentric rod end ball joint 187 and elevation arm 186) causes loaded piston 198 to compress spring 196 housed within elevation plunger 190 to compress. Elevation plunger 190 has a plunger top portion 190*a* coupled with a threaded portion 191*b* of ball joint rod end 191 and a plunger bottom portion 190*b* coupled with the top portion 187*a* of eccentric ball joint rod end 187. The elevation plunger 190 serves to dampen vibration during weapon operation and to keep weapon 21 at the selected elevation. The compression of compression spring 196 and the rotation of eccentric 188 causes a pivot rod end ball joint 191 to apply an upward force at its pivot portion 191*a*, causing the elevation lever 185 to rotate about pivot shaft 184 in a CCW direction. The elevation lever 185 is coupled to the pivot shaft 184 at its lever pivot portion 185*b*. This CCW movement causes the elevation pinion 173 to disengage from elevation sector gear 102. When the elevation pinion 173 is disengaged from elevation sector gear 102, weapon 21 may be fired manually.

When it is desired to switch from an elevation manual mode to an elevation power/stabilized firing mode, essentially the opposite movements are undertaken. An operator would grip handgrip 174 and pull it out, causing conical frustum 182 to be removed from manual position 179. Then, an operator would translate handgrip 174 along block 177 to insert the conical frustum 182 into the power/stabilized position 178. The pulling out of handgrip 174 and translating it between the manual position 179 and power/stabilized position 178 may be accomplished with about fifteen $lb_f$ or less. As the operator is translating handgrip 174 from one position to the other, eccentric 188 rotates in a CW direction.

When handgrip 174 is translated to the power/stabilized firing position, elevation arm 186 rotates in a CW direction, which is permitted by the CW rotation of eccentric shaft 189. Simultaneously, eccentric rod end ball joint 187 is rotated in a CW direction as well. Eccentric rod end ball joint 187 is allowed to rotate back to a four or five o'clock position from the one or two o'clock position that it was in while in manual mode.

The rotation of eccentric 188 (or the CW movement of elevation arm 186 and eccentric rod end ball joint 187) causes compression spring 196 to return approximately to its static equilibrium state. The decompression of compression spring 196 and the rotation of eccentric 188 causes the pivot rod end ball joint 191 causes the upward force that spring plunger 190 and pivot rod end ball joint 191 were previously applying to dissipate. Pivot rod end ball joint 191 also rotates slightly about pivot shaft 184 in a CW direction. This in turn causes the elevation lever 185 to rotate about pivot shaft 184 and pivot point 183 in a CW direction. This CW movement causes the elevation pinion 173 to engage elevation sector gear 102 as shown in FIG. 12B. Thus, the elevation setting of weapon 21 may be adjusted electrically in a power/stabilized mode.

Azimuth Drive Assembly

Referring now to FIGS. 13A through 13E, an example embodiment of an azimuth drive assembly 207 is depicted. Modular weapon station 10 and weapon 21 may be actuated in an azimuth direction electrically or manually, or in other words, in a power/stabilized mode or in a manual mode, respectively. An operator may select the mode of operation by actuating a mode select handle 210. When it is desired to move modular weapon station 10 about in an azimuth direction in a power/stabilized mode, mode select handle 210 is moved into the power/stabilized position 240, which has the ultimate effect of causing azimuth pinion 230 to engage and be in meshing communication with azimuth ring gear 38. A controller (not shown) located remotely or from an under armor position may send data signals to the motor/brake assembly 170 to drive azimuth pinion 230 about azimuth ring gear 38 to move modular weapon station 10 to the appropriate position. When it is desired to move modular weapon station 10 about in an azimuth direction in a manual mode, mode select handle 210 is moved into the azimuth manual position 242, which ultimately causes azimuth pinion 230 to disengage azimuth ring gear 38. Modular weapon station 10 and weapon 21 may then be rotated in an azimuth direction manually by an operator.

Azimuth drive assembly 207 will be hereinafter described in more detail. Azimuth drive assembly 207 includes a lower swing plate 232 and an upper swing plate 234 that are spaced apart by spacer 233 to allow for various components to be fit in between the upper and lower plates. FIG. 13C details how the motor/brake assembly 170 drives the azimuth pinion 230. Motor/brake assembly 170 is fixedly attached to upper swing plate 234 and provides the necessary power to drive azimuth pinion 230 about azimuth ring gear 38. The motor shaft 171 of motor/brake assembly 170 drives a timing belt 246 about a sprocket assembly 247 that is coupled with a shaft of gear reducer 248, which in turn drives azimuth pinion 230 at the appropriate angular velocity to drive and control the azimuth movement of modular weapon station 10 and the selected weapon 21. Belt guard 249 protects the belt from environmental contaminants and may be readily removed for maintenance.

Azimuth drive assembly 207 includes a rotatable azimuth drive assembly 208 and a fixed azimuth drive assembly 209. The fixed azimuth drive assembly 209 is fixedly attached to rotatable frame 24 of modular weapon station 10. The fixed drive assembly 209 comprises of an azimuth pivot shaft 236 that allows for the rotatable azimuth drive assembly 208 to pivot about azimuth pivot axis 238. The pivoting of the rotatable azimuth drive assembly 208 about azimuth pivot axis 238 moves the azimuth pinion 230 in an out of communication with azimuth ring gear 38.

Figure 13A:
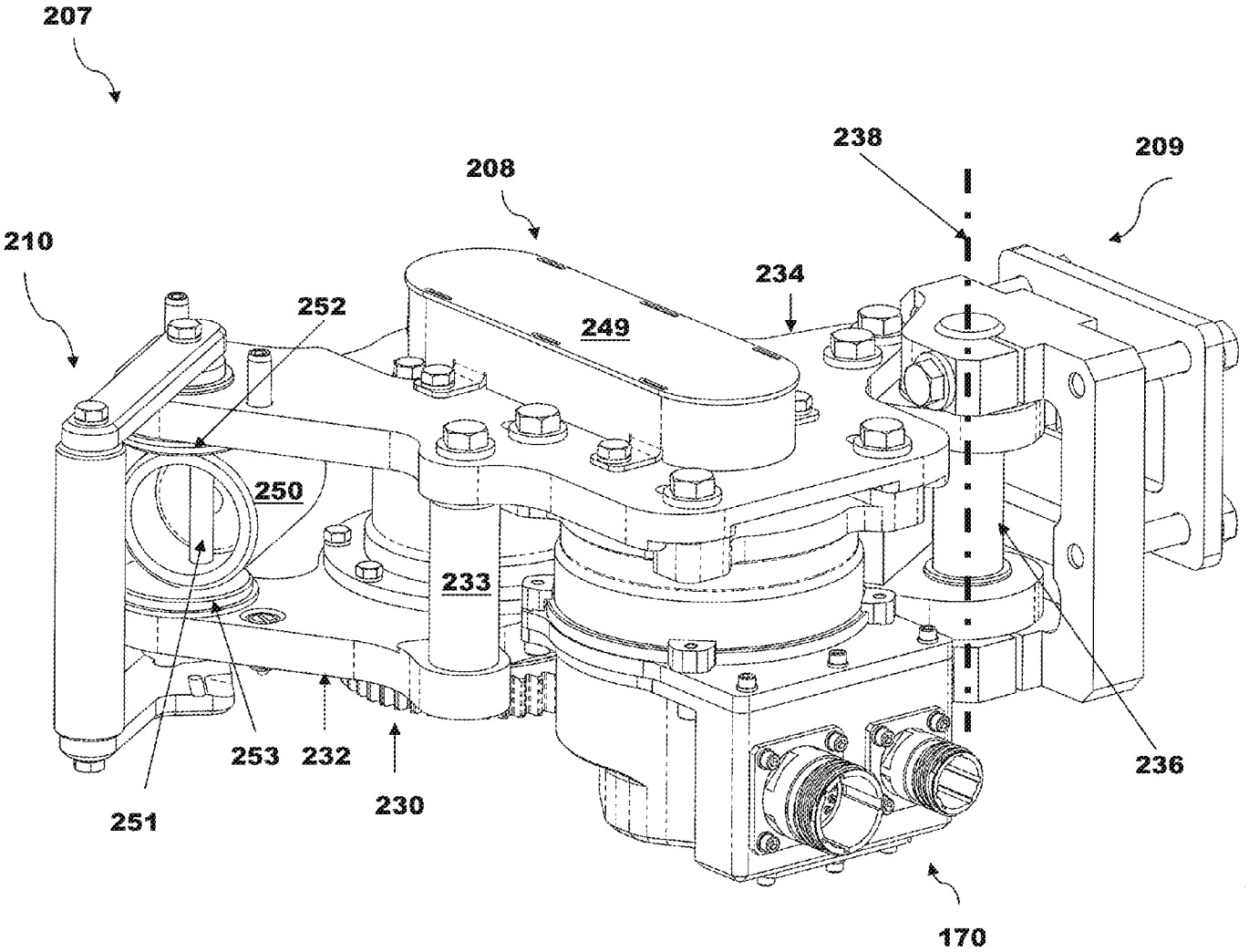
FIG. 13A is a perspective side view of an azimuth drive assembly for one embodiment of the disclosure.
Figure 13B:
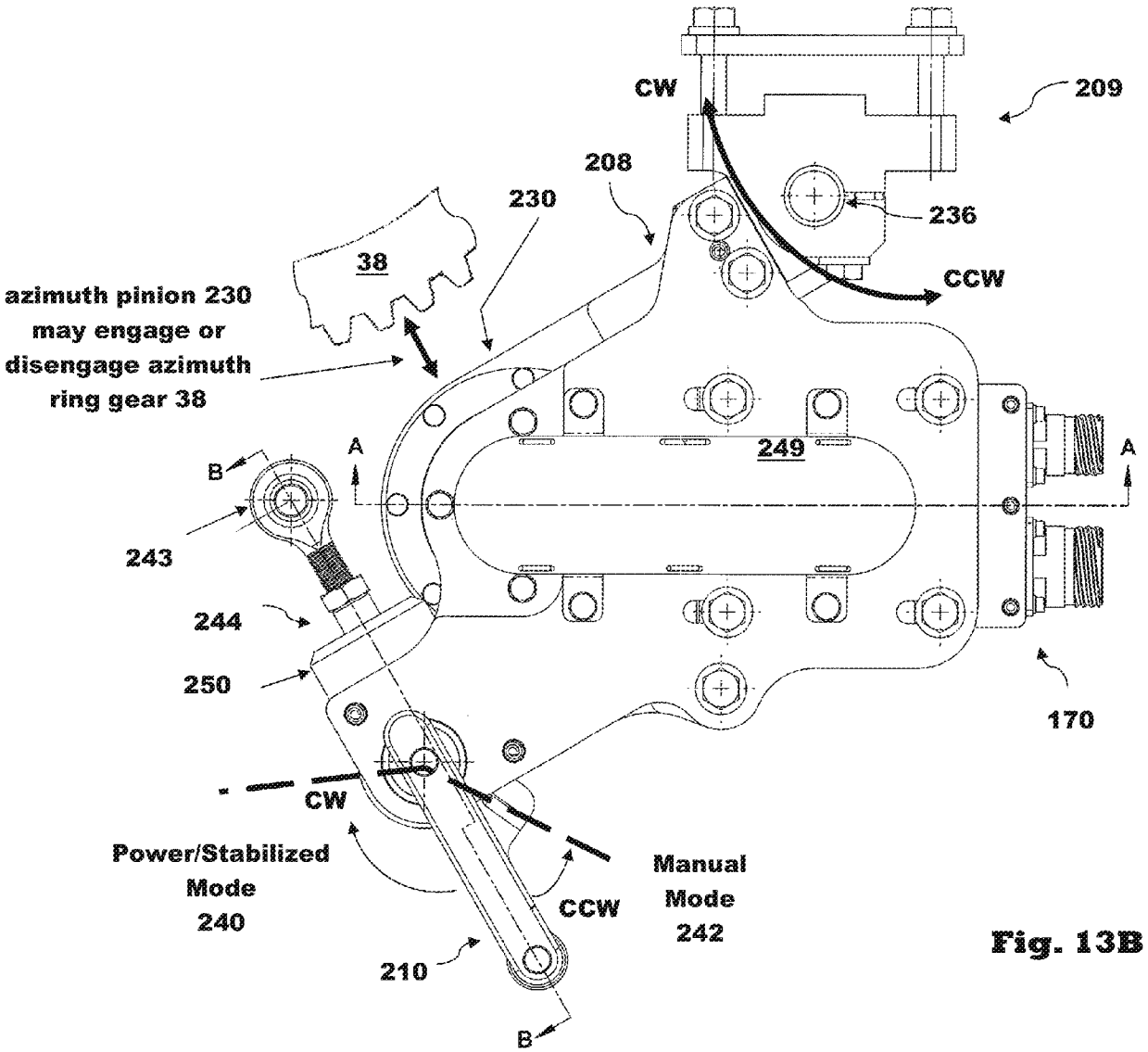
FIG. 13B is a top plan view of the azimuth drive assembly of FIG. 13A.
Figure 13C:
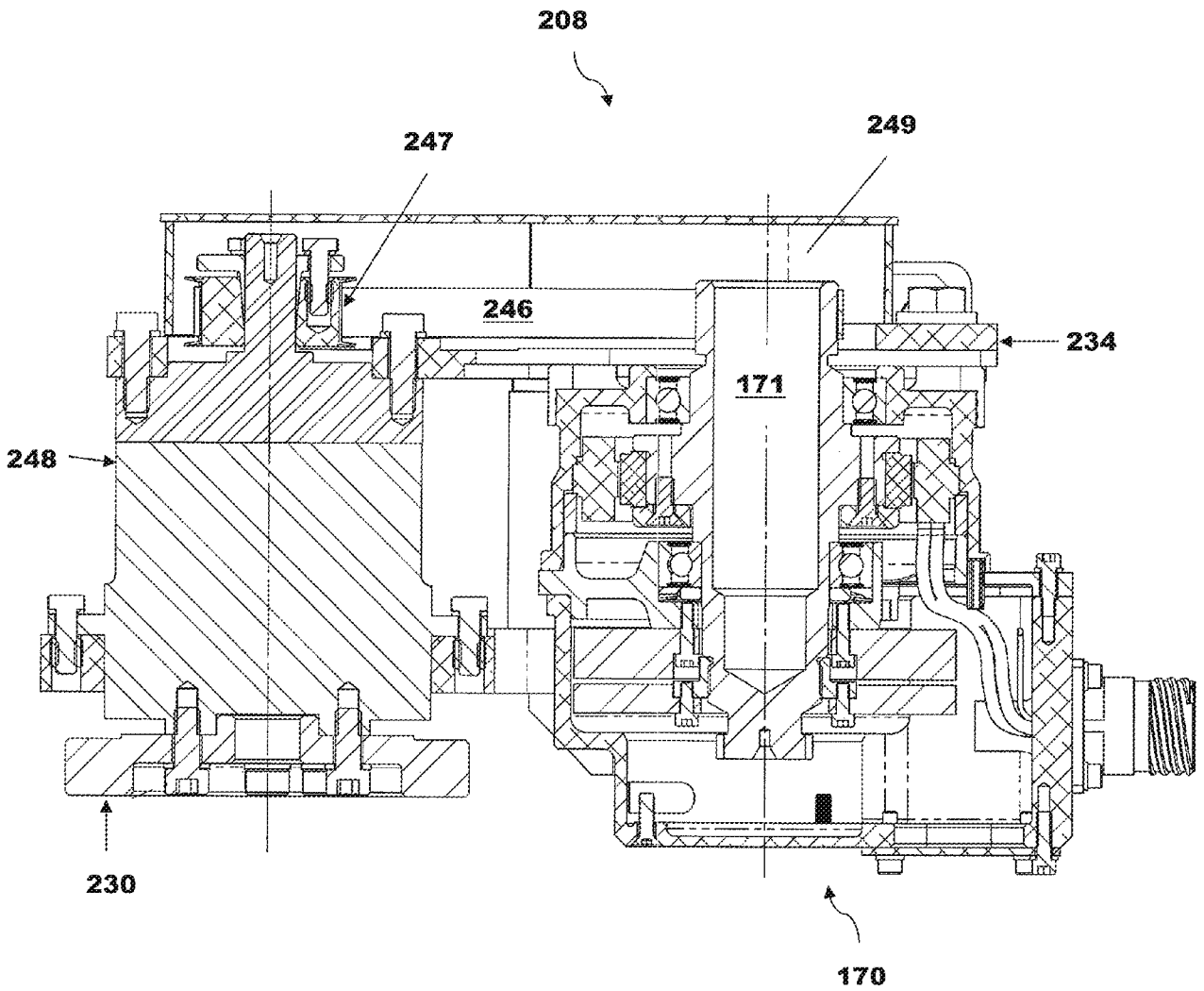
FIG. 13C is a cutaway view taken along line A-A of FIG. 13B.
Figure 13D:
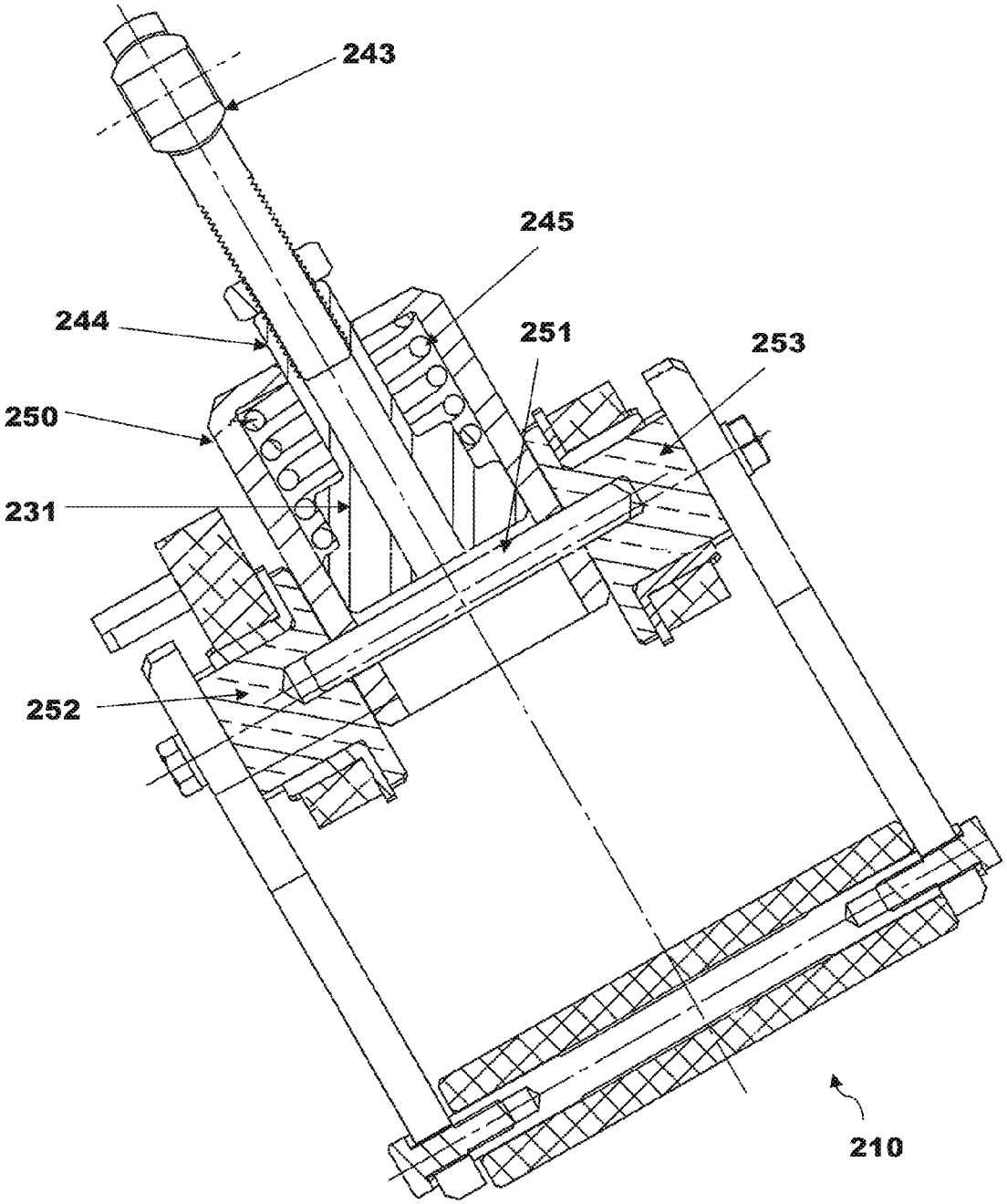
FIG. 13D is a is a sectional view taken along line B-B of FIG. 13B.
Figure 13E:
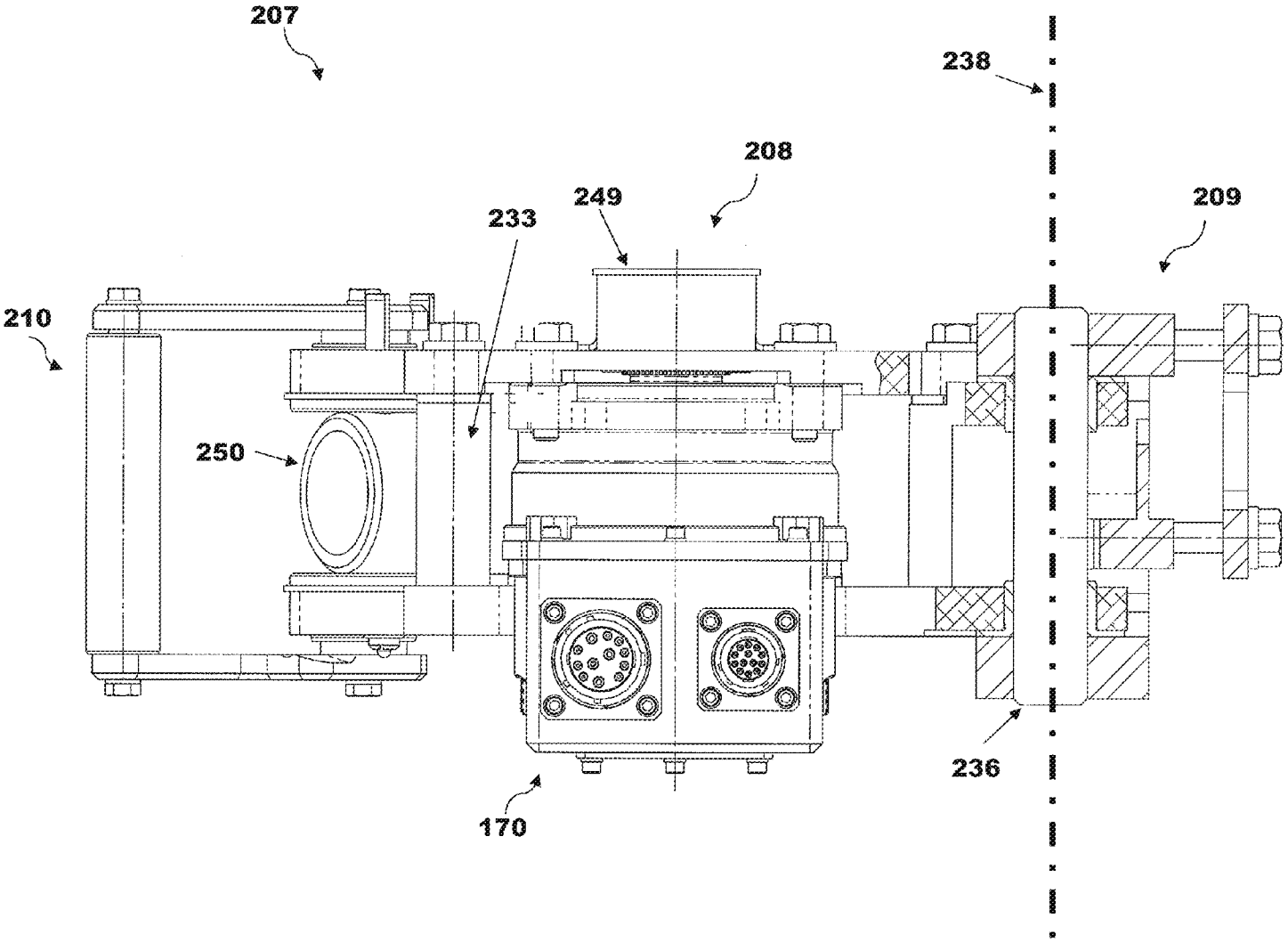
FIG. 13E is a front plan view of the azimuth drive assembly of FIG. 13A.

To move the azimuth drive assembly 207 into the power/stabilized mode of operation, mode select handle 210 is moved in a CW direction into the power/stabilized position 240 as shown in FIG. 13B. As the mode select handle 210 is moved into the power/stabilized position 240, the rotatable azimuth drive assembly 208 pivots in a CW direction about azimuth pivot axis 238, which engages the azimuth pinion 230 with the azimuth ring gear 38, and at the same time, an azimuth compression spring 245 of azimuth spring plunger 244 is compressed by azimuth piston 231, locking the rotatable azimuth drive assembly 208 firmly into place. An azimuth spring cup 250 protects azimuth spring plunger 244 and houses the connection between the spring plunger 244 and rod end 243. A dowel pin 251 that passes through azimuth spring cup 250 may be used to align the upper cam journal 252 and lower cam journal 253 of mode select handle 210. The upper cam journal 252 and lower cam journal 253 allow slight rotation of the azimuth spring cup 250 to allow for the compression and decompression of azimuth compression spring 245. Rod end 243 is coupled with a pivot shaft (not shown) located on rotatable frame 24 of modular weapon station 10.

To move the azimuth drive assembly 207 into the manual mode of operation, mode select handle 210 is moved in a CCW direction into the azimuth manual position 242 as shown in FIG. 13B. As the mode select handle 210 is moved into the azimuth manual position 242, the rotatable azimuth drive assembly 208 pivots in a CCW direction about azimuth pivot axis 238, which disengages the azimuth pinion 230 from the azimuth ring gear 38, and simultaneously, azimuth compression spring 245 of azimuth spring plunger 244 is permitted to decompress, unlocking the rotatable azimuth drive assembly 208. An operator may readily control the azimuth drive assembly 207 in a power/stabilized or manual mode. No matter the direction mode select handle 210 is moved, about fifteen $lb_f$ or less is required. Under battle conditions, the small force required to move the mode select handle 210 may allow even an injured operator to change to the mode of the weapon 21.

Electronics Access Plate

Figure 11A:
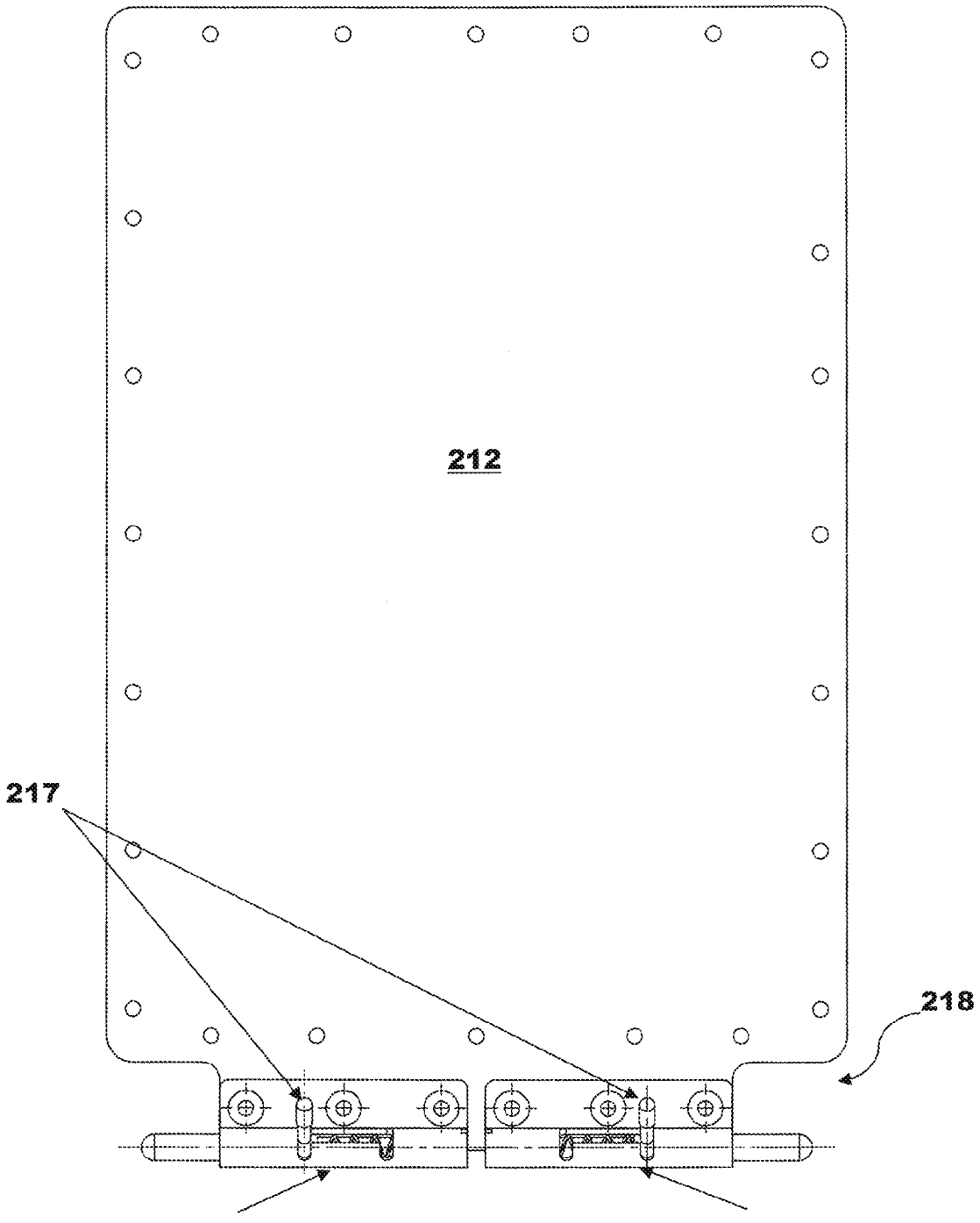
FIG. 11A is a front view of an access plate for the electronics for one embodiment of the disclosure.
Figure 11B:
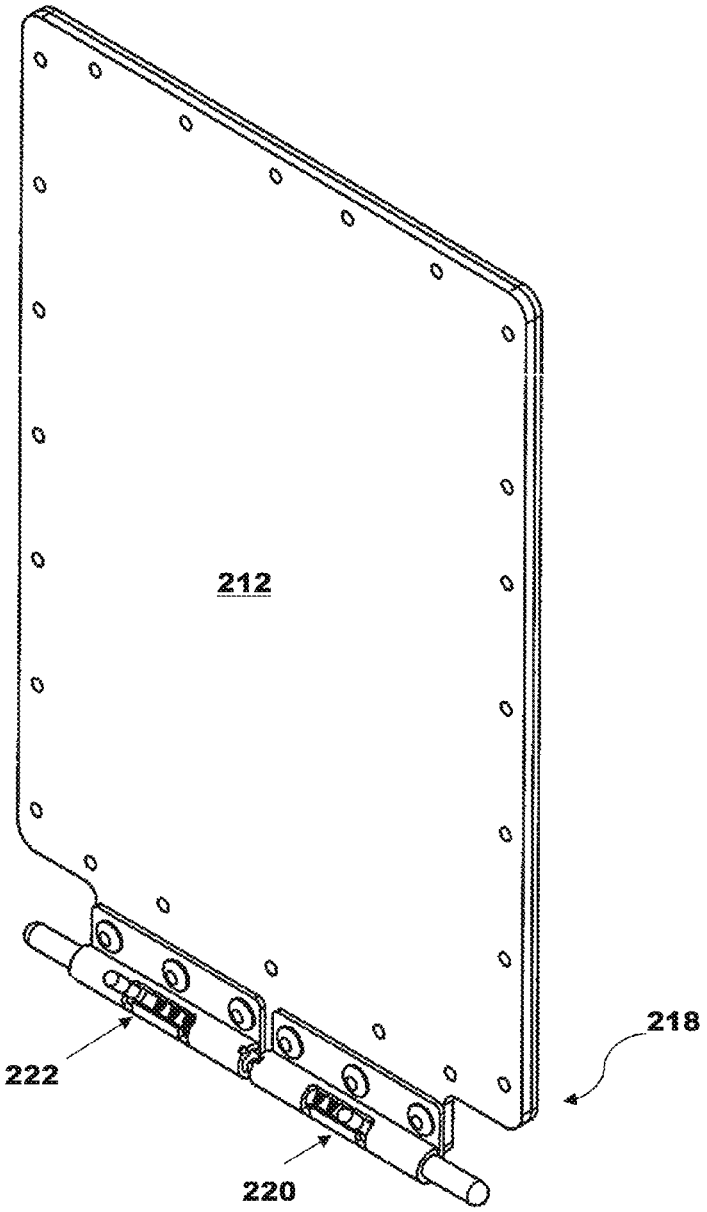
FIG. 11B is a perspective view showing the access plate of FIG. 11A.
Figure 11C:
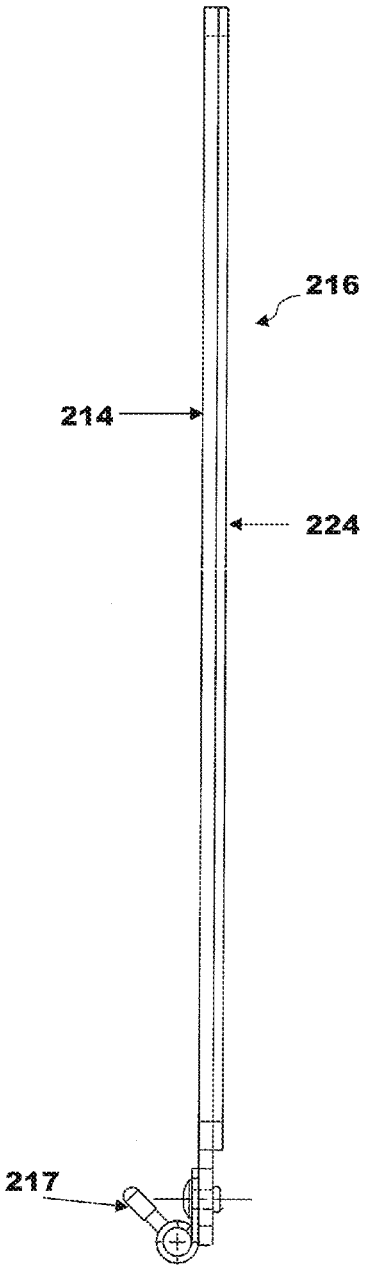
FIG. 11C is a side view of the access plate of FIG. 11A.

FIGS. 11A through 11C depict an exemplary electronics access hatch. Specifically, the access plate 212 is made of an armor material, and has a front 214 and opposed back 216. At its pivot end 218 there are hinges 220 and 222. The hinges are equipped with biased pivot pins 217 so that when the operator desires to remove the access plate 212 from the rotatable frame 24 of modular weapon station 10 the pivot pins 217 are biased toward each other to release the access plate 212. The hinges 220 and 222 may further be equipped with a stop to limit the range of motion about the hinge. The access plate 212 may be equipped with a sealing gasket 224 to seal the electronics compartment from environmental contamination. The electronics controlling modular weapon station 10 may be mounted within the electronics compartment of rotatable frame 24 and may be easily accessed by the pivoting of access plate 212 when it is needed to easily remove/replace electronics.

While one embodiment of has been disclosed, the words for the disclosure used are words of description and not words of limitation. Those skilled in the art recognize that many variations and modifications are possible without departing from the scope and spirit of the invention as set forth in the appended claims.

What is claimed as new and desired to be protected by Letters Patent of the United States is:

1. A modular weapon station mountable on a platform and adapted to secure a weapon for firing, comprising:

a rotatable frame;

a rotatable drum coupled with and rotatable with said rotatable frame, said rotatable drum configured with a side wall opening which is accessible from an under armor position such that a plurality of ammunition rounds may be replenished from said under armor position;

an ammunition tray mounted within said rotatable drum, said ammunition tray configured to be pivoted into the side wall opening for ease of replenishing ammunition;

an ammunition feed path stemming from said rotatable drum to said weapon;

a plurality of ammunition feeds disposed along said ammunition feed path, at least one of said ammunition feeds configured to aid in the transport of said plurality of ammunition rounds from said under armor position to said weapon; and a stationary drum substantially enclosing said rotatable drum, said stationary drum equipped with at least one access door configured to be operable by a latch, said latch operable by one hand.

2. The modular weapon station of claim 1, wherein said modular weapon station further comprises an ammunition feed chute coupled with said rotatable frame and having a weapon feed end, said weapon feed end having an angle relative to a longitudinal axis substantially the same as the midpoint of an elevation range of said weapon.

3. The modular weapon station of claim 1, wherein said modular weapon station further comprises an ammunition feed chute coupled with said rotatable frame and said ammunition feed chute having an angled top portion, said angled top portion having an angle relative to a vertical axis.

4. The modular weapon station of claim 1, wherein at least one of said ammunition feeds is configured to maintain a longitudinal orientation of said plurality of ammunition rounds traveling from said rotatable drum to a base portion of an ammunition feed chute coupled with said rotatable frame.

5. The modular weapon station of claim 1, wherein said modular weapon station further comprises a plurality of low ammunition sensors configured to detect that said plurality of ammunition rounds have been depleted to a predetermined amount, and said modular weapon station is configured to send an alert signal that said plurality of ammunition rounds have been depleted to a predetermined amount.

6. The modular weapon station of claim 1, wherein said weapon mountable on said modular weapon station has an automatic feed mechanism, and said automatic feed mechanism is configured to pull said plurality of ammunition rounds from said rotatable drum to said weapon.

7. The modular weapon station of claim 1, wherein said modular weapon station is configured to be switchable between a direct feed mode and a load under armor mode.

8. The modular weapon station of claim 1, wherein rotatable frame further comprises an azimuth drive assembly that allows for said weapon to be switchable between a power/stabilized firing mode and a manual firing mode in an azimuth direction.

9. The modular weapon station of claim 1, wherein rotatable frame further comprises an elevation mode select assembly that allows for said weapon to be switchable between a power/stabilized firing mode and a manual firing mode in an elevation direction.

* * * * *